US010449428B2

(12) United States Patent
Parsons et al.

(10) Patent No.: US 10,449,428 B2
(45) Date of Patent: Oct. 22, 2019

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Robert R. Parsons, Scottsdale, AZ (US); Michael R. Nicolette, Scottsdale, AZ (US); Bradley D. Schweigert, Anthem, AZ (US)

(73) Assignee: Parsons Xtreme Golf, LLC, Scottsdale, AZ (US)

( * ) Notice: Subject to any disclaimer, the term of this patent is extended or adjusted under 35 U.S.C. 154(b) by 0 days.

(21) Appl. No.: 16/272,269

(22) Filed: Feb. 11, 2019

(65) Prior Publication Data

US 2019/0247726 A1 Aug. 15, 2019

Related U.S. Application Data

(60) Provisional application No. 62/629,459, filed on Feb. 12, 2018, provisional application No. 62/714,948, filed on Aug. 6, 2018, provisional application No. 62/722,491, filed on Aug. 24, 2018, provisional application No. 62/732,062, filed on Sep. 17, 2018, provisional application No. 62/755,160, filed on Nov. 2, 2018, provisional application No. 62/756,446, filed (Continued)

(51) Int. Cl.
*A63B 53/04* (2015.01)
*A63B 60/54* (2015.01)

(52) U.S. Cl.
CPC ..... *A63B 53/0475* (2013.01); *A63B 60/54* (2015.10); *A63B 2053/0479* (2013.01)

(58) Field of Classification Search
CPC ..... A63B 53/047; A63B 53/0475; A63B 2053/0479; A63B 60/54
USPC ..... 473/324–350, 287–292
See application file for complete search history.

(56) References Cited

U.S. PATENT DOCUMENTS 723,258 A * 3/1903 Felton ..... A63B 53/0466 473/329
1,133,129 A 3/1915 Govan
(Continued)

FOREIGN PATENT DOCUMENTS

DE 29715997 2/1998
GB 2249031 4/1992
(Continued)

OTHER PUBLICATIONS

Machine translation of DE 29715997 (Published Feb. 12, 1998 by Linphone)—Translation of description obtained Jun. 1, 2019, via Espacenet. (Year: 2019).*

(Continued)

*Primary Examiner* — Sebastiano Passaniti

(57) ABSTRACT

Embodiments of golf club heads, golf clubs, and methods to manufacture golf club heads and golf clubs are generally described herein. In one example, a golf club head may include a body portion comprising a first material. The body portion may have a toe portion, a heel portion, a top portion, a sole portion, a back portion, a front portion having a face portion. The golf club head may include an interior cavity partially, substantially, or entirely filled with a first filler material and a second filler material. Other examples and embodiments may be described and claimed.

19 Claims, 25 Drawing Sheets

Related U.S. Application Data on Nov. 6, 2018, provisional application No. 62/787,554, filed on Jan. 2, 2019, provisional application No. 62/792,191, filed on Jan. 14, 2019.

(56) References Cited

U.S. PATENT DOCUMENTS 1,534,600 A 4/1925 Mattern
1,538,312 A 5/1925 Beat
D138,438 S 8/1944 Link
3,020,048 A 2/1962 Carroll
3,266,805 A 8/1966 Bulla
D215,101 S 9/1969 Sabat
D229,431 S 11/1973 Baker
3,843,122 A * 10/1974 Florian ..... A63B 53/007 473/329
D234,609 S 3/1975 Raymont
D239,550 S 4/1976 Timbrook
D240,748 S 7/1976 Bock
4,085,934 A 4/1978 Churchward
D253,778 S 12/1979 Madison
4,502,687 A 3/1985 Kochevar
4,523,759 A 6/1985 Igarashi
4,545,580 A 10/1985 Tomita
4,591,160 A * 5/1986 Piragino ..... A63B 53/04 473/326
D294,617 S 3/1988 Perkins
4,754,977 A 7/1988 Sahm
4,803,023 A 2/1989 Enomoto
4,824,116 A 4/1989 Nagamoto
4,928,972 A 5/1990 Nakanishi
4,988,104 A 1/1991 Shiotani
5,028,049 A 7/1991 McKeighen
5,090,702 A 2/1992 Viste
5,158,296 A 10/1992 Lee
5,176,384 A 1/1993 Sata
5,184,823 A 2/1993 Desboilles
5,213,328 A 5/1993 Long
D336,672 S 6/1993 Gorman
5,244,211 A 9/1993 Lukasiewicz
5,290,036 A * 3/1994 Fenton ..... A63B 53/04 473/332
5,306,450 A * 4/1994 Okumoto ..... A63B 53/04 264/45.1
5,348,302 A 9/1994 Sasamoto
D351,883 S 10/1994 Serrano
5,351,958 A 10/1994 Helmstetter
5,419,559 A 5/1995 Melanson
5,419,560 A 5/1995 Bamber
5,421,577 A 6/1995 Kobayashi
5,425,535 A 6/1995 Gee
D361,358 S 8/1995 Simmons
5,447,311 A 9/1995 Viollaz
5,451,056 A 9/1995 Manning
D362,885 S 10/1995 Sheeley
5,485,998 A 1/1996 Kobayashi
5,518,243 A 5/1996 Redman
5,540,437 A 7/1996 Bamber
5,595,548 A * 1/1997 Beck ..... B22D 19/00 473/324
D378,111 S 2/1997 Parente
5,637,045 A 6/1997 Igarashi
5,647,808 A 7/1997 Hosokawa
5,649,873 A 7/1997 Fuller
5,669,830 A 9/1997 Bamber
5,766,091 A 6/1998 Humphrey
5,766,092 A 6/1998 Mimeur
5,769,735 A 6/1998 Hosokawa
5,772,527 A 6/1998 Liu
5,788,584 A 8/1998 Parente
5,797,807 A 8/1998 Moore
5,827,132 A 10/1998 Bamber
5,899,821 A 5/1999 Hsu
5,935,016 A 8/1999 Antonious
6,012,990 A 1/2000 Nishizawa
D421,080 S 2/2000 Chen
6,064,568 A 5/2000 Schmitt
D426,276 S 6/2000 Besnard et al.
6,077,171 A 6/2000 Yoneyama
6,162,133 A 12/2000 Peterson
6,165,081 A 12/2000 Chou
D442,659 S 5/2001 Solheim
6,231,458 B1 5/2001 Cameron
6,238,302 B1 5/2001 Helmstetter
D445,862 S 7/2001 Ford
6,290,609 B1 9/2001 Takeda
6,386,990 B1 5/2002 Reyes
D469,833 S 2/2003 Roberts
D475,107 S 5/2003 Madore
D478,140 S 8/2003 Burrows
6,638,182 B2 10/2003 Kosmatka
6,695,714 B1 2/2004 Bliss
6,702,693 B2 3/2004 Bamber
6,780,123 B2 8/2004 Hasebe
6,811,496 B2 11/2004 Wahl
6,830,519 B2 12/2004 Reed
6,855,067 B2 2/2005 Solheim
D502,975 S 3/2005 Schweigert et al.
D503,204 S 3/2005 Nicolette et al.
D508,545 S 8/2005 Roberts et al.
D508,969 S 8/2005 Hasebe
6,923,733 B2 8/2005 Chen
D514,183 S 1/2006 Schweigert
6,984,180 B2 1/2006 Hasebe
D523,501 S 6/2006 Schweigert
7,121,956 B2 10/2006 Lo
7,128,663 B2 10/2006 Bamber
7,153,222 B2 12/2006 Gilbert
D534,595 S 1/2007 Hasebe
7,156,751 B2 1/2007 Wahl
7,169,057 B2 1/2007 Wood
7,182,698 B2 2/2007 Tseng
7,207,900 B2 4/2007 Nicolette
D543,601 S 5/2007 Kawami
7,281,991 B2 10/2007 Gilbert
D555,219 S 11/2007 Lin
7,303,486 B2 12/2007 Imamoto
7,351,164 B2 4/2008 Schweigert
7,396,299 B2 7/2008 Nicolette
7,553,241 B2 6/2009 Park
7,582,024 B2 9/2009 Shear
7,588,502 B2 9/2009 Nishino
7,594,862 B2 9/2009 Gilbert
7,611,424 B2 11/2009 Nagai
7,658,686 B2 2/2010 Soracco
D618,293 S 6/2010 Foster et al.
7,744,484 B1 6/2010 Chao
7,744,486 B2 6/2010 Hou
7,744,487 B2 6/2010 Tavares
7,749,100 B2 7/2010 Tavares
7,785,212 B2 * 8/2010 Lukasiewicz, Jr. ..... A63B 53/0466 473/332
7,794,333 B2 9/2010 Wallans
7,798,917 B2 9/2010 Nguyen
7,803,068 B2 9/2010 Clausen
7,815,521 B2 10/2010 Ban
7,846,040 B2 12/2010 Ban
7,938,738 B2 5/2011 Roach
8,012,040 B2 9/2011 Takechi
8,062,150 B2 11/2011 Gilbert
8,088,025 B2 1/2012 Wahl
8,092,319 B1 1/2012 Cackett
8,105,180 B1 1/2012 Cackett
8,221,262 B1 7/2012 Cackett
8,246,487 B1 8/2012 Cackett
8,257,196 B1 9/2012 Abbott
8,262,506 B2 9/2012 Watson
8,277,337 B2 10/2012 Shimazaki
8,328,662 B2 12/2012 Nakamura
8,376,878 B2 2/2013 Bennett
8,393,976 B2 3/2013 Soracco
D681,142 S 4/2013 Fossum et al.
8,414,422 B2 4/2013 Peralta

(56) References Cited

U.S. PATENT DOCUMENTS

| | | | |
|---|---|---|---|
| 8,449,406 | B1 | 5/2013 | Frame |
| 8,475,293 | B2 | 7/2013 | Morin |
| 8,506,420 | B2 | 8/2013 | Hocknell |
| 8,535,176 | B2 | 9/2013 | Bazzel |
| 8,545,343 | B2 | 10/2013 | Boyd |
| 8,574,094 | B2 | 11/2013 | Nicolette |
| 8,657,700 | B2 | 2/2014 | Nicolette |
| 8,663,026 | B2 | 3/2014 | Blowers |
| 8,690,710 | B2 | 4/2014 | Nicolette |
| 8,753,230 | B2 | 6/2014 | Stokke |
| 8,790,196 | B2 | 7/2014 | Solheim |
| 8,827,832 | B2 | 9/2014 | Breier |
| 8,827,833 | B2 | 9/2014 | Amano |
| 8,845,455 | B2 | 9/2014 | Ban |
| 8,858,362 | B1 | 10/2014 | Leposky |
| D722,351 | S | 2/2015 | Parsons et al. |
| D722,352 | S | 2/2015 | Nicolette et al. |
| D723,120 | S | 2/2015 | Nicolette |
| 8,961,336 | B1 | 2/2015 | Parsons |
| D724,164 | S | 3/2015 | Schweigert et al. |
| D725,208 | S | 3/2015 | Schweigert |
| D726,265 | S | 4/2015 | Nicolette |
| D726,846 | S | 4/2015 | Schweigert |
| 9,005,056 | B2 | 4/2015 | Pegnatori |
| D729,892 | S | 5/2015 | Schweigert |
| D733,234 | S | 6/2015 | Nicolette |
| 9,044,653 | B2 | 6/2015 | Wahl |
| D738,449 | S | 9/2015 | Schweigert |
| D739,487 | S | 9/2015 | Schweigert |
| 9,192,830 | B2 | 11/2015 | Parsons |
| 9,192,832 | B2 | 11/2015 | Parsons |
| 9,199,143 | B1 | 12/2015 | Parsons |
| D746,927 | S | 1/2016 | Parsons |
| D748,214 | S | 1/2016 | Nicolette et al. |
| D748,215 | S | 1/2016 | Parsons et al. |
| D748,749 | S | 2/2016 | Nicolette et al. |
| D753,251 | S | 4/2016 | Schweigert |
| D753,252 | S | 4/2016 | Schweigert |
| D755,319 | S | 5/2016 | Schweigert |
| D756,471 | S | 5/2016 | Schweigert |
| 9,345,938 | B2 | 5/2016 | Parsons |
| 9,346,203 | B2 | 5/2016 | Parsons |
| 9,352,197 | B2 | 5/2016 | Parsons |
| D759,178 | S | 6/2016 | Nicolette |
| D760,334 | S | 6/2016 | Schweigert |
| 9,364,727 | B2 | 6/2016 | Parsons |
| 9,399,158 | B2 | 7/2016 | Parsons |
| 9,421,437 | B2 | 8/2016 | Parsons |
| 9,427,634 | B2 | 8/2016 | Parsons |
| 9,440,124 | B2 | 9/2016 | Parsons |
| 9,468,821 | B2 | 10/2016 | Parsons |
| 9,517,393 | B2 | 12/2016 | Cardani |
| 9,533,201 | B2 | 1/2017 | Parsons |
| 9,550,096 | B2 | 1/2017 | Parsons |
| 9,610,481 | B2 | 4/2017 | Parsons |
| 9,630,070 | B2 | 4/2017 | Parsons |
| 9,636,554 | B2 | 5/2017 | Parsons |
| 9,649,540 | B2 | 5/2017 | Parsons |
| 9,649,542 | B2 | 5/2017 | Nicolette |
| 9,662,547 | B2 | 5/2017 | Parsons |
| 9,675,853 | B2 | 6/2017 | Parsons |
| 9,750,993 | B2 | 9/2017 | Ritchie |
| 9,764,194 | B2 | 9/2017 | Parsons |
| 9,782,643 | B2 | 10/2017 | Parsons |
| 9,795,842 | B1 | 10/2017 | Parsons |
| 9,795,843 | B2 | 10/2017 | Parsons |
| 9,814,952 | B2 | 11/2017 | Parsons |
| 2001/0055996 | A1 | 12/2001 | Iwata |
| 2002/0004427 | A1 | 1/2002 | Cheng |
| 2002/0037775 | A1 | 3/2002 | Keelan |
| 2002/0094884 | A1 | 7/2002 | Hocknell |
| 2002/0107087 | A1 | 8/2002 | Fagot |
| 2003/0139226 | A1 | 7/2003 | Cheng |
| 2003/0176231 | A1 | 9/2003 | Hasebe |
| 2003/0194548 | A1 | 10/2003 | McLeod |
| 2004/0082401 | A1 | 4/2004 | Takeda |
| 2004/0092331 | A1 | 5/2004 | Best |
| 2004/0204263 | A1 | 10/2004 | Fagot |
| 2004/0266550 | A1 | 12/2004 | Gilbert |
| 2005/0009632 | A1 | 1/2005 | Schweigert |
| 2005/0014573 | A1 | 1/2005 | Lee |
| 2005/0043117 | A1 | 2/2005 | Gilbert |
| 2005/0119066 | A1 | 6/2005 | Stites |
| 2005/0239569 | A1 | 10/2005 | Best |
| 2005/0255936 | A1 | 11/2005 | Huang |
| 2005/0277485 | A1 | 12/2005 | Hou |
| 2006/0111200 | A1 | 5/2006 | Poynor |
| 2006/0229141 | A1 | 10/2006 | Galloway |
| 2006/0240909 | A1 | 10/2006 | Breier |
| 2007/0032308 | A1 | 2/2007 | Fagot |
| 2007/0129166 | A1 | 6/2007 | Shimazaki |
| 2007/0225084 | A1 | 9/2007 | Schweigert |
| 2008/0058113 | A1 | 3/2008 | Nicolette |
| 2008/0188322 | A1 | 8/2008 | Anderson |
| 2008/0300065 | A1 | 12/2008 | Schweigert |
| 2008/0318705 | A1 | 12/2008 | Clausen |
| 2008/0318706 | A1 | 12/2008 | Larson |
| 2009/0011858 | A1 | 1/2009 | Binette |
| 2009/0029790 | A1 | 1/2009 | Nicolette |
| 2010/0130306 | A1 | 5/2010 | Schweigert |
| 2010/0178999 | A1 | 7/2010 | Nicolette |
| 2011/0111883 | A1 | 5/2011 | Cackett |
| 2011/0165963 | A1 | 7/2011 | Cackett |
| 2011/0269567 | A1 | 11/2011 | Ban |
| 2011/0294596 | A1 | 12/2011 | Ban |
| 2012/0196702 | A1 | 8/2012 | Shimazaki |
| 2013/0137532 | A1 | 5/2013 | Deshmukh |
| 2013/0225319 | A1 | 8/2013 | Kato |
| 2013/0281226 | A1 | 10/2013 | Ban |
| 2013/0288823 | A1 | 10/2013 | Hebreo |
| 2013/0303303 | A1 | 11/2013 | Ban |
| 2013/0310192 | A1 | 11/2013 | Wahl |
| 2013/0316842 | A1 | 11/2013 | Demkowski |
| 2014/0045605 | A1 | 2/2014 | Fujiwara |
| 2014/0080621 | A1 | 3/2014 | Nicolette |
| 2014/0128175 | A1 | 5/2014 | Jertson |
| 2014/0274441 | A1 | 9/2014 | Greer |
| 2014/0274442 | A1 | 9/2014 | Honea |
| 2014/0274451 | A1 | 9/2014 | Knight |
| 2014/0364248 | A1* | 12/2014 | Wahl ..... A63B 53/047 473/346 |
| 2015/0192116 | A1 | 7/2015 | Haug |
| 2015/0231454 | A1 | 8/2015 | Parsons |
| 2015/0231806 | A1 | 8/2015 | Parsons |
| 2016/0045793 | A1* | 2/2016 | Cardani ..... A63B 53/047 473/332 |
| 2016/0296804 | A1 | 10/2016 | Parsons |
| 2016/0317883 | A1 | 11/2016 | Parsons |
| 2017/0239533 | A1 | 8/2017 | Cole |
| 2017/0340928 | A1 | 11/2017 | Parsons |
| 2018/0028882 | A1 | 2/2018 | Hebreo |
| 2018/0028883 | A1 | 2/2018 | Morin |
| 2018/0050243 | A1 | 2/2018 | Parsons |
| 2018/0140910 | A1 | 5/2018 | Parsons |
| 2018/0318673 | A1 | 11/2018 | Parsons |

FOREIGN PATENT DOCUMENTS

| | | |
|---|---|---|
| JP | 02084972 | 3/1990 |
| JP | 08257181 | 10/1996 |
| JP | 10127832 | 5/1998 |
| JP | H110127832 | 5/1998 |
| JP | 10277187 | 10/1998 |
| JP | H110277187 | 10/1998 |
| JP | 2001346924 | 12/2001 |
| JP | 2002143356 | 5/2002 |
| JP | 2004313777 | 11/2004 |
| JP | 2005218510 | 8/2005 |

(56) References Cited

FOREIGN PATENT DOCUMENTS

| | | |
|---|---|---|
| JP | 2013043091 | 3/2013 |
| WO | 9215374 | 9/1992 |

OTHER PUBLICATIONS

Machine translation of JP 2004313777 (Published Nov. 11, 2002 by Mizuno)—Translation of description obtained May 30, 2019, via Espacenet. (Year: 2019).*

Taylor Made Golf Company, Inc., https://taylormadegolf.com/on/demandware.static/-/sites-tmag-library/default/v1459859109590/docs/productspecs/tm_s2013_catalog18.pdf., Published Jan. 2013.

Rocketbladez Press Release, "Golfballed", http://golfballed.com/index.php?option=com_content&view=article&id=724:taylormade- . . . Oct. 13, 2017, Published Jan. 3, 2013.

Kozuchowski, Zak, "Callaway Mack Daddy 2 PM Grind Wedges" (http://golfwrz.com/276203/callaway-mack-daddy-2-pm-grind-wedges/), www.golfwrx.com, Golfwrx Holdings, LLC, Published Jan. 21, 2015.

Wall, Jonathan, "Details: Phil's Prototype Mack Daddy PM-Grind Wedge," (http://www.pgatour.com/equipmentreport/2015/01/21/callaway-wedge.html),www.pgatour.com, PGA Tour, Inc., Published Jan. 21, 2015.

International Search Report and Written Opinion Received in Connection With Corresponding PCT Application Serial No. PCT/US16/42075 dated Sep. 22, 2016 (13 Pages).

International Search Report and Written Opinion Received in Connection With Corresponding PCT Application Serial No. PCT/US18/23617 dated May 31, 2018 (19 Pages).

International Search Report and Written Opinion Received in Connection With the Corresponding Application No. PCT/US2015/016666, dated May 14, 2015 (7 Pages).

U.S. Appl. No. 29/512,313, Nicolette, "Golf Club Head," filed Dec. 18, 2014.

International Search Report and Written Opinion Received in Connection With Corresponding PCT Application Serial No. PCT/US2019/017464 dated Apr. 29, 2019 (9 Pages).

* cited by examiner

GOLF CLUB HEADS AND METHODS TO MANUFACTURE GOLF CLUB HEADS

CROSS REFERENCE

This application claims the benefit of U.S. Provisional Application No. 62/629,459, filed Feb. 12, 2018; U.S. Provisional Application No. 62/714,948, filed Aug. 6, 2018; U.S. Provisional Application No. 62/722,491, filed Aug. 24, 2018; U.S. Provisional Application No. 62/732,062, filed Sep. 17, 2018; U.S. Provisional Application No. 62/755,160, filed Nov. 2, 2018; U.S. Provisional Application No. 62/756,446, filed Nov. 6, 2018; U.S. Provisional Application No. 62/787,554, filed Jan. 2, 2019; and U.S. Provisional Application No. 62/792,191, filed Jan. 14, 2019. The disclosures of the above-listed applications are incorporated herein by reference in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
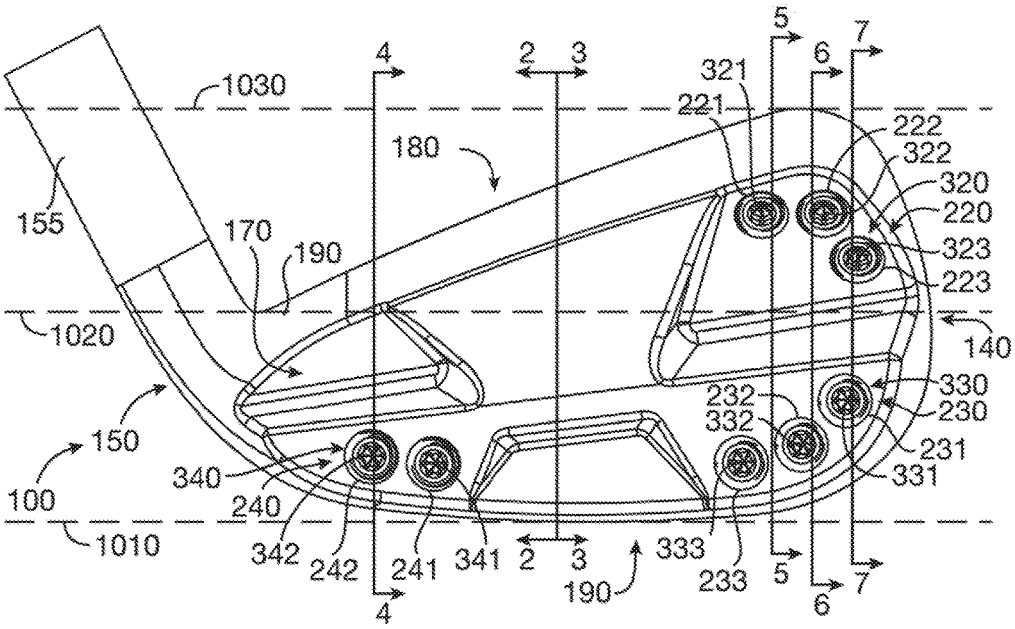
FIG. 1 depicts a perspective back view of a golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads, golf clubs, and methods to manufacture golf club heads and golf clubs are described herein. The following U.S. Patents and Patent Applications, which are collectively referred to herein as "the incorporated by reference applications," are incorporated by reference herein in their entirety: U.S. Pat. Nos. 8,961,336; 9,199,143; 9,675,853; 9,468,821; 9,533,201; 9,814,952; 9,610,481; and U.S. patent application Ser. No. 15/209,364, filed Jul. 13, 2016; U.S. patent application Ser. No. 15/462,281, filed Mar. 17, 2017; U.S. patent application Ser. No. 15/785,001, filed Oct. 16, 2017; U.S. patent application Ser. No. 16/039,496, filed Jul. 19, 2018; U.S. patent application Ser. No. 15/876,877, filed Jan. 22, 2018; and U.S. patent application Ser. No. 15/934,579, filed Mar. 23, 2018. The apparatus, methods, and articles of manufacture described herein are not limited in this regard.

In the example of FIGS. 1-11, a golf club head 100 may include a body portion 110 having a toe portion 140, a heel portion 150 that may include a hosel portion 155 configured to receive a shaft (not shown) with a grip (not shown) on one end and the golf club head 100 on the opposite end of the shaft to form a golf club, a front portion 160 with a perimeter edge portion 161, a back portion 170, a top portion 180, and a sole portion 190. The toe portion 140, the heel portion 150, the front portion 160, the back portion 170, the top portion 180, and/or the sole portion 190 may partially overlap each other. The golf club head 100 may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees)(°, 48°, 52°, 56°, 60°, etc.). Although FIGS. 1-11 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The volume of the golf club head 100 and the material of construction of the golf club head 100 and/or any components thereof may be similar to the golf club heads described in any of the incorporated by reference applications. The apparatus, methods, and articles of manufacture described herein are not limited in this regard.

The golf club head 100 may include a face portion 162 (i.e., the strike face), which may be integrally formed with the body portion 110 (e.g., a single unitary piece). In one example, as shown in FIGS. 1-11, the face portion 162 may be a separate piece attached (e.g., adhesively, mechanically, welding or soldering) or coupled to the body portion 110. The face portion 162 may include a front surface 164 and a back surface 166. In one example (not shown), the front portion 160 may include one or a plurality of recessed shoulders configured to receive the face portion 162 for attachment of the face portion 162 to the body portion 110. In another example, as shown in FIGS. 1-11, the back surface 166 may include a perimeter portion 167 that may be attached to the perimeter edge portion 161 of the body portion 110 to attach the face portion 162 to the body portion 110. The perimeter edge portion 161 of the body portion 110 and the perimeter portion 167 of the face portion 162 may be attached by one or more fasteners, one or move adhesive or bonding agents, and/or welding or soldering. In one example, as shown in FIGS. 1-11, the perimeter portion 167 of the face portion 162 may be welded to the perimeter edge portion 161 of the body portion 110 at one or more locations. Alternatively, the entire perimeter portion 167 of the face portion 162 may be welded to the entire perimeter edge portion 161 of the body portion 110 (i.e., a continuous weld). The face portion 162 may include a ball strike region 168 to strike a golf ball. In one example, the center of the ball strike region 168 may be a geometric center 163 of the face portion 162, which may provide a generally optimum location (i.e., optimum ball distance, ball speed, ball spin characteristics, etc.) on the face portion 162 for striking a golf ball. In another example, the geometric center 163 of the face portion 162 may be offset from a center of the ball strike region 168. The configuration of the face portion 162 and the attachment of the face portion 162 (e.g., welding) to the body portion 110 may be similar in many respects to the golf club heads described in any of the incorporated by reference applications. The apparatus, methods, and articles of manufacture described herein are not limited in this regard.

In one example, the area of the front surface 164 of the face portion 162 may be greater than or equal to 200 $mm^2$ and less than or equal to 5000 $mm^2$. In another example, the area of the front surface 164 of the face portion 162 may be greater than or equal to 1000 $mm^2$ and less than or equal to 4000 $mm^2$. In yet another example, the area of the front surface 164 of the face portion 162 may be greater than or equal to 1500 $mm^2$ and less than or equal to 3500 $mm^2$. While the above examples may describe particular areas, the area of the front surface 164 may greater than or less than those numbers. The apparatus, methods, and articles of manufacture described herein are not limited in this regard.

The golf club head 100 may be associated with a ground plane 1010, a horizontal midplane 1020, and a top plane 1030. In particular, the ground plane 1010 may be a plane that is parallel or substantially parallel to the ground and is tangent to the lowermost edge of the sole portion 190 when the golf club head 100 is at an address position (e.g., the golf club head 100 aligned to strike a golf ball). A top plane 1030 may be a plane that is tangent to the uppermost edge of the top portion 180 when the golf club head 100 is at the address position. The ground and top planes 1010 and 1030, respectively, may be parallel or substantially parallel to each other. The horizontal midplane 1020 may be vertically halfway between the ground and top planes 1010 and 1030, respectively. Further, the golf club head 100 may be associated with a loft plane 1040 defining a loft angle 1045 (*a*) of the golf club head 100. The loft plane 1040 may be a tangential plane to the face portion 162. The loft angle 1045 may be defined by the loft plane 1040 and a vertical plane 1050 normal to the ground plane 1010, the horizontal midplane 1020, and the top plane 1030.

The body portion 110 may be a hollow body including an interior cavity 210 having inner walls 212. The interior cavity 210 may extend between the front portion 160, the back portion 170, the top portion 180, and the sole portion 190. In the example of FIGS. 1-11, the interior cavity 210 of the body portion 110 may be enclosed with and partially defined with the face portion 162. The configuration of the interior cavity 210 (e.g., height, width, volume, shape, etc.), the configuration of the interior cavity 210 relative to the body portion 110 (e.g., volume of the interior cavity 210 relative to the volume of body portion 110), the width and height variation, and access to the interior cavity 210 from one or more ports on the body portion 110 may be similar to the golf club heads described in any of the incorporated by reference applications. The apparatus, methods, and articles of manufacture described herein are not limited in this regard.

Further, the body portion 110 may include one or more ports, which may be exterior ports and/or interior ports (e.g., located inside the body portion 110). The inner walls 212 of the interior cavity 210 may include one or more ports. In one example, as shown in FIG. 1, the back portion 170 may include one or more ports along or proximate to a periphery of the body portion 110. For example, the body portion 110 may include a first set of ports 220 (e.g., shown as ports 221, 222, and 223), a second set of ports 230 (e.g., shown as ports 231, 232, and 233), and a third set of ports 240 (e.g., shown as ports 241 and 242). The locations, spacing relative to other ports, and any other configuration of each port of the first set of ports 220, the second set of ports 230, and/or the third set of ports 240 may be similar in many respects to any of the ports described in any of the incorporated by reference applications. Further, any one or more of the ports of the first set of ports 220, the second set of ports 230, and/or the third set of ports 240 may be connected to interior cavity 210 through which one or more filler materials may be injected into the interior cavity 210. In the example of FIGS. 1-11, the port 242 may be connected to the interior cavity 210 via an opening 243. The apparatus, methods, and articles of manufacture described herein are not limited in this regard.

Each port of the first set of ports 220 may be separated by a distance less than the port diameter of any of the ports of the first set of ports 220. Each port of the second set of ports 230 may be separated by a distance less than the port diameter of any of the ports of the second set of ports 230. Each port of the third set of ports third set of ports 240 may be separated by a distance less than the port diameter of any of the ports of the third set of ports 240. The first set of ports 220 and the second set of ports 230 may be spaced apart by a distance substantially greater than the port diameter of any of the ports of the first set of ports 220 and the second set of ports 230. In one example, the second set of ports 230 and the third set of ports 240 may be spaced apart by a distance less than the port diameter of any of the ports of the second set of ports 230 and the third set of ports 240. In another example, as shown in FIG. 1, the second set of ports 230 and the third set of ports 240 may be spaced apart by a distance substantially greater than the port diameter of any of the ports of the second set of ports 230 and the third set of ports 240. In one example, the portion of the body portion 110 between the second set of ports 230 and the third set of ports 240 may generally correspond or be aligned with the ball strike region 168 and may be devoid of any ports. In another example (not shown), the second set of ports 230 and the third set of ports 240 may extend continuously and with generally equal port spacing from the toe portion 140 to the heel portion 150. The apparatus, methods, and articles of manufacture described herein are not limited in this regard.

Although the figures may depict the ports as separate and individual parts, each set of the first, second, and third sets of ports 220, 230, and 240, respectively, may be a single port. In one example, all of the first set of ports 220 (e.g., shown as 221, 222, and 223) may be combined into a single port (e.g., a first port). In another example, all of the second set of ports 230 (e.g., shown as 231, 232, and 233) may be combined into a single port (e.g., a second port). In yet another example, all of the third set of ports 240 (e.g., shown as 241 and 242) may be combined into a single port (e.g., a third port). While the figures may depict a particular number of ports, the apparatus, methods, and articles of manufacture described herein may include more or a smaller number of ports.

The body portion 110 may include one or more mass portions (e.g., weight portion(s)), which may be integral mass portion(s) or separate mass portion(s) that may be coupled to the body portion 110. In the illustrated example as shown in FIG. 1, the body portion 110 may include a first set of mass portions 320 (e.g., shown as mass portions 321, 322, and 323), a second set of mass portions 330 (e.g., shown as mass portions 331, 332, and 333), and a third set of mass portions 340 (e.g., shown as mass portions 341 and 342). While the above example may describe a particular number or portions of mass portions, a set of mass portions may include a single mass portion or a plurality of mass portions as described in any of the incorporated by reference applications. For example, the first set of mass portions 320 may be a single mass portion (e.g., mass portions 331, 332, and 333 may be a single mass portion referred to as a first mass portion). In a similar manner, the second set of mass portions 330 and/or the third set of mass portions 340 may be a single mass portion. Further, the first set of mass portions 320, the second set of mass portions 330, and/or the third set of mass portions 340 may be a portion of the physical structure of the body portion 110. The mass portions of the first set of mass portions 320, the second set of mass portions 330, and/or third set of mass portions 340 may be similar to any of the mass portions described in any of the incorporated by reference applications. The apparatus, methods, and articles of manufacture described herein are not limited in this regard.

The body portion 110 may be made of a first material whereas the mass portions of the first set of mass portions 320, the second set of mass portions 330, and/or the third set of mass portions 340 may be made of a second material. The mass portions of the first set of mass portions 320, the second set of mass portions 330, and/or the mass portions of the third set mass portions 340 may be similar or different materials. The materials of the body portion 110 and any of the mass portions of the first set of mass portions 320, the second set of mass portions 330, and/or the third set mass portions 340 may be similar to the materials of the body portion and any of the mass portions, respectively, described in any of the incorporated by reference applications. The apparatus, methods, and articles of manufacture described herein are not limited in this regard.

The interior cavity 210 may be partially or entirely filled with one or more filler materials (i.e., a cavity filling material), which may include one or more similar or different types of materials. In one example, as shown in FIGS. 1-11, the interior cavity 210 may be filled with a first filler material 412 and a second filler material 414. The first filler material 412 may be coupled or attached to the back surface 166 of the face portion 162. In one example, the first filler material 412 may have inherent adhesive or bonding properties to attach to the back surface 166 of the face portion 162. In another example, the first filler material 412 may be attached to the back surface 166 of the face portion 162 with one or more bonding agents or adhesives that may be mixed with the first filler material 412. In another example, the first filler material 412 may be attached to the back surface 166 of the face portion 162 with one or more bonding agents or adhesives that may be separate from the first filler material 412. In another example, the first filler material 412 may be maintained in contact with the back surface 166 of the face portion 162 with the second filler material 414 as described herein. In yet another example, the first filler material 412 may be both bonded to the back surface 166 of the face portion 162 as described herein and maintained in contact with the back surface 166 of the face portion 162 with the second filler material 414. The first filler material 412 and/or the second filler material 414 may be similar to the filler materials described in any of the incorporated by reference applications. The apparatus, methods, and articles of manufacture described herein are not limited in this regard.

The first filler material 412 may be coupled to at least a portion of the back surface 166 of the face portion 162 that corresponds to the ball strike region 168 of the face portion 162. The first filler material 412 may be coupled to regions of the back surface 166 of the face portion 162 that are beyond the ball strike region 168. In one example, the first filler material 412 may be coupled to at least 10% of the back surface 166 of the face portion 162. In another example, the first filler material 412 may be coupled to at least 25% of the back surface 166 of the face portion 162. In yet another example, the first filler material 412 may be coupled to between 25% and 50% of the back surface 166 of the face portion 162. In another example, the first filler material 412 may be coupled to between 35% and 75% of the back surface 166 of the face portion 162. In yet another example, the first filler material 412 may be coupled to between 50% and 90% of the back surface 166 of the face portion 162. In yet another example, the first filler material 412 may be coupled to more than 75% of the back surface 166 of the face portion 162. In yet another example, the first filler material 412 may be coupled to the entire back surface 166 of the face portion 162 that is exposed to the interior cavity 210 (e.g., 100%). The amount of the first filler material 412 that may be coupled to the back surface 166 of the face portion 162 may depend upon the loft angle of the golf club head, the overall thickness of the face portion 162, the thickness profile of the face portion 162, the shape of the interior cavity 210, the locations and configurations of any ports of mass portions, the material properties of the first filler material 412, and/or the material properties of the second filler material 414. In one example, a relatively large portion of the back surface 166 of the face portion 162 may be coupled to the first filler material 412 for a relatively thin face portion 162 so that the first filler material 412 provides sufficient structural support for the face portion 162. In another example, a golf club head with a relatively higher loft angle may limit the portions of the back surface 166 of the face portion 162 to which the first filler material 412 may be coupled. In yet another example, the acoustic properties of the golf club head may be a factor in determining the amount of filler material 412 that may be coupled to the back surface 166 of the face portion to provide a pleasing sound and feel to an individual. The amount of the first filler material 412 coupled to the back surface 166 of the face portion 162 may (i) provide vibration dampening or sound dampening (e.g., consistent and/or pleasing sound and feel when the golf club head 100 strikes a golf ball as perceived by an individual using the golf club head 100), (ii) provide structural support for the face portion 162, and/or (iii) optimize ball travel distance, ball speed, ball launch angle, ball spin rate, ball peak height, ball landing angle and/or ball dispersion. The apparatus, methods, and articles of manufacture described herein are not limited in this regard.

A width 422 ($W_{F1}$) of the first filler material 412 may vary from the toe portion 140 to the heel portion 150 and/or from the top portion 180 to the sole portion 190. The width 422 of the first filler material 412 may be constant or substantially constant from the toe portion 140 to the heel portion 150 and/or from the top portion 180 to the sole portion 190. The width 422 of the first filler material 412 may be constant or substantially constant at one or more locations in the interior cavity 210 and vary at certain other locations in the interior cavity 210. In one example, as shown in FIGS. 1-11, the width 422 of the first filler material 412 may vary at one or more locations in the interior cavity 210 similar or substantially similar to the contour of all or portions of the inner walls 212 of the interior cavity 210 (i.e., similar or substantially similar to the shape of the inner walls 212 of the interior cavity 210). Accordingly, the amount of the first filler material 412 in the interior cavity 210 and/or coupled to the face portion 162 may be maximized while maintaining a certain gap as further described herein between the first filler material 412 and the inner walls 212 of the interior cavity 210. In another example, the first filler material 412 at and/or around the ball strike region 168 of the face portion 162 may have a relatively large width 422 to (i) provide vibration dampening or sound dampening (e.g., consistent and/or pleasing sound and feel when the golf club head 100 strikes a golf ball as perceived by an individual using the golf club head 100), (ii) provide structural support for the face portion 162, and/or (iii) optimize ball travel distance, ball speed, ball launch angle, ball spin rate, ball peak height, ball landing angle and/or ball dispersion. The width 422 of the first filler material 412 may be determined at the ball strike region 168 and/or other regions of the interior cavity 210 so that a relatively high or optimum coefficient of restitution (COR) is provided for the golf club head 100. The apparatus, methods, and articles of manufacture described herein are not limited in this regard.

In one example, as shown in FIGS. 1-11, a distance between the first filler material 412 and the inner walls 212 of the interior cavity 210 may define a gap 424. The size of the gap 424 may be constant or may vary in the interior cavity 210 similar or substantially similar to the shape of the first filler material 412, the shape of the inner walls 212 of the interior cavity 210, the locations of one or more ports that may be connected to the interior cavity 210, the locations of one or more integral and/or removable mass portions, and/or other factors as described herein. At certain locations in the interior cavity 210, the size of the gap 424 may be as small as possible yet provide sufficient space to accommodate the second filler material 414 between the first filler material 412 and the inner walls 212 of the interior cavity 210. In one example, the gap may be a result of manufacturing the golf club head with the first filler material 412 and the second filler material 414.

In one example, the gap 424 may be greater than or equal to 0.001 inch (0.003 cm) and less than or equal to 0.2 inch (0.508 cm). In another example, the gap 424 may be greater than or equal to 0.007 inch (0.18 cm) and less than or equal to 0.1 inch (0.254 cm). In another example, the gap 424 may be greater than or equal to 0.015 inch (0.038 cm) and less than or equal to 0.05 inch (0.127 cm). In yet another example, the gap 424 may be greater than or equal to 0.003 inch (0.008 cm) and less than or equal to 0.25 inch (0.635 cm). The apparatus, methods, and articles of manufacture described herein are not limited in this regard.

As described herein, the width 422 of the first filler material 412 may vary similar or substantially similar to the shape of the inner walls 212 of the interior cavity 210. Accordingly, in one example, the variation in the width of the gap 424 (Wg) may be expressed by the following equation:

$$1 \leq \frac{Wg_{max}}{Wg_{min}} \leq Rg \tag{1}$$

where: $Wg_{max}$ is the maximum Wg,
$Wg_{min}$ is the minimum Wg, and
$1<Rg\leq 5$ In one example, $R_g$ may be 2 or less as the width 422 of the first filler material 412 varies similar or substantially similar to the shape of the inner walls 212 of the interior cavity 210. In another example, $R_g$ may be 3 or less. Accordingly, the maximum width of the gap 424 ($Wg_{max}$) may be no more than three times the minimum width of the gap 424 ($Wg_{min}$). In yet another example, $R_g$ may be 4 or less. Accordingly, the maximum width of the gap 424 ($Wg_{max}$) may be no more than four times the minimum width of the gap 424 ($Wg_{min}$). The variation in the gap 424 may be small such that the shape of the first filler material 412 may vary similar or substantially similar to the contour of the inner walls 212 of the interior cavity 210 (i.e., the shape of the inner walls of the interior cavity 210). While the above examples may describe particular ratios of $Wg_{max}$ to $Wg_{min}$, the apparatus, methods, and articles of manufacture described herein may include greater ratios of $Wg_{max}$ to $Wg_{min}$. The apparatus, methods, and articles of manufacture described herein are not limited in this regard.

The back surface 166 of the face portion 162 may include a perimeter portion 167, which may be attached to the perimeter edge portion 161 of the body portion 110 as described herein. Accordingly, the back surface 166 of the face portion 162 may include an inner surface portion 169 exposed to the interior cavity 210. The inner surface portion 169 may also define a boundary of the interior cavity 210 (i.e., the front boundary of the interior cavity 210). In one example (not shown), the first filler material 412 may be coupled the entire inner surface portion 169 of the face portion 162. In another example, as shown in FIGS. 1-11, the first filler material 412 may be coupled to a portion of the inner surface portion 169 of the face portion 162. Accordingly, the first filler material 412 may include a frontal area 413 attached to the inner surface portion 169 of the face portion 162. In one example, a relationship between the frontal area 413 of the first filler material 412 (the area of the front surface of the first filler material 412 attached to the face portion 162) ($FA_m$) and the area of the inner surface portion 169 of the face portion 162 ($BA_f$) may be expressed by the following equation:

$$FA_m = BA_f(A_1\alpha + A_2) \tag{2}$$

where:
$FA_m$ is the frontal area 413 of the first filler material 412,
$BA_f$ is the area of the inner surface portion 169 of the face portion 162,
$\alpha$ is the loft angle of the face portion 162,
$-0.003 \leq A_1 \leq 0.001$, and
$0.4 \leq A_2 \leq 0.85$ The loft angle $\alpha$ as used herein may be associated with the type of iron golf club head such as a 5-iron golf club, a 7-iron golf club, or a wedge-type golf club. For example, a 5-iron golf club head may have a loft angle $\alpha$ of 25°±2°. In another example, a 7-iron golf club head may have a loft angle $\alpha$ of 31°±2°. In yet another example, a wedge-type golf club head may have a loft angle $\alpha$ of 5°±2°. Accordingly, any loft angle expressed herein may vary by ±2° for the same type of iron golf club head. While the above examples may describe particular iron-type golf club heads, the apparatus, methods, and articles of manufacture described herein may include a driver-type golf club head, a fairway-wood-type golf club head, a hybrid-type golf club head, a putter-type golf club head, or other types of golf club heads. Further, although the above examples may describe particular loft angles, the apparatus, methods, and articles of manufacture described herein may include greater or less loft angles. The apparatus, methods, and articles of manufacture described herein are not limited in this regard.

The upper and lower values of the coefficients $A_1$ and $A_2$ may define the upper and lower boundaries of the ratio of the frontal area 413 of the first filler material 412 to the area of the inner surface portion 169 of the face portion 162. In one example, according to Equation (2) and assuming a value of −0.0018 for the coefficient $A_1$, upper and lower boundaries of a ratio of the frontal area 413 of the first filler material 412 to the area of the inner surface portion 169 of the face portion 162 for a set of iron-type golf club heads may be determined as shown in Table 1.

TABLE 1

| Iron-Type | α | $(FA_m/BA_f)\leq$ | $(FA_m/BA_f)\geq$ |
|---|---|---|---|
| 3 | 18 | 0.77 | 0.45 |
| 4 | 21 | 0.77 | 0.44 |
| 5 | 23 | 0.76 | 0.44 |
| 6 | 26 | 0.76 | 0.43 |
| 7 | 30 | 0.75 | 0.43 |
| 8 | 34 | 0.74 | 0.42 |
| 9 | 39 | 0.73 | 0.41 |
| Wedge | 44 | 0.72 | 0.40 |
| Gap Wedge | 49 | 0.71 | 0.39 |
| Sand Wedge | 54 | 0.71 | 0.38 |
| Lob Wedge | 59 | 0.70 | 0.38 |

The loft angle of a golf club head may determine the structural configuration of the golf club head. Accordingly, golf club heads with different loft angles may have different internal cavity shapes, port locations, mass portion locations, filler material volumes, different CG locations, different size face portions, or different golf club head cross sectional shapes. In one example, a golf club head with a relatively higher loft angle may have a generally smaller cavity width profile than a golf club head with a lower loft angle. Accordingly, the value of $FA_m/BA_f$ for the golf club with the relatively higher loft angle may be generally smaller than the golf club head with the lower loft angle due to the difference in the amount of filler materials that may be provided in the interior cavities of each golf club head as described herein. The apparatus, methods, and articles of manufacture described herein are not limited in this regard.

In another example, a relationship between the volume of the first filler material 412 and the volume of the interior cavity 210 ($V_m$) may be expressed by the following equation:

$$V_m=V_c(B_1\alpha+B_2) \tag{3}$$

where:

$V_m$ is the volume of the first filler material 412, $V_c$ is the volume of the interior cavity 210, α is the loft angle, $-0.001\leq B_1\leq 0.001$, and $0.3\leq B_2\leq 0.65$ The upper and lower boundary values of the coefficients $B_1$ and $B_2$ may define the upper and lower boundaries of a ratio of the volume of the first filler material 412 to the volume of the interior cavity 210. In one example, according to Equation (3) and assuming a value of −0.0015 for the coefficient $B_1$, upper and lower boundaries of a ratio of the volume of the first filler material 412 to the volume of the interior cavity 210 for a set of iron-type golf club heads may be determined as shown in Table 2.

TABLE 2

| Iron-Type | α | $(V_m/V_c)\leq$ | $(V_m/V_c)\geq$ |
|---|---|---|---|
| 3 | 18 | 0.61 | 0.35 |
| 4 | 21 | 0.61 | 0.35 |
| 5 | 23 | 0.60 | 0.35 |
| 6 | 26 | 0.60 | 0.34 |
| 7 | 30 | 0.59 | 0.34 |
| 8 | 34 | 0.58 | 0.33 |
| 9 | 39 | 0.58 | 0.32 |
| Wedge | 44 | 0.57 | 0.32 |
| Gap Wedge | 49 | 0.56 | 0.31 |

TABLE 2-continued

| Iron-Type | α | $(V_m/V_c)\leq$ | $(V_m/V_c)\geq$ |
|---|---|---|---|
| Sand Wedge | 54 | 0.55 | 0.30 |
| Lob Wedge | 59 | 0.55 | 0.29 |

As discussed herein, golf club heads with different loft angles may have different internal cavity shapes, port locations, mass portion locations, filler material volumes, different CG locations, different size face portions, or different golf club head cross sectional shapes. In one example, a golf club head with a relatively higher loft angle may have a generally smaller cavity width profile than a golf club head with a lower loft angle. Accordingly, the value of $V_m/V_c$ for the golf club with the relatively higher loft angle may be generally smaller than the golf club head with the lower loft angle due to the difference in the amount of filler materials that may be provided in the interior cavities of each golf club head as described herein. The apparatus, methods, and articles of manufacture described herein are not limited in this regard.

Figure 2:
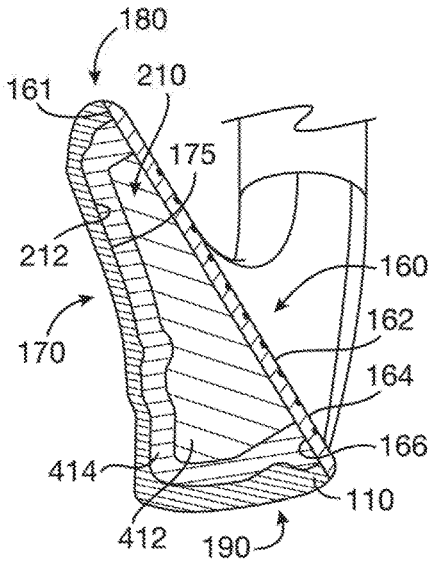
FIG. 2 depicts a perspective cross-sectional view of the golf club head of FIG. 1 taken at line 2-2 of FIG. 1.
Figure 3:
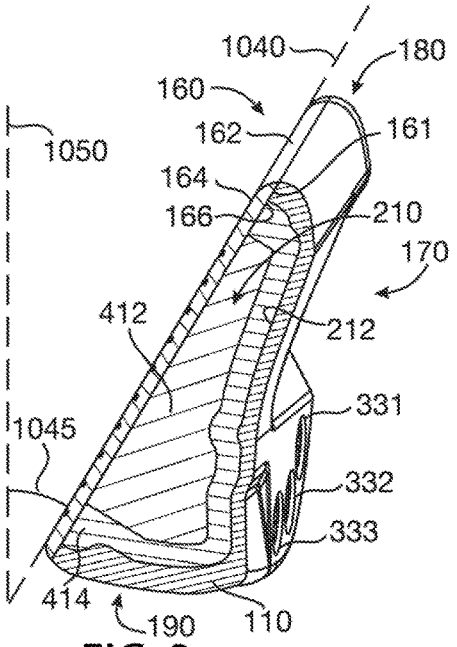
FIG. 3 depicts a perspective cross-sectional view of the golf club head of FIG. 1 taken at line 3-3 of FIG. 1.
Figure 4:
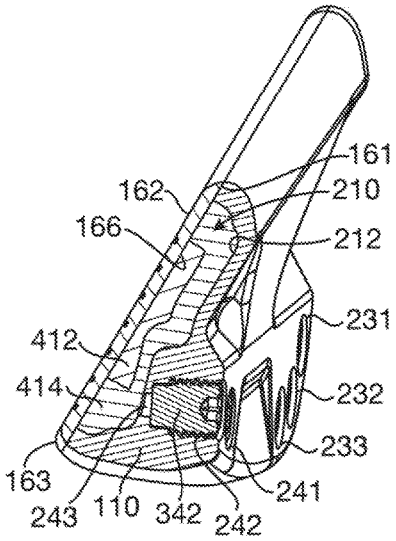
FIG. 4 depicts a perspective cross-sectional view of the golf club head of FIG. 1 taken at line 4-4 of FIG. 1.
Figure 5:
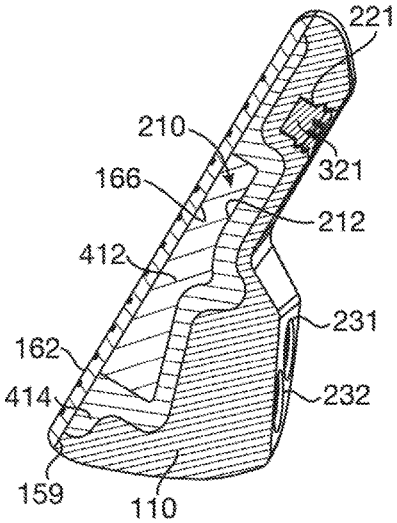
FIG. 5 depicts a perspective cross-sectional view of the golf club head of FIG. 1 taken at line 5-5 of FIG. 1.
Figure 6:
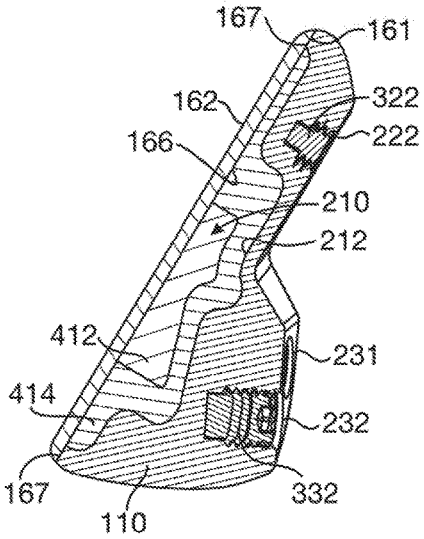
FIG. 6 depicts a perspective cross-sectional view of the golf club head of FIG. 1 taken at line 6-6 of FIG. 1.
Figure 7:
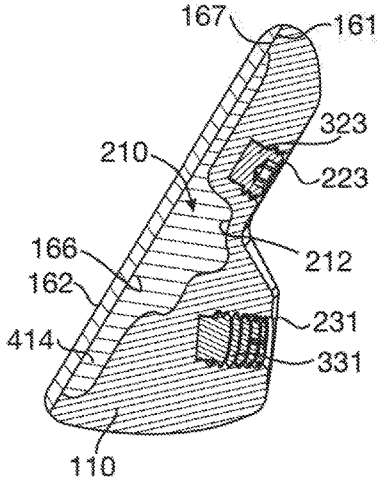
FIG. 7 depicts a perspective cross-sectional view of the golf club head of FIG. 1 taken at line 7-7 of FIG. 1.
Figure 9:
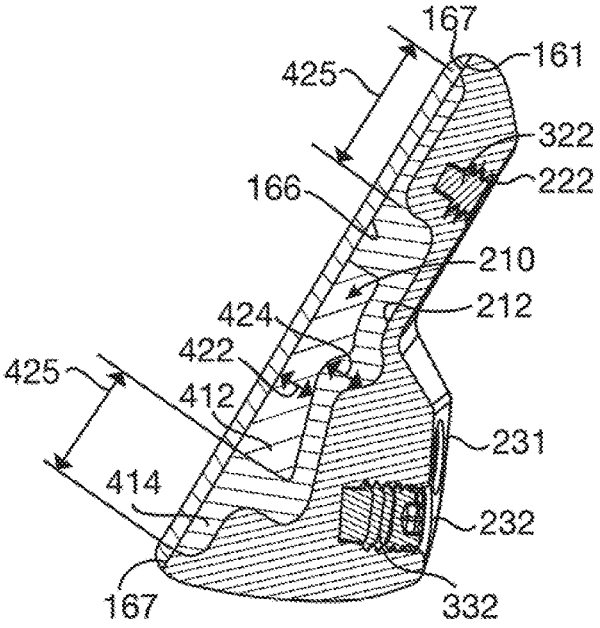
FIG. 9 depicts another perspective cross-sectional view of the golf club head of FIG. 1 taken at line 6-6 of FIG. 1.
Figure 10:
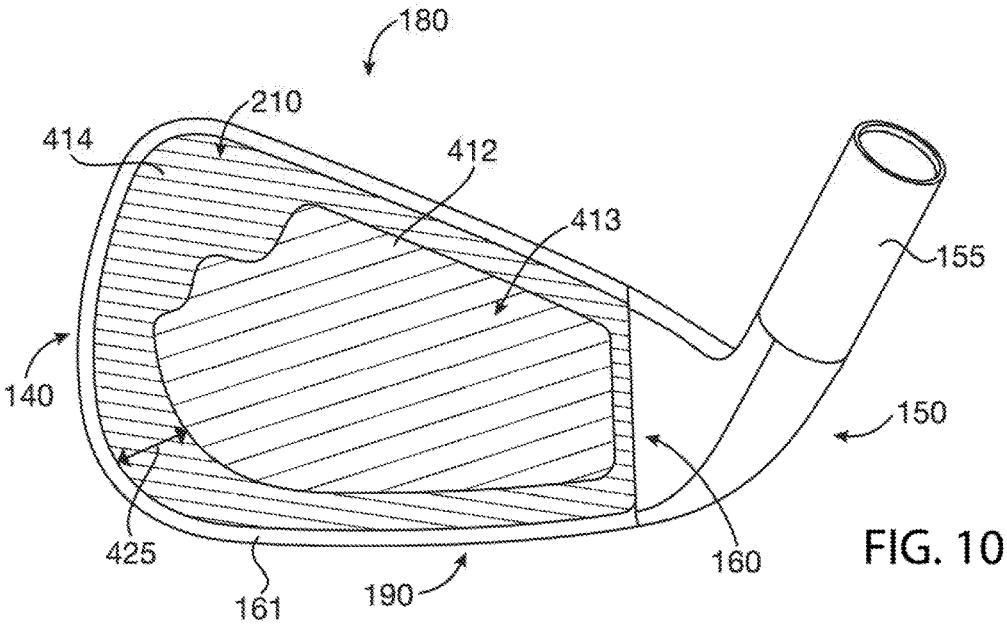
FIG. 10 depicts a front perspective view of the golf club head of FIG. 1 shown without a face portion.
Figure 11:
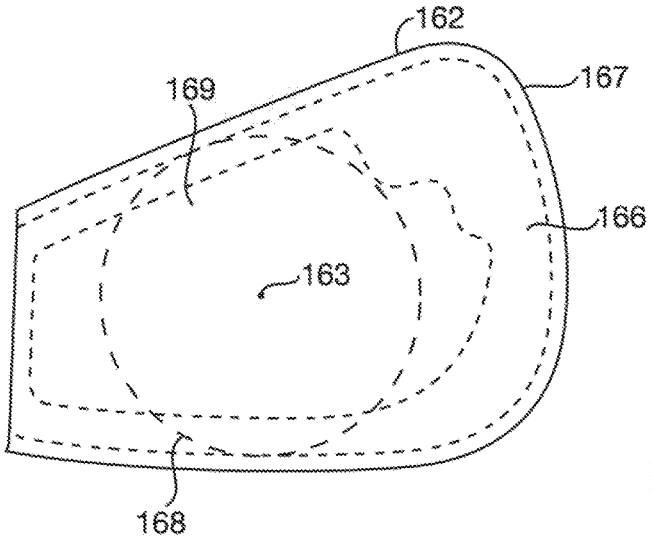
FIG. 11 depicts a back side of a face portion for the golf club head of FIG. 1.

The values of the coefficients $A_1$, $A_2$, $B_1$, and $B_2$ within the boundaries of these coefficients as defined herein may maintain a certain gap or a certain perimeter gap between the first filler material 412 and the inner walls of the interior cavity 210 as described herein, and/or optimize or maximize the width 422 of the first filler material 412 at or proximate to the ball strike region 168. Additionally, the values of the coefficients $A_1$, $A_2$, $B_1$, and $B_2$ may vary within the boundaries of these coefficients as defined herein based on the specific internal configuration or structure of a golf club head. For example, as shown in FIG. 9, the widths of certain areas of the interior cavity 210 may not be sufficiently large to include both the first filler material 412 and the second filler material 414. As shown in FIG. 6, an area of the interior cavity 210 between the port 222 and the face portion 162 may only include the second filler material 414. Accordingly, the absence of first filler material 412 in the area of the interior cavity 210 between the port 222 and the face portion 162 as shown in FIG. 6 may affect both the upper boundary and the lower boundary of the ratio of the frontal area of the first filler material 412 to the area of the inner surface portion 169 of the face portion 162 and/or the ratio of the volume of the first filler material 412 to the volume of the interior cavity 210. In another example, as shown in FIGS. 2 and 3, the ratio of the frontal area 413 of the first filler material 412 to the area of the inner surface portion 169 of the face portion 162 and/or the ratio of the volume of the first filler material 412 to the volume of the interior cavity 210 may be determined so that the width of the first filler material 412 at the ball strike region 168 is maximized while still maintaining a gap 424 of sufficient width to accommodate the second filler material 414. The apparatus, methods, and articles of manufacture described herein are not limited in this regard.

Figure 8:
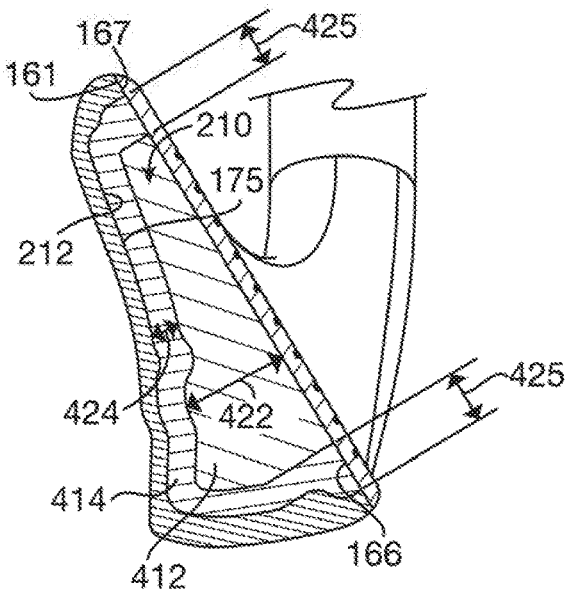
FIG. 8 depicts another perspective cross-sectional view of the golf club head of FIG. 1 taken at line 2-2 of FIG. 1.

As described herein, in one example, the first filler material 412 may not be attached to the entire inner surface portion 169 of the face portion 162. Accordingly, the first filler material 412 and the perimeter edge portion 161 (or the perimeter portion 167 of the face portion) may be spaced apart by a perimeter gap 425. The perimeter gap 425 may be greater than the gap 424 due to one or more golf club head design and manufacturing considerations. For example, the perimeter gap 425 may have to be sufficiently large so that the heat from any welding or soldering process as described herein to attach the perimeter portion 167 of the face portion 162 to the perimeter edge portion 161 of the body portion 110 does not damage, shift, move, detach from the face portion 162, and/or alter the material properties (e.g., melt) of the first filler material 412 at or proximate to perimeter portion 167 of the face portion 162. Accordingly, for example, as shown in FIGS. 8 and 9, the perimeter gap 425 may be larger than the gap 424. In another example, as shown in FIG. 9, portions of the interior cavity 210 at or proximate to the perimeter edge portion 161 may not be sufficiently wide to include both the first filler material 412 and the second filler material 414. Accordingly, the perimeter gap 425 may be substantially greater than the gap 424. Thus, the gap 424 may be configured such that the first filler material 412 follows the contour of the inner walls 212 of the interior cavity 210, whereas the perimeter gap 425 may be similar, greater, or substantially greater than the gap 425 depending on the location or region of the interior cavity 210. In one example, the relationship between the perimeter gap 425 and the gap 424 may be expressed by the following equation:

$$\frac{Wg_{PR}}{Wg_{min}} \geq 1.25 \tag{4}$$

where: $Wg_{PR}$ is the width of the perimeter gap 425, and $Wg_{min}$ is the minimum width of the gap 424.

The first filler material 412 may include a polymer material having a relatively high coefficient of restitution (COR). The COR of the first filler material 412 may be determined by shooting a golf ball sized sample of the first filler material 412 from an air cannon toward a steel plate. Two light screens at known positions between the cannon and the plate may be used to measure the approach velocity and rebound velocities of the sample. The COR of the sample may then be calculated as the rebound velocity divided by the approach velocity. In one example, he first filler material 412 may have a COR of greater than or equal to 0.7 at an approach velocity of 125 ft/s (38.1 m/s). In another example, the first filler material 412 may have a COR of greater than or equal to 0.75 at an approach velocity of 125 ft/s (38.1 m/s). In yet another example, the first filler material 412 may have a COR of greater than or equal to 0.7 and less than or equal to 0.9 at an approach velocity of 125 ft/s (38.1 m/s). The apparatus, methods, and articles of manufacture described herein are not limited in this regard.

The compression of the golf ball sized sample may be related to the COR of the golf ball sized sample. Compression is a measurement of how much the golf ball sized sample deforms (compresses) under load. A relatively lower compression rating indicates a softer filler material, whereas a relatively higher compression rating indicates a firmer filler material. Compression may be measured by using an ATTI compression gauge, manufactured by ATTI Engineering, Union City, N.J. In one example, the COR of the first filler material 412 may be greater than or equal to 0.75 at a compression of greater than or equal to 22. In another example, the COR of the first filler material 412 may be greater than or equal to 0.78 at a compression of greater than or equal to 2 and less than or equal to 0.8 at a compression of less than or equal to 80. In yet another example, the COR of the first filler material 412 may be greater than or equal to 0.78 at a compression of greater than or equal to 32 and less than or equal to 0.9 at a compression of less than or equal to 90. The apparatus, methods, and articles of manufacture described herein are not limited in this regard.

In one example, the first filler material 412 may be a polymer material having a density of greater than or equal to 1.1 g/cm$^3$ and less than or equal to 1.3 g/cm$^3$. In another example, the first filler material 412 may be a polymer material having a density of greater than or equal to 1.15 g/cm$^3$ and less than or equal to 1.25 g/cm$^3$. In yet another example, the first filler material 412 may be a polymer material having a density of greater than or equal to 1.1 g/cm$^3$ and less than or equal to 1.2 g/cm$^3$. The apparatus, methods, and articles of manufacture described herein are not limited in this regard.

In one example, the first filler material 412 may be a polymer material including rubber or a rubber compound that may provide the COR and compression ranges described herein. In one example, the first filler material 412 may include rubber and at least another compound that may provide increased softness or firmness to the first filler material 412 to maximize the COR of the first filler material 412 while maintaining compression values within a certain range as described herein. In one example, the first filler material 412 may include rubber and Zinc Diacrylate (ZDA), which may increase the compression value of the first filler material 412 and hence the COR of the first filler material 412. The amount of Zinc Diacrylate (ZDA) in the first filler material 412 may be varied to achieve certain COR and/or compression values as described herein. The apparatus, methods, and articles of manufacture described herein are not limited in this regard.

The adhesive for bonding the first filler material 412 to the back surface 166 of the face portion 162 may be any type of adhesive that can bond the first filler material 412 to the material of the face portion 162. In one example, the first filler material 412 may be a rubber or a rubber compound and the face portion 162 may be constructed from a steel-based material such as stainless steel. Accordingly, the adhesive for bonding the first filler material 412 to the back surface 166 of the face portion 162 may be a type of adhesive used to bond steel-based materials to rubber or rubber compounds. In another example, the first filler material 412 may be a rubber or a rubber compound and the face portion 162 may be constructed from titanium or a titanium alloy. Accordingly, the adhesive for bonding the first filler material 412 to the back surface 166 of the face portion 162 may be a type of adhesive used to bond titanium-based materials to rubber or rubber compounds. The bonding of the first filler material 412 to any portion of the body portion 110, the face portion 162, and/or the second filler material 414, and the bonding of the second filler material 414 to the body portion 110, the face portion 162, and/or the first filler material 412 may be similar to any of the bonding properties and procedures described in any of the incorporated by reference applications. The apparatus, methods, and articles of manufacture described herein are not limited in this regard.

In one example (not shown), the interior cavity 210 may be entirely filled with the first filler material 412. In another example, as shown in FIGS. 1-11 and described herein, the interior cavity 210 may be partially filled with the first filler material 412 to define the gap 424 between the first filler material 412 and the inner walls 212 of the interior cavity 210. Accordingly, the remaining portions of the first interior cavity 210 may be filled with a second filler material 414. As described herein, the second filler material 414 may provide or assist (e.g., alone or in conjunction with one or more adhesives) in the coupling of the first filler material 412 with the face portion 162. In other words, the first filler material 412 may be maintained against the back surface 166 of the face portion 162 by the second filler material 414. The apparatus, methods, and articles of manufacture described herein are not limited in this regard.

The second filler material 414 may have one or more different properties than the first filler material 412 such as density, compression, hardness (i.e., durometer), tensile strength, shear strength, viscosity, elasticity, etc., to optimize energy transfer from the face portion 162 to a golf ball. The second filler material may be a polymer material. In one example, the second filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, the second filler material 414 may be one or more thermoset polymers having bonding properties (e.g., one or more adhesive or epoxy materials). The second filler material 414 may also absorb shock, isolate vibration, and/or dampen noise when the golf club head 100 strikes a golf ball. Further, the second filler material 414 may be an epoxy material that may be flexible or slightly flexible when cured. In another example, the second filler material 414 may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, the filler material may include 3M™ Scotch-Weld™ DP100 Plus Clear adhesive. In another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, the filler material may be LOCTITE® materials manufactured by Henkel Corporation, Rocky Hill, Conn. The apparatus, methods, and articles of manufacture described herein are not limited in this regard.

As described herein, the first filler material 412 and/or the second filler material 414 may provide vibration dampening or sound dampening (e.g., consistent and/or pleasing sound and feel when the golf club head 100 strikes a golf ball as perceived by an individual using the golf club head 100, provide structural support for the face portion 162, and/or improve ball travel distance, ball speed, ball launch angle, ball spin rate, ball peak height, ball landing angle and/or ball dispersion. The first filler material 412, the second filler material 414, or both may provide the properties and characteristics described herein whereas the mass of the first filler material 412, the mass of the second filler material 414, or the masses of both relative to the mass of the body portion 110 may optimally affect the mass, mass distribution, CG, MOI characteristics, structural integrity and/or or other static and/or dynamic characteristics of the golf club head 100. In one example, a relationship between the mass of the first filler material 412 ($m_{m1}$), the mass of the second filler material 414 ($m_{m2}$), and the mass of the body portion 110 ($m_b$) may be expressed by the following equation:

$$m_{m1}=m_b(C_1\alpha+C_2)-m_{m2} \quad (5)$$

where:

$m_{m1}$ is the mass of the first filler material 412,
$m_{m2}$ is the mass of the second filler material 414,
$m_b$ is the mass of the body portion 110,
$\alpha$ is the loft angle,
$-0.001 \le C_1 \le 0.001$, and
$0.1 \le C_2 \le 0.2$.

The upper and lower values of the coefficients $C_1$ and $C_2$ as defined herein may provide the upper and lower boundaries of a ratio of the sum of the masses of the first filler material 412 and the second filler material 414 to the mass of the body portion 110 (i.e., $(m_{m1}+m_{m2})/m_b$). In one example, according to Equation (5) and assuming a value of −0.0016 for the coefficient $C_1$, upper and lower boundaries of a ratio of the sum of the masses of the first filler material 412 and the second filler material 414 to the mass of the body portion 110 for a set of iron-type golf club heads may be determined as shown in Table 3.

TABLE 3

| Iron-Type | $\alpha$ | $(m_{m1}+m_{m2})/m_b) \le$ | $(m_{m1}+m_{m2})/m_b) \ge$ |
|---|---|---|---|
| 3 | 18 | 0.16 | 0.08 |
| 4 | 21 | 0.16 | 0.08 |
| 5 | 23 | 0.15 | 0.08 |
| 6 | 26 | 0.15 | 0.07 |
| 7 | 30 | 0.14 | 0.06 |
| 8 | 34 | 0.13 | 0.06 |
| 9 | 39 | 0.13 | 0.05 |
| Wedge | 44 | 0.12 | 0.04 |
| Gap Wedge | 49 | 0.11 | 0.03 |
| Sand Wedge | 54 | 0.10 | 0.03 |
| Lob Wedge | 59 | 0.09 | 0.02 |

The values of the coefficients $C_1$ and $C_2$ within the boundaries of these coefficients as defined herein may (i) provide vibration dampening or sound dampening (e.g., consistent and/or pleasing sound and feel when the golf club head 100 strikes a golf ball as perceived by an individual using the golf club head 100), (ii) provide structural support for the face portion 162, and/or (iii) improve ball travel distance, ball speed, ball launch angle, ball spin rate, ball peak height, ball landing angle and/or ball dispersion. The first filler material 412 and the second filler material 414 may provide the properties and characteristics described herein whereas the mass of the first filler material 412 and the second filler material 414 relative to the mass of the body portion 110 optimally affect the mass, mass distribution, CG, MOI characteristics, structural integrity and/or or other static and/or dynamic characteristics of the golf club head 100. The apparatus, methods, and articles of manufacture described herein are not limited in this regard.

Figure 12:
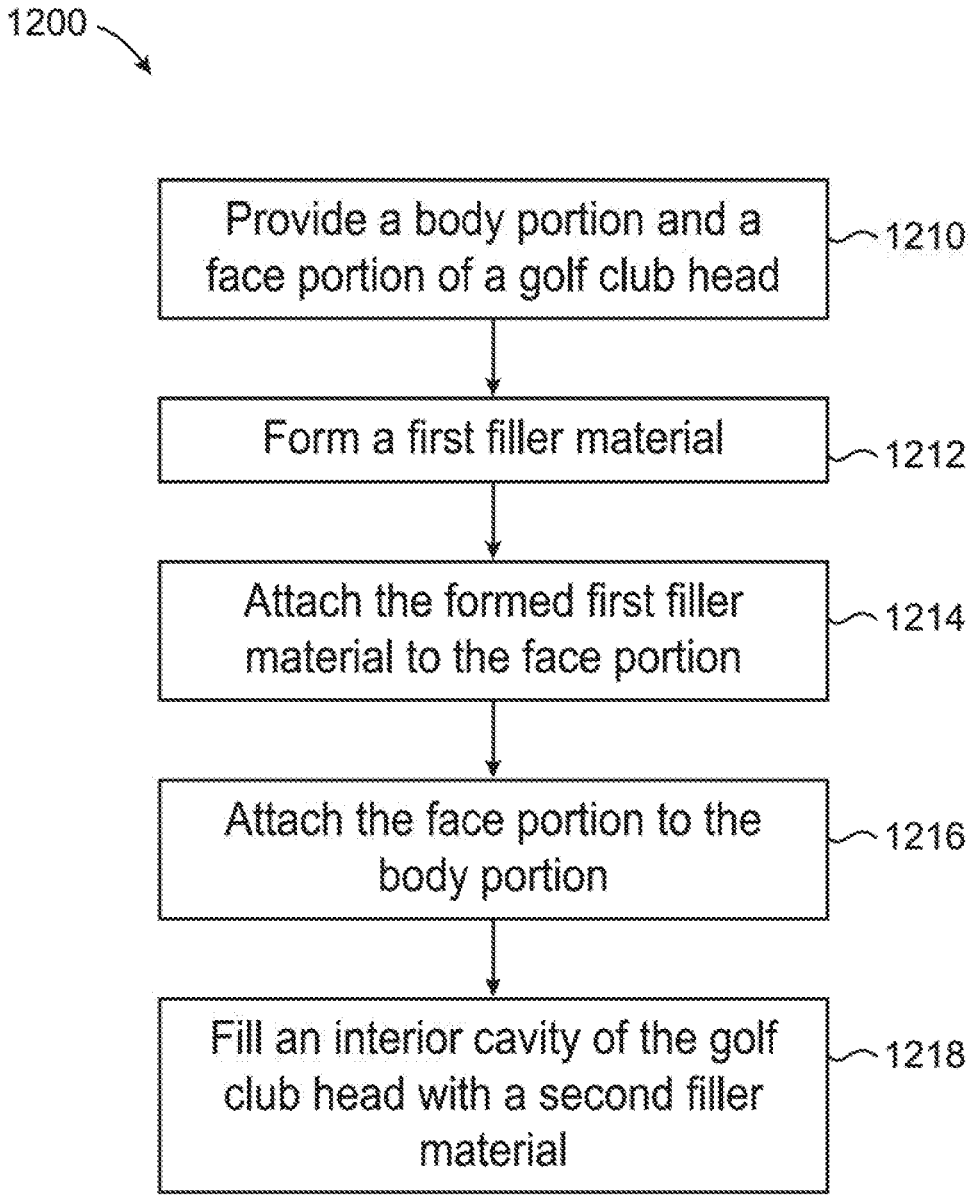
FIG. 12 depicts one manner in which the example golf club head of FIG. 1 may be manufactured.

FIG. 12 depicts one manner by which the example golf club head 100 as described herein may be manufactured. In the example of FIG. 12, the process 1200 may begin with providing a body portion 110 and a face portion 162 of a golf club head 100 (block 1210). The first filler material 412 may be formed or molded into a certain shape (block 1212) as described in detail herein, for example, to resemble, closely resemble, or generally resemble the contour of the interior cavity 210 (i.e., the shape of the inner walls 212 of the interior cavity 210) of the golf club head 100. The first filler material 412 in the molded form may then be attached or bonded to the back surface 166 of the face portion 162 (block 1214) as described herein. The face portion 162 may then be attached to the body portion 110 as described herein to form or enclose the interior cavity 210 (block 1216). The second filler material 414 may then be injected into the interior cavity 210 through one or more of the ports of the first set of ports 220, the second set of ports 230, and/or the third set of ports 240 that may be connected to the interior cavity 210 as described herein to fill the gap 424, to fill the remaining portions of the interior cavity 210 (block 1218), and/or to surround the first filler material 412. The second filler material 414 may be injected into the interior cavity 210 at a relatively high pressure if necessary and/or from more than one port if necessary, to allow the second filler material 414 to fill relatively narrow gaps 424 at certain locations in the interior cavity 210 as described herein between the first filler material 412 and the inner walls of the interior cavity 210. The second filler material 414 may then cure at ambient temperature or by one or more heating/cooling cycles depending on the material used for the second filler material 414. The apparatus, methods, and articles of manufacture described herein are not limited in this regard.

Figure 13:
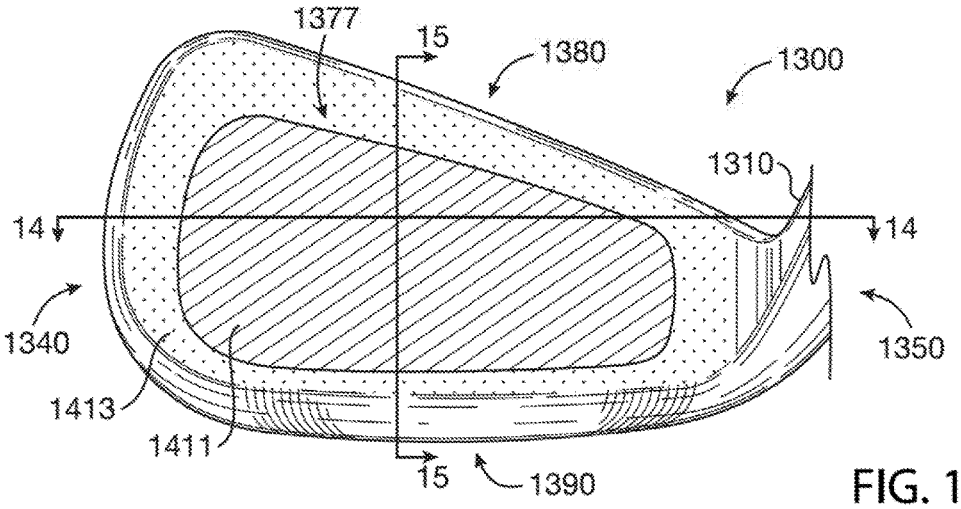
FIG. 13 depicts a perspective cross-sectional view taken at line 13-13 of FIG. 14 of a golf club head according to an embodiment of the apparatus, methods, and articles of manufacture described herein.
Figure 14:
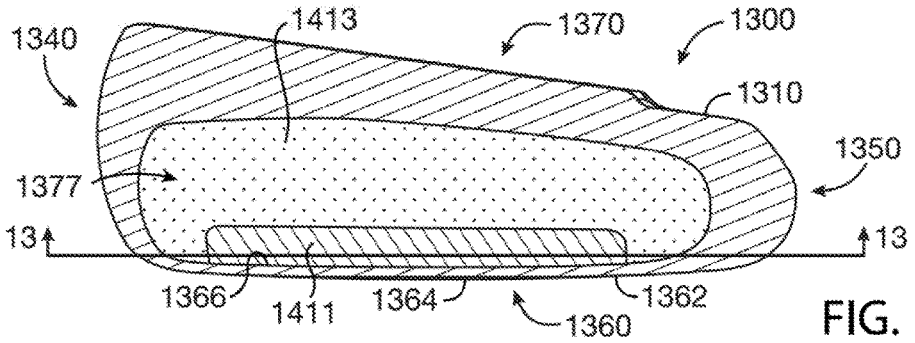
FIG. 14 depicts a perspective cross-sectional view of the golf club head of FIG. 13 taken at line 14-14 of FIG. 13.
Figure 15:
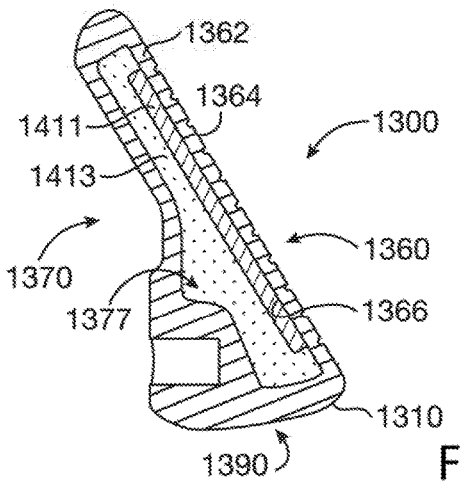
FIG. 15 depicts a perspective cross-sectional view of the golf club head of FIG. 13 taken at line 15-15 of FIG. 13.

In the example of FIGS. 13-15, a golf club head 1300 may include a body portion 1310 having a toe portion 1340, a heel portion 1350, a front portion 1360 with a face portion 1362 (e.g., a strike face) having a front surface 1364 and a back surface 1366, a back portion 1370, a top portion 1380, and a sole portion 1390. In one example, the body portion 1310 may be a hollow body including the interior cavity 1377 extending between the front portion 1360 and the back portion 1370, and extending between the top portion 1380 and the sole portion 1390. The golf club head 1300 may be similar in many respects to any of the golf club heads described herein. For example, the golf club head 1300 may include any number of ports and/or mass portions similar to any of the golf club head described herein. In another example, the golf club head 1300 may include any of the materials described herein. The apparatus, methods, and articles of manufacture described herein are not limited in this regard.

The golf club head 1300 may include one or more filler materials in the interior cavity 1377. In one example, as shown in FIGS. 13-15, the golf club head 1300 may include a first filler material 1411 and a second filler material 1413 having one or more different properties than the first filler material 1411 (e.g., elasticity, density, hardness, etc.). In one example, the first filler material 1411 may be a polymer material having a different elasticity than the second filler material 1413 (e.g., the second filler material 1413 may be more elastic than the first filler material 1411 or vice versa). In another example, the first filler material 1411 may include a polymer material having a different density than the second filler material 1413 (e.g., the first filler material 1411 may have a higher density than the second filler material 1413 or vice versa). In yet another example, the first filler material 1411 may have a different hardness (e.g., Shore D hardness) than the second filler material 1413 (e.g., the first filler material 1411 may have a relatively higher hardness than the second filler material 1413 or vice versa). The first and second filler materials 1411 and 1413, respectively, may be different types of non-metal materials. In one example, the first filler material 1411 may include a thermoset material whereas the second filler material 1413 may include a thermoplastic elastomer material. In another example, the second filler material 1413 may include a thermoset material whereas the first filler material 1411 may include a thermoplastic elastomer material. The first and second filler materials 1411 and 1413, respectively, may include the same type of non-metal material but different properties. In one example, the first filler material 1411 may include a thermoset material and the second filler material 1413 may include a thermoset material having a different elasticity than the first filler material 1411. In another example, the first filler material 1411 may include a thermoplastic material and the second filler material 1413 may include a thermoplastic material having a different elasticity than the first filler material 1411. Alternatively, the first and second filler materials 1411 and 1413, respectively, may include metal materials and/or non-metal materials. For example, the first filler material 1411 may include one or more metal-based materials whereas the second filler material 1413 may include one or more polymer materials. Further, the first filler material 1411 and/or the second filler material 1413 may include any of the filler materials described herein. In one example, the first filler material 1411 may be an epoxy material such as any of the epoxy materials described herein and the second filler material 1413 may be an elastomer material such as any of the elastomer materials described herein. In one example, the first filler material 1411 may be an epoxy material such as any of the epoxy materials described herein and the second filler material 1413 may be an elastomer material such as any of the elastomer materials described herein. In another example, the first filler material 1411 may be a rubber-based compound and the second filler material 1413 may be an epoxy-based compound. In yet another example, the first filler material 1411 may be similar to the first filler material 412, and the second filler material 1413 may be similar to the second filler material 414. The apparatus, methods, and articles of manufacture described herein are not limited in this regard.

The first filler material 1411 may have a relatively higher coefficient of restitution (COR) than the second filler material 1413. In one example, the first filler material 1411 may have a COR ranging between 0.65 and 0.93 when measured at an approach velocity of 125 ft/s (38.1 m/s) (i.e., approach velocity according to the COR measurement procedures described herein). In another example, the first filler material 1411 may have a COR ranging between 0.70 and 0.85 when measured at an approach velocity of 125 ft/s (38.1 m/s). In another example, the first filler material 1411 may have a COR ranging between 0.75 and 0.80 when measured at an approach velocity of 125 ft/s (38.1 m/s). In another example, the first filler material 1411 may have a COR ranging between 0.68 and 0.88 when measured at an approach velocity of 125 ft/s (38.1 m/s). In another example, the first filler material 1411 may have a COR ranging between 0.77 and 0.85 when measured at an approach velocity of 125 ft/s (38.1 m/s). In another example, the first filler material 1411 may have a COR ranging between 0.65 and 0.83 when measured at an approach velocity of 125 ft/s (38.1 m/s). The apparatus, methods, and articles of manufacture described herein are not limited in this regard.

In one example, the second filler material 1413 may have a COR ranging between 0.17 and 0.75 when measured at an approach velocity of 125 ft/s (38.1 m/s) (i.e., approach velocity according to the COR measurement procedures described herein). In another example, the second filler material 1413 may have a COR ranging between 0.27 and 0.65 when measured at an approach velocity of 125 ft/s (38.1 m/s). In another example, the second filler material 1413 may have a COR ranging between 0.32 and 0.60 when measured at an approach velocity of 125 ft/s (38.1 m/s). In another example, the second filler material 1413 may have a COR ranging between 0.37 and 0.65 when measured at an approach velocity of 125 ft/s (38.1 m/s). In another example, the second filler material 1413 may have a COR ranging between 0.25 and 0.62 when measured at an approach velocity of 125 ft/s (38.1 m/s). In another example, the second filler material 1413 may have a COR ranging between 0.34 and 0.72 when measured at an approach velocity of 125 ft/s (38.1 m/s). The apparatus, methods, and articles of manufacture described herein are not limited in this regard.

In one example, as shown in FIGS. 13-15, the first filler material 1411 may be attached or bonded to a portion of the back surface 1366 of the face portion 1362. In one example, the first filler material 1411 may be attached or bonded to a ball strike region of the back surface 1366 of the face portion 1362. In another example, the first filler material 1411 may be attached or bonded to the ball strike region of the back surface 1366 of the face portion 1362 and an area surrounding the ball strike region of the back surface 1366 of the face portion 1362. In one example, the width of the first filler material 1411 (i.e., the thickness of the first filler material 1411) may be less than the thickness of the face portion 1362. In another example, the width of the first filler material 1411 may be similar to the thickness of the face portion 1362. In yet another example, the width of the first filler material 1411 may be greater than the thickness of the face portion 1362. The apparatus, methods, and articles of manufacture described herein are not limited in this regard.

In one example, as shown in FIGS. 13-15, the remaining portions of the interior cavity 1377 may be partially or entirely filled with the second filler material 1413. The first filler material 1411 may be surrounded by the second filler material 1413 such that the second filler material 1413 is attached or bonded to the remaining portions of the back surface 1366 of the face portion 1362. As shown in FIG. 13, the second filler material 1333 may be attached or bonded to the back surface 1366 of the face portion 1362 and define a perimeter portion on the back surface 1366 of the face portion 1362 surrounding the first filler material 1411. For example, as shown in FIGS. 13-15, the second filler material 1413 may be attached or bonded to a portion of the back surface 1366 of the face portion 1362 and surround the first filler material 1411 at or proximate to the toe portion 1340, attached or bonded to a portion of the back surface 1366 of the face portion 1362 and surround the first filler material 1411 at or proximate to the heel portion 1350, attached or bonded to a portion of the back surface 1366 of the face portion 1362 and surround the first filler material 1411 at or proximate to the top portion 1380, and/or attached or bonded to a portion of the back surface 1366 of the face portion 1362 and surround the first filler material 1411 at or proximate to the sole portion 1390. The apparatus, methods, and articles of manufacture described herein are not limited in this regard.

Figure 16:
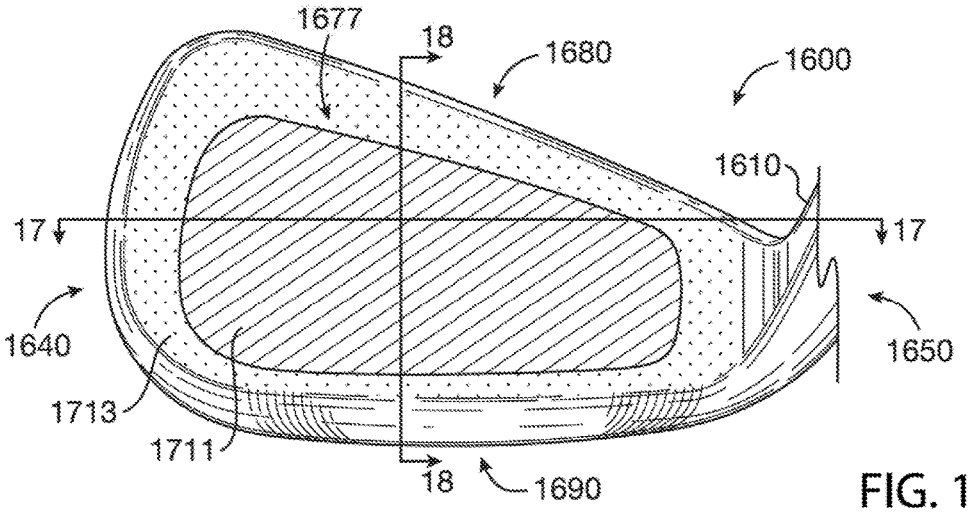
FIG. 16 depicts a perspective cross-sectional view taken at line 16-16 of FIG. 17 of a golf club head according to an embodiment of the apparatus, methods, and articles of manufacture described herein.
Figure 17:
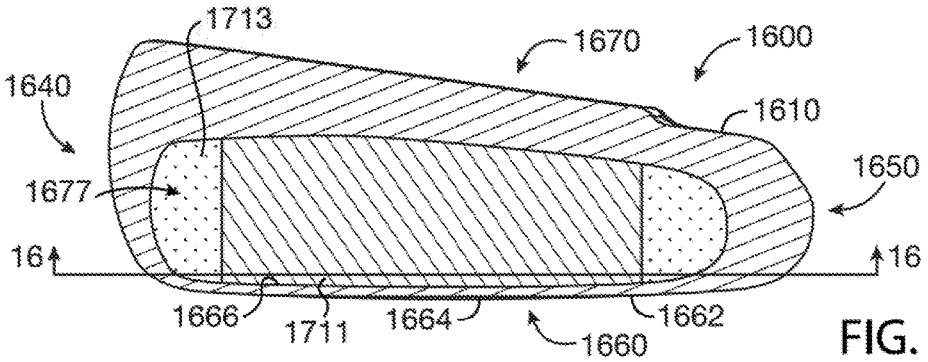
FIG. 17 depicts a perspective cross-sectional view of the golf club head of FIG. 16 taken at line 17-17 of FIG. 16.
Figure 18:
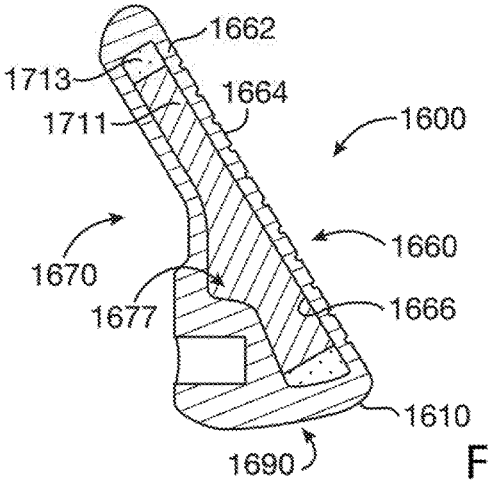
FIG. 18 depicts a perspective cross-sectional view of the golf club head of FIG. 16 taken at line 18-18 of FIG. 16.

In the example of FIGS. 16-18, a golf club head 1600 may include a body portion 1610 having a toe portion 1640, a heel portion 1650, a front portion 1660 with a face portion 1662 (e.g., a strike face) having a front surface 1664 and a back surface 1666, a back portion 1670, a top portion 1680, and a sole portion 1690. In one example, the body portion 1610 may be a hollow body including the interior cavity 1677 extending between the front portion 1660 and the back portion 1670 and extending between the top portion 1680 and the sole portion 1690. The golf club head 1600 may be similar in many respects to any of the golf club heads described herein. For example, the golf club head 1600 may include any number of ports and/or mass portions similar to any of the golf club head described herein. In another example, the golf club head 1600 may include any of the materials described herein. The apparatus, methods, and articles of manufacture described herein are not limited in this regard.

The golf club head 1600 may include a first filler material 1711 and a second filler material 1713 that may be similar to the first filler material 1411 and the second filler material 1413, respectively, of the golf club head 1300. In the example of FIGS. 16-18, the first filler material 1711 may be attached or bonded to a portion of the back surface 1666 of the face portion 1662 similar to the examples of FIGS. 13-15. In the example of FIGS. 16-18, however, the first filler material 1711 may extend from the back surface 1666 of the face portion 1662 to a back surface 1676 of a back wall 1672 of the back portion 1670. The first filler material 1711 may contact or be attached or bonded to the back surface 1676 of a back wall 1672 of the back portion 1670. The remaining portions of the interior cavity 1677 may be partially or entirely filled with the second filler material 1713. The apparatus, methods, and articles of manufacture described herein are not limited in this regard.

Figure 19:
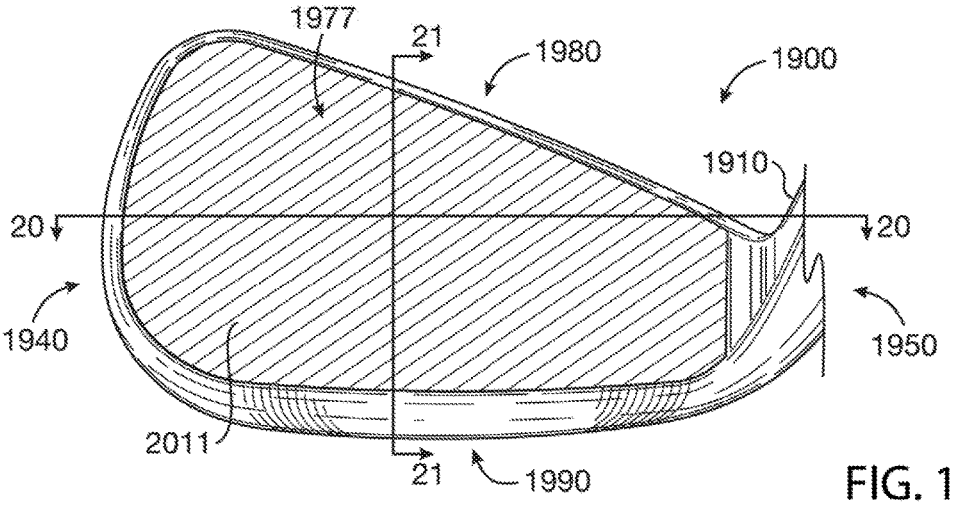
FIG. 19 depicts a perspective cross-sectional view taken at line 19-19 of FIG. 20 of a golf club head according to an embodiment of the apparatus, methods, and articles of manufacture described herein.
Figure 20:
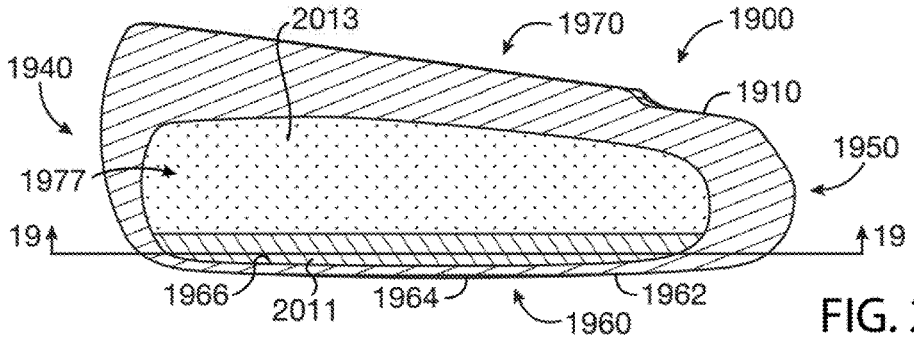
FIG. 20 depicts a perspective cross-sectional view of the golf club head of FIG. 19 taken at line 20-20 of FIG. 19.
Figure 21:
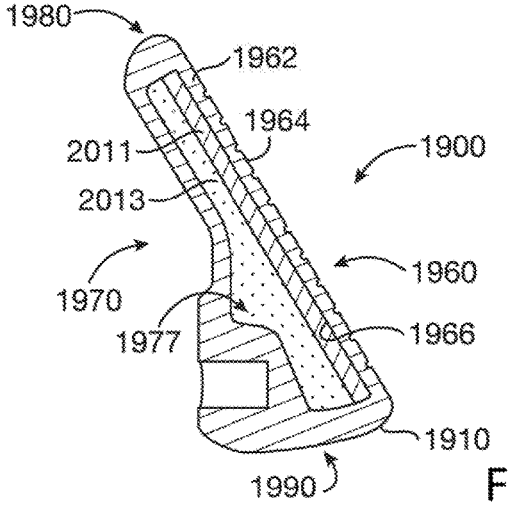
FIG. 21 depicts a perspective cross-sectional view of the golf club head of FIG. 19 taken at line 21-21 of FIG. 19.

In the example of FIGS. 19-21, a golf club head 1900 may include a body portion 1910 having a toe portion 1940, a heel portion 1950, a front portion 1960 with a face portion 1962 (e.g., a strike face) having a front surface 1964 and a back surface 1966, a back portion 1970, a top portion 1980, and a sole portion 1990. In one example, the body portion 1910 may be a hollow body including the interior cavity 1977 extending between the front portion 1960 and the back portion 1970 and extending between the top portion 1980 and the sole portion 1990. The golf club head 1900 may be similar in many respects to any of the golf club heads described herein. For example, the golf club head 1900 may include any number of ports and/or mass portions similar to any of the golf club head described herein. In another example, the golf club head 1900 may include any of the materials described herein. The apparatus, methods, and articles of manufacture described herein are not limited in this regard.

The golf club head 1900 may include a first filler material 2011 and a second filler material 2013 that may be similar to the first filler material 1411 and the second filler material 1413, respectively, of the golf club head 1300. In the example of FIGS. 19-21, the first filler material 2011 may be attached or bonded to a substantial portion of or the entire back surface 1966 of the face portion 1962. In one example, the width of the first filler material 2011 (i.e., the thickness of the first filler material 2011) may be less than the thickness of the face portion 1962. In another example, the width of the first filler material 2011 may be similar to the thickness of the face portion 1962. In yet another example, the width of the first filler material 2011 may be greater than the thickness of the face portion 1962. The remaining portions of the interior cavity 1977 may be partially or entirely filled with the second filler material 2013. The apparatus, methods, and articles of manufacture described herein are not limited in this regard.

Figure 22:
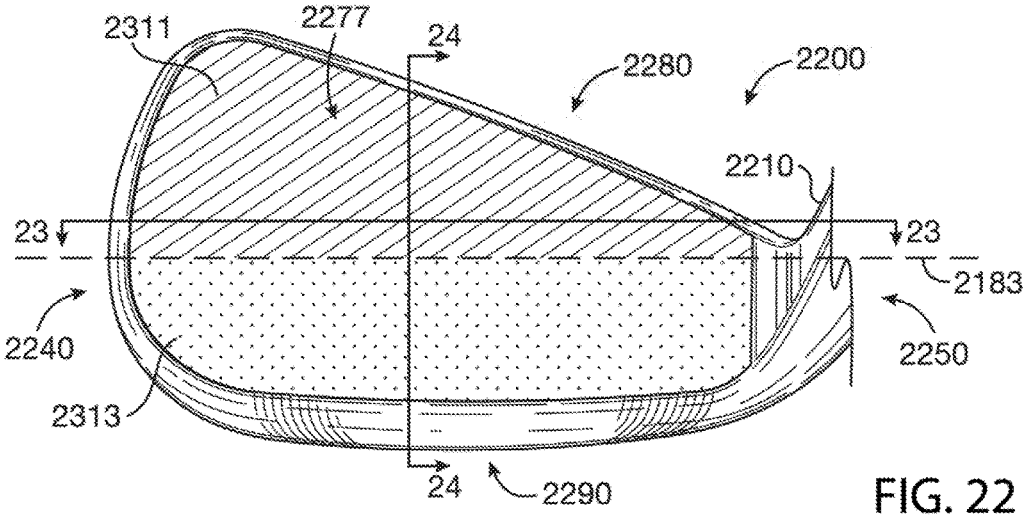
FIG. 22 depicts a perspective cross-section view taken at line 22-22 of FIG. 23 of a golf club head according to an embodiment of the apparatus, methods, and articles of manufacture described herein.
Figure 23:
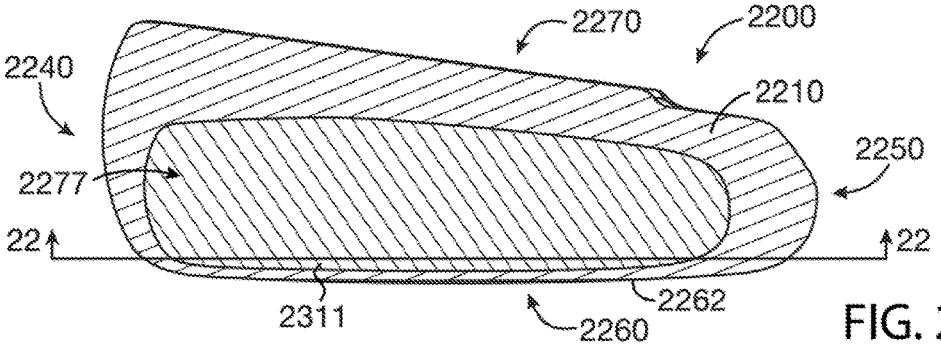
FIG. 23 depicts a perspective cross-sectional view of the golf club head of FIG. 22 taken at line 23-23 of FIG. 22.
Figure 24:
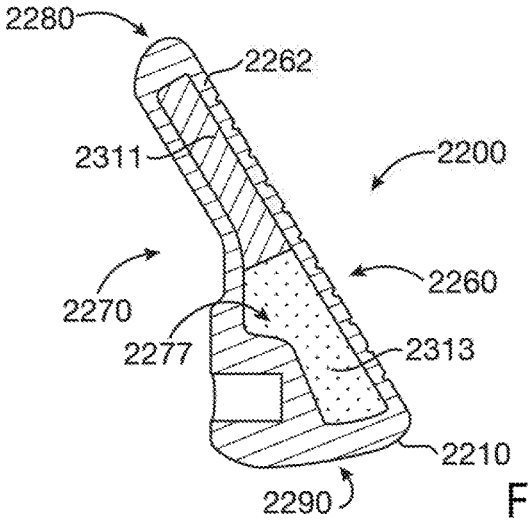
FIG. 24 depicts a perspective cross-sectional view of the golf club head of FIG. 22 taken at line 24-24 of FIG. 22.

In the example of FIGS. 22-24, a golf club head 2200 may include a body portion 2210 having a toe portion 2240, a heel portion 2250, a front portion 2260 with a face portion 2262 (e.g., a strike face) having a front surface 2264 and a back surface 2266, a back portion 2270, a top portion 2280, and a sole portion 2290. In one example, the body portion 2210 may be a hollow body including the interior cavity 2277 extending between the front portion 2260 and the back portion 2270 and extending between the top portion 2280 and the sole portion 2290. The golf club head 2200 may be similar in many respects to any of the golf club heads described herein. For example, the golf club head 2200 may include any number of ports and/or mass portions similar to any of the golf club head described herein. In another example, the golf club head 2200 may include any of the materials described herein. The apparatus, methods, and articles of manufacture described herein are not limited in this regard.

The golf club head 2200 may include a first filler material 2311 and a second filler material 2313 that may be similar to the first filler material 1411 and the second filler material 1413, respectively, of the golf club head 1300. In the example of FIGS. 22-24, a portion of the interior cavity 2277 above a horizontal midplane 2283 of the body portion 2210 may be partially or entirely filled with the first filler material 2311, and a portion of the interior cavity 2277 below the horizontal midplane 2283 may be partially or entirely filled with the second filler material 2313. In one example, the first filler material 2311 and the second filler material 2313 may contact each other, be attached together, or bonded together at or proximate to the horizontal midplane 2283. In another example, the first filler material 2311 and the second filler material 2313 may contact each other, be attached together, or bonded together above the horizontal midplane 2283. Accordingly, a portion of the interior cavity 2277 from a location above the horizontal midplane 2283 to the sole portion 2290 may be filled with the second filler material 2313, and the remaining portions of the interior cavity 2277 may be filled with the first filler material 2311. In yet another example, as shown in FIGS. 22-24, the first filler material 2311 and the second filler material 2313 may contact each other, be attached together, or bonded together below the horizontal midplane 2283. Accordingly, a portion of the interior cavity 2277 from a location below the horizontal midplane 2283 to the sole portion 2290 may be filled with the second filler material 2313, and the remaining portions of the interior cavity 2277 may be filled with the first filler material 2311. In yet another example, the first filler material 2311 and the second filler material 2313 may contact each other, be attached together, or bonded together along a region extending between the toe portion 2240 and the heel portion 2250 and intersecting the horizontal midplane 2283 (i.e., the region oriented at a non-zero angle relative to the horizontal midplane). The apparatus, methods, and articles of manufacture described herein are not limited in this regard.

Figure 25:
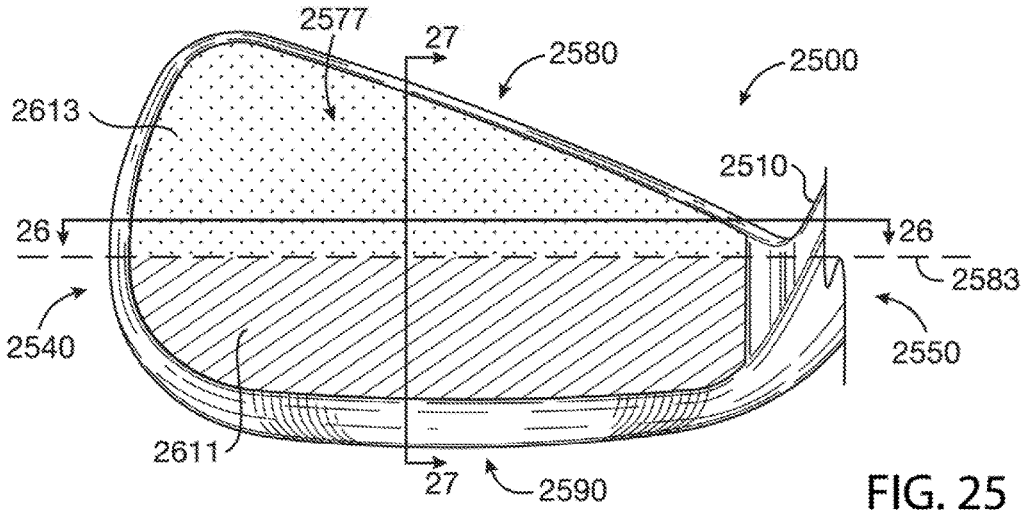
FIG. 25 depicts a perspective cross-section view taken at line 25-25 of FIG. 26 of a golf club head according to an embodiment of the apparatus, methods, and articles of manufacture described herein.
Figure 26:
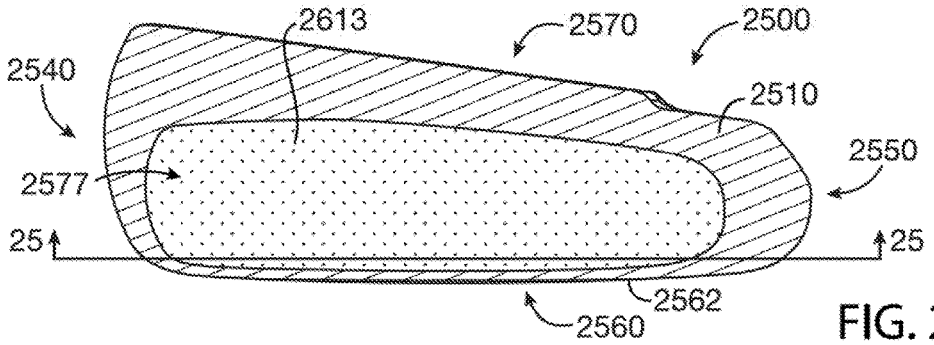
FIG. 26 depicts a perspective cross-sectional view of the golf club head of FIG. 25 taken at line 26-26 of FIG. 25.
Figure 27:
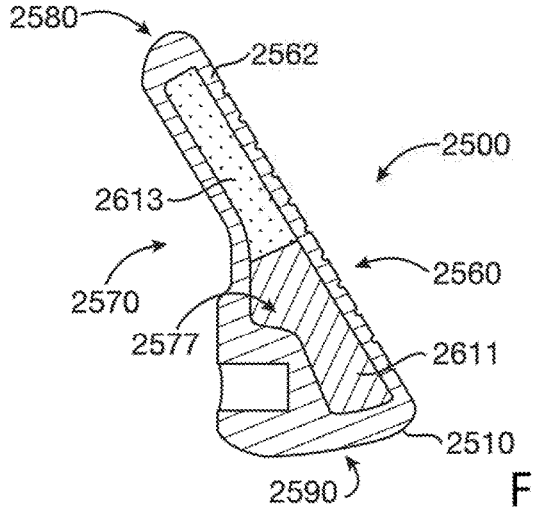
FIG. 27 depicts a perspective cross-sectional view of the golf club head of FIG. 25 taken at line 27-27 of FIG. 25.

In the example of FIGS. 25-27, a golf club head 2500 may include a body portion 2510 having a toe portion 2540, a heel portion 2550, a front portion 2560 with a face portion 2562 (e.g., a strike face) having a front surface 2564 and a back surface 2566, a back portion 2570, a top portion 2580, and a sole portion 2590. In one example, the body portion 2510 may be a hollow body including the interior cavity 2577 extending between the front portion 2560 and the back portion 2570 and extending between the top portion 2580 and the sole portion 2590. The golf club head 2500 may be similar in many respects to any of the golf club heads described herein. For example, the golf club head 2500 may include any number of ports and/or mass portions similar to any of the golf club head described herein. In another example, the golf club head 2500 may include any of the materials described herein. The apparatus, methods, and articles of manufacture described herein are not limited in this regard.

The golf club head 2500 may include a first filler material 2611 and a second filler material 2613 that may be similar to the first filler material 1411 and the second filler material 1413, respectively, of the golf club head 1300. In the example of FIGS. 25-27, a portion of the interior cavity 2577 below a horizontal midplane 2583 of the body portion 2510 may be partially or entirely filled with the first filler material 2611, and a portion of the interior cavity 2577 above the horizontal midplane 2583 may be partially or entirely filled with the second filler material 2613. In one example, the first filler material 2611 and the second filler material 2613 may contact each other, be attached together, or bonded together at or proximate to the horizontal midplane 2583. In another example, the first filler material 2611 and the second filler material 2613 may contact each other, be attached together, or bonded together above the horizontal midplane 2583. Accordingly, a portion of the interior cavity 2577 from a location above the horizontal midplane 2583 to the sole portion 2590 may be filled with the first filler material 2611, and the remaining portions of the interior cavity 2577 may be filled with the second filler material 2613. In yet another example, as shown in FIGS. 25-27, the first filler material 2611 and the second filler material 2613 may contact each other, be attached together, or bonded together below the horizontal midplane 2583. Accordingly, a portion of the interior cavity 2577 from a location below the horizontal midplane 2583 to the sole portion 2590 may be filled with the first filler material 2611, and the remaining portions of the interior cavity 2577 may be filled with the second filler material 2613. In yet another example, the first filler material 2611 and the second filler material 2613 may be attached or bonded together along a region extending between the toe portion 2540 and the heel portion 2550 and intersecting the horizontal midplane 2583 (i.e., the region oriented at a non-zero angle relative to the horizontal midplane). The apparatus, methods, and articles of manufacture described herein are not limited in this regard.

Figure 28:
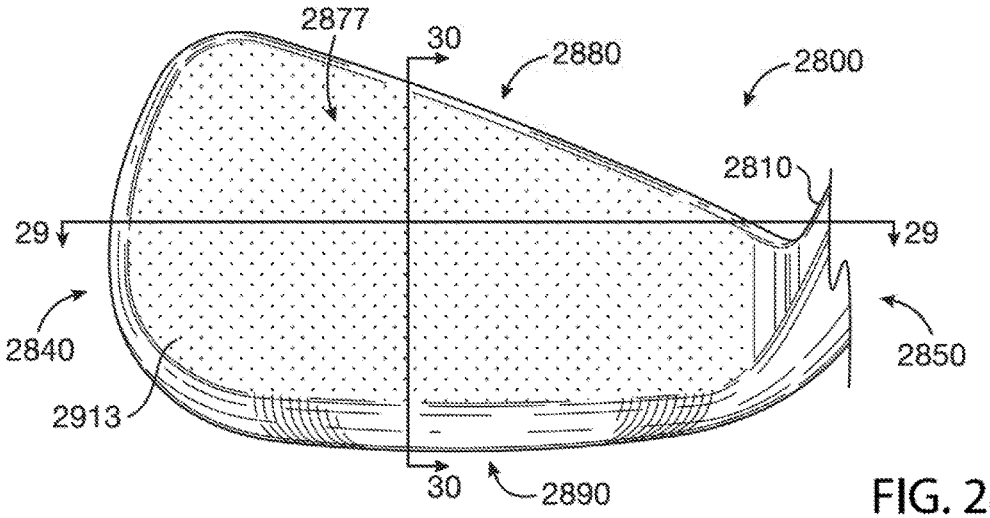
FIG. 28 depicts a perspective cross-sectional view taken at line 28-28 of FIG. 29 of a golf club head according to an embodiment of the apparatus, methods, and articles of manufacture described herein.
Figure 29:
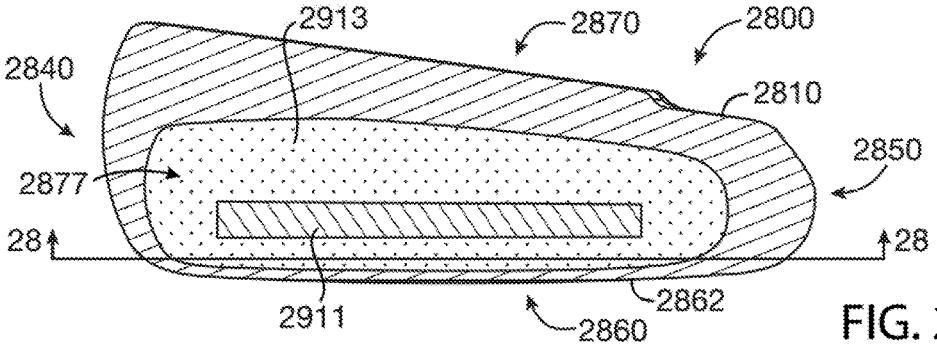
FIG. 29 depicts a perspective cross-sectional view of the golf club head of FIG. 28 taken at line 29-29 of FIG. 28.
Figure 30:
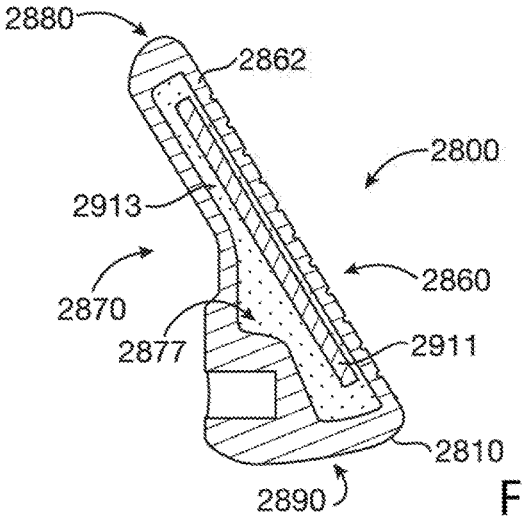
FIG. 30 depicts a perspective cross-sectional view of the golf club head of FIG. 28 taken at line 30-30 of FIG. 28.

In the example of FIGS. 28-30, a golf club head 2800 may include a body portion 2810 having a toe portion 2840, a heel portion 2850, a front portion 2860 with a face portion 2862 (e.g., a strike face) having a front surface 2864 and a back surface 2866, a back portion 2870, a top portion 2880, and a sole portion 2890. In one example, the body portion 2810 may be a hollow body including the interior cavity 2877 extending between the front portion 2860 and the back portion 2870 and extending between the top portion 2880 and the sole portion 2890. The golf club head 2800 may be similar in many respects to any of the golf club heads described herein. For example, the golf club head 2800 may include any number of ports and/or mass portions similar to any of the golf club head described herein. In another example, the golf club head 2800 may include any of the materials described herein. The apparatus, methods, and articles of manufacture described herein are not limited in this regard.

The golf club head 2800 may include a first filler material 2911 and a second filler material 2913 that may be similar to the first filler material 1411 and the second filler material 1413, respectively, of the golf club head 1300. In the example of FIGS. 28-30, a portion of the interior cavity 2877 spaced apart from any boundary of the interior cavity 2877 defined by the body portion 2810 and the face portion 2862 may be filled with the first filler material 2911, and the remaining portions of the interior cavity 2877 may be partially or entirely filled with the second filler material 2913. In other words, the first filler material 2911 may be suspended in the interior cavity 2877 and entirely surrounded by the second filler material 2913. The portion of the interior cavity 2877 filled with the first filler material 2911 may be similar in size and/or shape to the ball strike region of the face portion 2862 and located closer to the face portion 2862 than the back portion 2870. The apparatus, methods, and articles of manufacture described herein are not limited in this regard.

In one example, as described herein, one or more polymer materials may be injection molded in the body portion of any of the golf club heads described herein. In other examples. The one or more polymer materials may be made or formed by any useful forming means for forming polymers. This include, molding including compression molding, injection molding, blow molding, and transfer molding; film blowing or casting; extrusion, and thermoforming; as well as by lamination, pultrusion, protrusion, draw reduction, rotational molding, spin bonding, melt spinning, melt blowing; or combinations thereof. In another example, any one or more of the polymer materials described herein may be in pellet or solid pieces that may be placed in the interior cavity and expanded and/or cured with heat. The apparatus, methods, and articles of manufacture described herein are not limited in this regard.

The interior cavity of any of the golf club heads described herein may be partially or entirely filled with one or more thermoset materials (e.g., one or more epoxy materials), such as any one or more of the epoxy materials described herein or any other suitable epoxy material(s). For example, the interior cavity of any of the golf club heads described herein may be substantially filled with one or more thermoset materials (e.g., one or more epoxy materials), such as any of the epoxy materials described herein or any other suitable epoxy material(s). In one example, the interior cavity of any of the golf club heads described herein may be at least 90% filled with a thermoset material. In another example, the interior cavity of any of the golf club heads described herein may be at least 80% filled with a thermoset material. In yet another example, the interior cavity of any of the golf club heads described herein may be at least 70% filled with a thermoset material. In yet another example, the interior cavity of any of the golf club heads described herein may be at least 60% filled with a thermoset material. In yet another example, the interior cavity of any of the golf club heads described herein may be at least 50% filled with a thermoset material. In yet another example, the interior cavity of any of the golf club heads described herein may be partially, substantially, or entirely filled with one or more thermoset materials (i.e., at least two thermoset materials). A thermoset material partially, substantially, or entirely filling the interior cavity may affect vibration and noise dampening, structural support for a relatively thin face portion, ball travel distance, ball speed, ball launch angle, ball spin rate, ball peak height, ball landing angle and/or ball dispersion. The apparatus, methods, and articles of manufacture described herein are not limited in this regard. The apparatus, methods, and articles of manufacture described herein are not limited in this regard.

Figure 31:
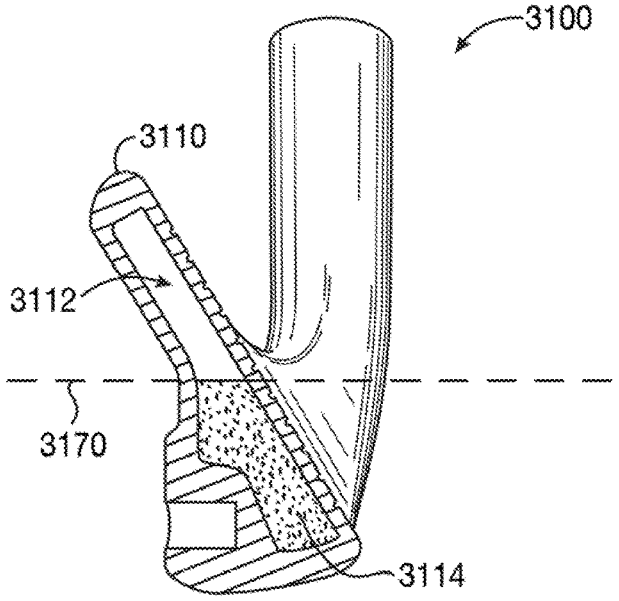
FIG. 31 is a perspective cross-sectional view of a golf club head according to an embodiment of the apparatus, methods, and articles of manufacture described herein.

As illustrated in FIG. 31, for example, the interior cavity 3112 of a body portion 3110 of the golf club head 3100, which may be similar to any of the golf club heads described herein, may be filled with a thermoset material 3114 (e.g., epoxy material) below the horizontal midplane 3170 of the golf club head 3100. In another example, the interior cavity 3112 of the golf club head 3100 or any of the golf club heads described herein may be filled with a thermoset material (e.g., epoxy material) above the horizontal midplane 3170 (not shown). In yet another example, the interior cavity 3112 of the golf club head 3100 or any of the golf club heads described herein may be filled with a thermoset material (e.g., epoxy material) above and below the horizontal midplane 3170 and yet have regions in the interior cavity 3112 that may not include any thermoset materials or include other materials (not shown). The apparatus, methods, and articles of manufacture described herein are not limited in this regard.

Figure 32:
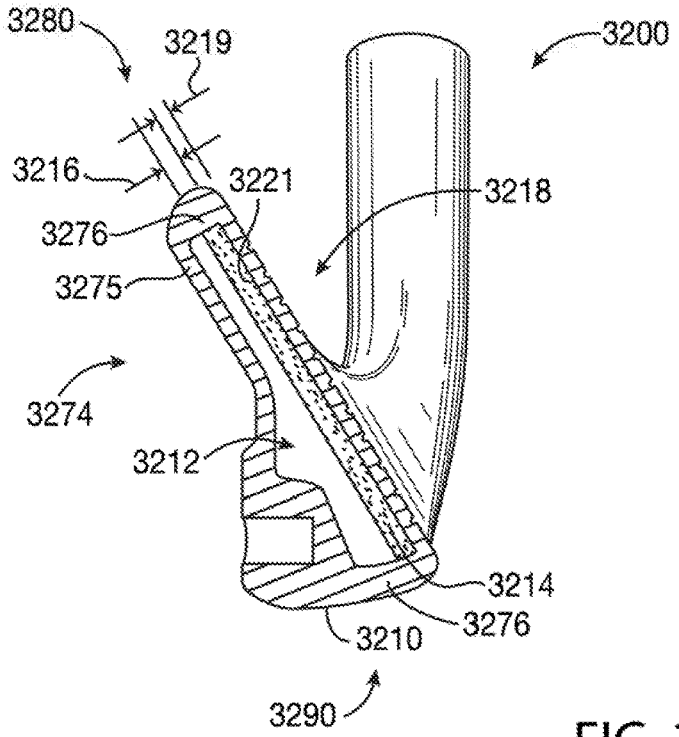
FIG. 32 is a perspective cross-sectional view of a golf club head according to an embodiment of the apparatus, methods, and articles of manufacture described herein.

As shown in FIG. 32, for example, a golf club head 3200, which may be similar to any of the golf club heads described herein, may include a body portion 3210 with an interior cavity 3212 having a width 3216 of a thermoset material 3214. The width 3216 may be related to face portion thickness 3219 of the face portion 3218 by the following expression:

$$W_{th} a T_f \tag{6}$$

Where: $0.5 \leq a \leq 5.0$ $W_{th}$ is the width of the thermoset material in inches, and $T_f$ is the thickness of the face portion in inches.

In one example, the width 3216 of the thermoset material 3214 may be greater than or equal to half the face portion thickness 3219. In another example, the width 3216 of the thermoset material 3214 may be greater than or equal to the face portion thickness 3219 (e.g., $W_{th} \geq T_f$). In yet another example, the width 3216 of the thermoset material 3214 may be greater than or equal to twice the face portion thickness 3219 (e.g., $W_{th} \geq 2T_f$). In another example, the width 3216 of the thermoset material 3214 may be greater than or equal to three times the face portion thickness 3219 (e.g., $W_{th} \geq 3T_f$). In yet another example, the width 3216 of the thermoset material 3214 may be greater than five times the face portion thickness 3219 (e.g., $W_{th} \geq 5T_f$). In yet another example, the width 3216 of the thermoset material 3214 may be greater than or equal to the face portion thickness 3219 and less than or equal to three times the face portion thickness 3219 (e.g., $T_f \leq W_{th} \leq 3T_f$). The apparatus, methods, and articles of manufacture described herein are not limited in this regard.

In one example, the mass of the thermoset material (e.g., epoxy) partially, substantially (e.g., filling at least 50% of the interior cavity), or entirely filling the interior cavity of any of the golf club heads described herein may be greater than or equal to 6.0 grams and less than or equal to 32.0 grams. In another example, the mass of the thermoset material partially, substantially or entirely filling the interior cavity of any of the golf club heads described herein may be greater than or equal to 6.0 grams and less than or equal to 24.0 grams. In yet another example, the mass of the thermoset material partially, substantially or entirely filling the interior cavity of any of the golf club heads described herein may be greater than or equal to 12.0 grams and less than or equal to 18.0 grams. In yet another example, the mass of the thermoset material partially, substantially or entirely filling the interior cavity of any of the golf club heads described herein may be greater than or equal to 16.0 grams and less than or equal to 27.0 grams. In yet another example, the mass of the thermoset material partially, substantially or entirely filling the interior cavity of any of the golf club heads described herein may be greater than or equal to 32.0 grams and less than or equal to 31.0 grams. In yet another example, the mass of the thermoset material partially, substantially or entirely filling the interior cavity of any of the golf club heads described herein may be greater than or equal to 33.0 grams and less than or equal to 28.0 grams. In yet another example, the mass of the thermoset material partially, substantially or entirely filling the interior cavity of any of the golf club heads described herein may be greater than or equal to 10.0 grams and less than or equal to 32.0 grams. In yet another example, the mass of the thermoset material partially, substantially, or entirely filling the interior cavity of any of the golf club heads described herein may be greater than or equal to 15.0 grams and less than or equal to 30.0 grams. In yet another example, the mass of the thermoset material partially, substantially, or entirely filling the interior cavity of any of the golf club heads described herein may be greater than or equal to 32.0 grams and less than or equal to 30.0 grams. The apparatus, methods, and articles of manufacture described herein are not limited in this regard.

In one example, for any of the golf club heads described herein, the mass of a thermoset material partially, substantially, or entirely filling the interior cavity may be related to the mass of the golf club head by the following expression:

$$0.03 \leq \frac{m_T}{m_H} \leq 0.2 \quad (7)$$

Where: $m_T$ is the mass of the thermoset material in grams, and $m_H$ is the mass of the golf club head in grams.

In one example, a ratio of the mass of the thermoset material and the mass of the golf club head may be greater than or equal to 0.04 and less than or equal to 0.08. In another example, a ratio of the mass of the thermoset material and the mass of the golf club head may be greater than or equal to 0.05 and less than or equal to 0.09. In another example, a ratio of the mass of the thermoset material and the mass of the golf club head may be greater than or equal to 0.05 and less than or equal to 0.11. In another example, a ratio of the mass of the thermoset material and the mass of the golf club head may be greater than or equal to 0.09 and less than or equal to 0.12. In another example, a ratio of the mass of the thermoset material and the mass of the golf club head may be greater than or equal to 0.08 and less than or equal to 0.17. In yet another example, a ratio of the mass of the thermoset material and the mass of the golf club head may be greater than or equal to 0.01. The apparatus, methods, and articles of manufacture described herein are not limited in this regard.

A thermoset material partially, substantially, or entirely filling the interior cavity may have a certain Shore D hardness to provide vibration and noise dampening and/or structurally support a relatively thin face portion of a golf club head. In one example, a thermoset material partially, substantially, or entirely filling the interior cavity may have a Shore D hardness of at least 32. In another example, a thermoset material partially, substantially, or entirely filling the interior cavity may have a Shore D hardness of greater than or equal to 32 and less than or equal to 80. In another example, a thermoset material partially, substantially, or entirely filling the interior cavity may have a Shore D hardness of greater than or equal to 25 and less than or equal to 37. In yet another example, a thermoset material partially, substantially, or entirely filling the interior cavity may have a Shore D hardness of greater than or equal to 27 and less than or equal to 65. In yet another example, a thermoset material partially, substantially, or entirely filling the interior cavity may have a Shore D hardness of greater than or equal to 37 and less than or equal to 75. The apparatus, methods, and articles of manufacture described herein are not limited in this regard.

A thermoset material partially, substantially, or entirely filling the interior cavity may have a certain density to provide vibration and noise dampening and/or structurally support a relatively thin face portion of a golf club head. In one example, a thermoset material partially, substantially, or entirely filling the interior cavity may have a density of greater than or equal to 1.0 grams per cubic centimeter ($g/cm^3$) and less than or equal to 2.0 $g/cm^3$. In another example, a thermoset material partially, substantially, or entirely filling the interior cavity may have a density of greater than or equal to 1.1 $g/cm^3$ and less than or equal to 1.5 $g/cm^3$. In yet another example, a thermoset material partially, substantially, or entirely filling the interior cavity may have a density of greater than or equal to 1.0 $g/cm^3$ and less than or equal to 1.4 $g/cm^3$. In yet another example, a thermoset material partially, substantially, or entirely filling the interior cavity may have a density of greater than or equal to 1.1 $g/cm^3$ and less than or equal to 1.2 $g/cm^3$. The apparatus, methods, and articles of manufacture described herein are not limited in this regard.

The polymer material (e.g., the thermoset material 3214 as shown in FIG. 32) may be located adjacent to the back surface 3221 of the face portion 3218. For example, the thermoset material 3214 may be attached and/or bonded directly to the back surface 3221 of the face portion 3218. Alternatively, the thermoset material 3214 may be located away from the face portion 3218. In one example, the thermoset material 3214 be attached and/or bonded to the back wall portion 3275 of the back portion 3274. As a result, the thermoset material 3214 may not be in contact with the back surface 3221 of the face portion 3218. In yet another example, the thermoset material 3214 may be attached and/or bonded to the back surface 3221 and the back wall portion 3275 but not to the side wall portion 3276 at or proximate to the top portion 3280 and/or the sole portion 3290. In addition, as another example, the thermoset material 3214 may not be attached and/or bonded to the side wall portion 3276 at or proximate to the toe portion and/or the heel portion of the golf club head 3200. That is, the thermoset material 3214 may be suspended in the interior cavity 3212 without contact with the side wall portion 3276 (e.g., 280-degree space around the thermoset material 3214). In yet another example, the thermoset material 3214 may be attached and/or bonded to the back surface 3221, the back wall portion 3275, and the side wall portion 3276 at or proximate the top portion 3280 and the sole portion 3290 but not the toe portion and the heel portion of the golf club head 3200. While the above examples may describe the thermoset material 3214 being attached and/or bonded to various surfaces and/or wall portions of the golf club head 3200, the thermoset material 3214 may be attached and/or bonded to more or less surfaces and/or wall portions. The apparatus, methods, and articles of manufacture described herein are not limited in this regard.

Figure 33:
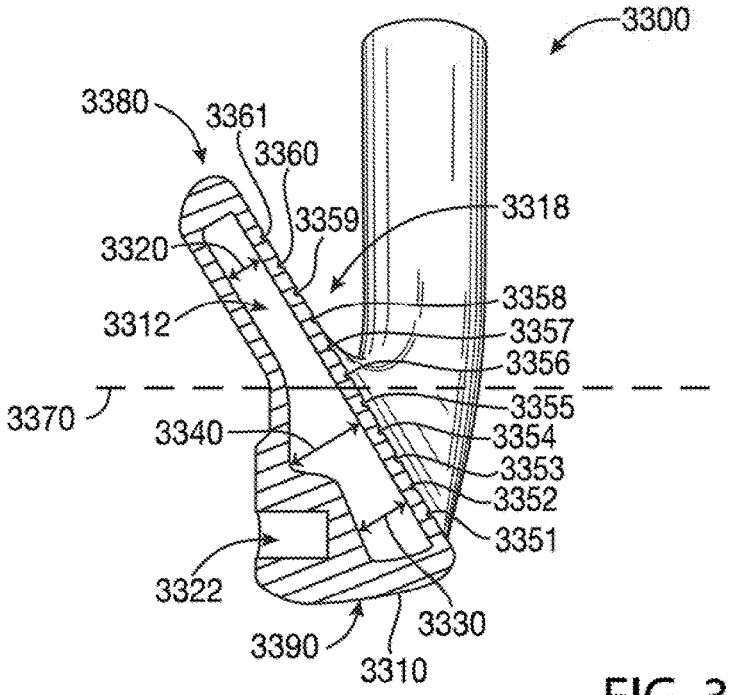
FIG. 33 is a perspective cross-sectional view of a golf club head according to an embodiment of the apparatus, methods, and articles of manufacture described herein.

As shown in FIG. 33, for example, a golf club head 3300, which may be similar to any of the golf club heads described herein, may have a body portion 3310 include an internal cavity 3312 having an internal cavity width that may vary between the top portion 3380 and the sole portion 3390. In particular, the internal cavity 3312 may include a first width 3320 ($W_1$) above a horizontal midplane 3370 of the golf club head 3300, a second width 3330 ($W_2$) below the horizontal midplane 3370, and a third width 3340 ($W_3$) between the first width 3320 and the second width 3330. The third width 3340 may be at or below the horizontal midplane 3370. In one example, the third width 3340 may be above one or more ports (e.g., one generally shown as 3322). Accordingly, the third width 3340 may be located above one or more mass portions (not shown in FIG. 33 but for example, a mass portion disposed in the port 3322) and/or be closer to the horizontal midplane 3370 than one or more mass portions. In another example, the third width 3340 may be above one or more ports of the golf club head 3200 and below the horizontal midplane 3370. The third width 3340 may be greater than the first width 3320 (e.g., $W_3>W_1$) and greater than the second width 3330 (e.g., $W_3>W_2$). In one example, the first width 3320 may be greater than or equal to the second width 3330 (e.g., $W_2\geq W_1$). In another example, the second width 3330 may be greater than or equal to the first width 3320 (e.g., $W_1\geq W_2$). In yet another example, the third width 3340 may be no more than three times the second width 3330. In yet another example, the third width 3340 may be no more than twice the second width 3330. In yet another example, the third width 3340 may be no more than 1.5 times the second width 3330. In yet another example, the third width 3340 may be no more than 1.25 times the second width 3330. The apparatus, methods, and articles of manufacture described herein are not limited in this regard.

The third width 3340 may be at a certain vertical location of the body portion 3310. The face portion 3318 of the golf club head 3300 may include a plurality of grooves. The face portion 3318 of the golf club head 3300 may include a similar number of grooves as the golf club head 100 of FIG. 1. Accordingly, the face portion 3318 may include a plurality of grooves (e.g., eleven grooves are generally shown as grooves 3351, 3352, 3353, 3354, 3355, 3356, 3357, 3357, 3359, 3360, and 3361 in FIG. 33). The third width 3340 may be located between any of the plurality of grooves. In one example, the third width 3340 may be located between the first groove 3351 and the eleventh groove 3361 from the sole portion 3390. In another example, the third width 3340 may be located between the fourth groove 3354 and the eighth groove 3358 from the sole portion 3390. In yet another example, the third width 3340 may be located between the fifth groove 3355 and the seventh groove 3357 from the sole portion 3390. Although FIG. 33 may depict the first, second, and third widths 3320, 3330, and 3340, respectively, of the internal cavity 3312 relative to the loft plane (e.g., one generally shown as 1040 in FIG. 3) associated with the face portion 3318 (e.g., normal to the loft plane), one or more widths may be measured relative to the ground plane (e.g., one generally shown as 1010 in FIG. 1). For example, one or more widths of the internal cavity 3312 may be substantially parallel to the ground plane (e.g., one generally shown as 1010 in FIG. 1). The apparatus, methods, and articles of manufacture described herein are not limited in this regard.

Figure 34:
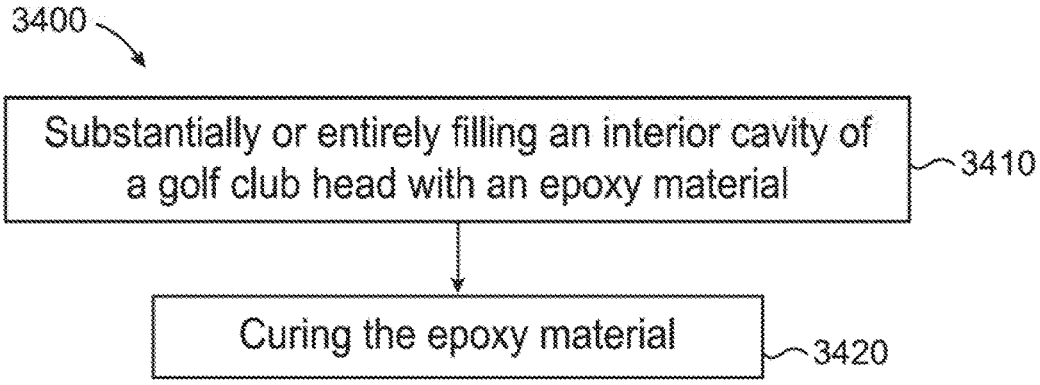
FIG. 34 depicts a manner in which an example golf club head described herein may be manufactured.
Figure 35:
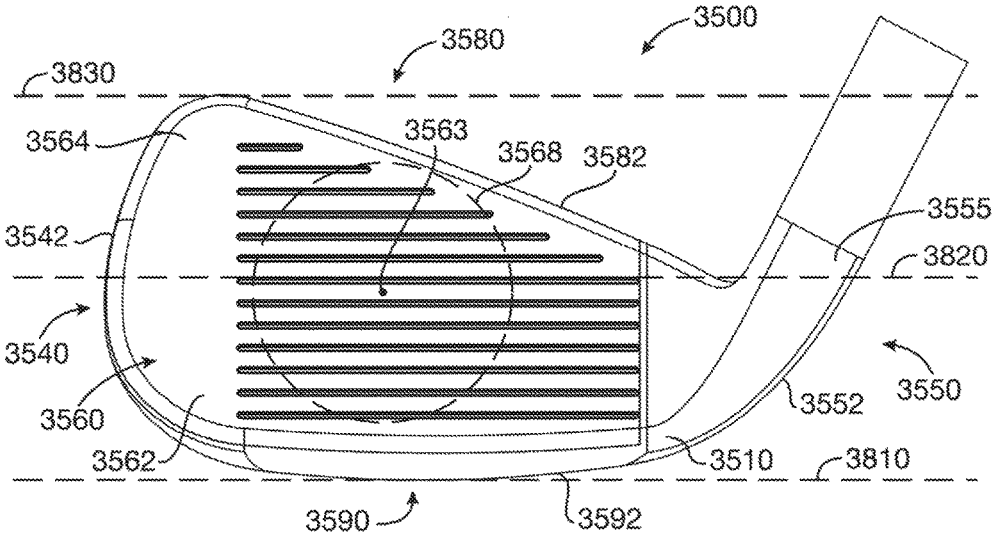
FIG. 35 depicts a perspective front view of a golf club head according to an embodiment of the apparatus, methods, and articles of manufacture described herein.
Figure 36:
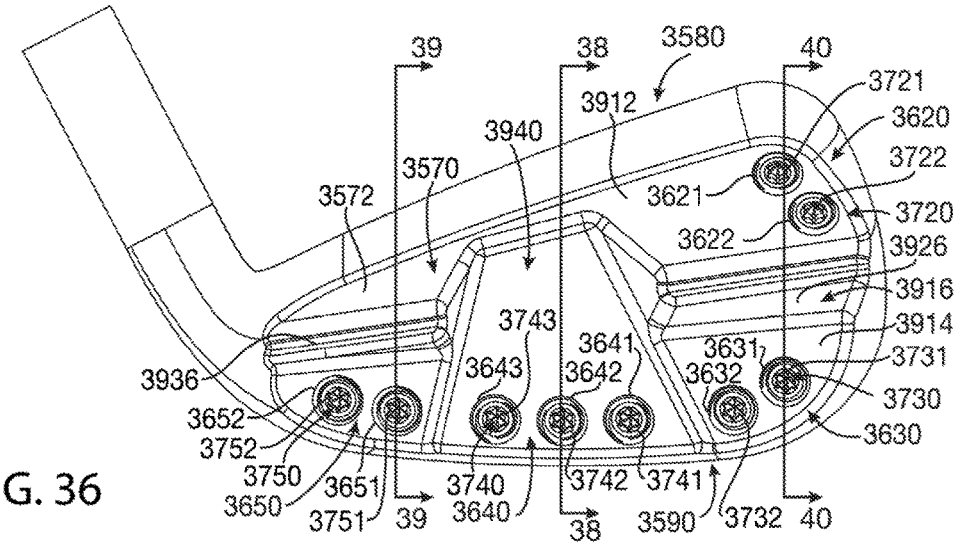
FIG. 36 depicts a perspective back view of the golf club head of FIG. 35.

In one example, the process of filling the interior cavity of the golf club head may not include applying a bonding portion to the back surface of the face portion. For example, as shown in FIG. 34, the process 3400 of filling the interior cavity of the golf club head may include partially, substantially, or entirely filling the interior cavity with an epoxy material (block 3410), and then curing the epoxy material (block 3420). The epoxy material may be injected into the interior cavity from one or more ports on the body portion of a golf club head as described herein. In one example, the process of curing the epoxy material may include using heat, radiation, and/or pressure for a certain period of time. In another example, the process of curing the epoxy material may only include allowing the epoxy material to cure at ambient or room temperature for a certain period of time. In another example, the process of filling the interior cavity of the golf club head may include applying a first epoxy material to the back surface of the face portion, curing the first epoxy material to a first cure state as described herein, filling the interior cavity with a second epoxy material that may be the same as or different from the first epoxy material, and curing the first epoxy material to the second cure state and curing the second epoxy material as described herein. In another example, more than two epoxy materials can be used to substantially or fully fill the interior cavity with single or multiple curing processes used for each epoxy material. The apparatus, methods, and articles of manufacture described herein are not limited in this regard.

In the example of FIGS. 35-40, a golf club head 3500 may include a body portion 3510 having a toe portion 3540 with a toe portion edge 3542, a heel portion 3550 with a heel portion edge 3552 that may include a hosel portion 3555 configured to receive a shaft (not shown) with a grip (not shown) on one end and the golf club head 3500 on the opposite end of the shaft to form a golf club, a front portion 3560 with a perimeter edge portion 3561, a back portion 3570 with a back wall portion 3572, a top portion 3580 with a top portion edge 3582, and a sole portion 3590 with a sole portion edge 3592. The toe portion 3540, the heel portion 3550, the front portion 3560, the back portion 3570, the top portion 3580, and/or the sole portion 3590 may partially overlap each other. The toe portion edge 3542, the heel portion edge 3552, the top portion edge 3582, and the sole portion edge 3592 may define a periphery of the body portion 3510. The apparatus, methods, and articles of manufacture described herein are not limited in this regard.

The golf club head 3500 may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees (°), 48°, 52°, 56°, 60°, etc.). Although FIGS. 35-40 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The volume of the golf club head 3500, the materials of construction of the golf club head 3500, and/or any components thereof may be similar to any of the golf club heads described herein and/or described in any of the incorporated by reference applications. The apparatus, methods, and articles of manufacture described herein are not limited in this regard.

The golf club head 3500 may include a face portion 3562 (i.e., the strike face), which may be integrally formed with the body portion 3510 (e.g., a single unitary piece). In one example, as shown in FIGS. 35-40, the face portion 3562 may be a separate piece coupled (e.g., adhesively, mechanically, by welding, and/or by soldering) to the front portion 3560. The face portion 3562 may include a front surface 3564 and a back surface 3566. In one example (not shown), the front portion 3560 may include one or a plurality of recessed shoulders configured to receive the face portion 3562 for attachment of the face portion 3562 to the body portion 3510. In another example, as shown in FIGS. 35-40, the back surface 3566 may include a perimeter portion 3567 that may be attached to a perimeter edge portion 3561 of the body portion 3510. The perimeter portion 3567 of the face portion 3562 may be attached to the perimeter edge portion 3561 of the body portion 3510 by one or more fasteners, one or more adhesive or bonding agents, and/or welding or soldering. In one example, as shown in FIGS. 35-40, the perimeter portion 3567 of the face portion 3562 may be welded to the perimeter edge portion 3561 of the body portion 3510 at one or more locations. Alternatively, the entire perimeter portion 3567 of the face portion 3562 may be welded to the entire perimeter edge portion 3561 of the body portion 3510 (i.e., a continuous weld). The face portion 3562 may include a ball strike region 3568 to strike a golf ball. In one example, the center of the ball strike region 3568 may be a geometric center 3563 of the face portion 3562, which may provide a generally optimum location (i.e., optimum ball distance, ball speed, ball spin characteristics, etc.) on the face portion 3562 for striking a golf ball. In another example, the geometric center 3563 of the face portion 3562 may be offset from a center of the ball strike region 3568. However, a ball may be struck with any portion of the face portion 3562 outside the ball strike region 3568 for any of the golf club heads described herein resulting in certain ball flight characteristics different from an on-center hit. The configuration of the face portion 3562 and the attachment of the face portion 3562 (e.g., welding) to the body portion 3510 may be similar in many respects to any of the golf club heads described herein and/or described in any of the incorporated by reference applications. The apparatus, methods, and articles of manufacture described herein are not limited in this regard.

In one example, the area of the front surface 3564 of the face portion 3562 may be greater than or equal to 200 $mm^2$ and less than or equal to 5000 $mm^2$. In another example, the area of the front surface 3564 of the face portion 3562 may be greater than or equal to 1000 $mm^2$ and less than or equal to 4000 $mm^2$. In yet another example, the area of the front surface 3564 of the face portion 3562 may be greater than or equal to 1500 $mm^2$ and less than or equal to 3500 $mm^2$. While the above examples may describe particular areas, the area of the front surface 3564 may greater than or less than those numbers. The apparatus, methods, and articles of manufacture described herein are not limited in this regard.

The golf club head 3500 may be associated with a ground plane 3810, a horizontal midplane 3820, and a top plane 3830. In particular, the ground plane 3810 may be a plane that is parallel or substantially parallel to the ground and is tangent to the lowest portion of the sole portion edge 3592 when the golf club head 3500 is at an address position (e.g., the golf club head 3500 aligned to strike a golf ball). A top plane 3830 may be a plane that is tangent to the upper most portion of top portion edge 3582 when the golf club head 3500 is at the address position. The ground and top planes 3810 and 3830, respectively, may be parallel or substantially parallel to each other. The horizontal midplane 3820 may be vertically halfway between the ground and top planes 3810 and 3830, respectively. Further, the golf club head 3500 may be associated with a loft plane 3840 defining a loft angle 3845 (*a*) of the golf club head 3500. The loft plane 3840 may be a plane that is tangent to the face portion 3562. The loft angle 3845 may be defined by an angle between the loft plane 3840 and a vertical plane 3850 normal to the ground plane 3810.

The body portion 3510 may be a hollow body including an interior cavity 3610 having inner walls 3612. The interior cavity 3610 may extend between the front portion 3560, the back portion 3570, the top portion 3580, and the sole portion 3590. In the example of FIGS. 35-40, the interior cavity 3610 of the body portion 3510 may be enclosed with and partially defined with the face portion 3562. The configuration of the interior cavity 3610 (e.g., height, width, volume, shape, etc.), the configuration of the interior cavity 3610 relative to the body portion 3510 (e.g., volume of the interior cavity 3610 relative to the volume of body portion 3510), the width and height variation of the interior cavity 3610, and access to the interior cavity 3610 from one or more ports on the body portion 3510 may be similar to any of the golf club heads described herein and/or described in any of the incorporated by reference applications. The apparatus, methods, and articles of manufacture described herein are not limited in this regard.

The back wall portion 3572 of the back portion 3570 may include an upper back wall portion 3912 and a lower back wall portion 3914. The back wall portion 3572 may include a ledge portion 3916 that may extend between the toe portion edge 3542 and the heel portion edge 3552 in a continuous or discontinuous manner. The lower back wall portion 3914 may be located farther back on the body portion 3510 than the upper back wall portion 3912, with the ledge portion 3916 defining a transition portion between the upper back wall portion 3912 and the lower back wall portion 3914. Accordingly, the ledge portion 3916 may extend transverse to the upper back wall portion 3912 and the lower back wall portion 3914. In one example, as shown in FIGS. 35-40, the ledge portion 3916 may include a first ledge portion 3926 and a second ledge portion 3936. The first ledge portion 3926 may extend on the back wall portion from the toe portion edge 3542 to a back wall center portion 3940 of the back wall portion 3572. The second ledge portion 3936 may extend from the center portion 3940 of the back wall portion 3572 to the heel portion edge 3552. As shown in FIGS. 35-40, the ledge portion 3916 may provide for a relatively greater mass below the horizontal midplane 3820 and the mass of the body portion 3510 below the horizontal midplane 3820 to be moved farther back on the body portion 3510. The width of the ledge portion 3916 may be greater than, equal to, or less than the width of the interior cavity at certain locations of the body portion 3510. The configuration of the ledge portion 3916 (e.g., width, segments, tapering, shape, etc.) and the properties of the ledge portion 3916 relative to the width of the interior cavity may be similar to any ledge portion or similar structure of any of the golf club heads described herein and/or described in any of the incorporated by reference applications. The apparatus, methods, and articles of manufacture described herein are not limited in this regard.

The body portion 3510 may include one or more ports, which may be exterior ports and/or interior ports (e.g., located inside the body portion 3510). The inner walls 3612 of the interior cavity 3610 may include one or more ports (not shown). In one example, as shown in FIGS. 35-40, the back portion 3570 may include one or more ports along or proximate to a periphery of the body portion 3510. For example, the body portion 3510 may include a first set of ports 3620 (e.g., shown as ports 3621 and 3622), a second set of ports 3630 (e.g., shown as ports 3631 and 3632), a third set of ports 3640 (e.g., shown as ports 3641, 3642, and 3643), and a fourth set of ports 3650 (e.g., shown as ports 3651 and 3652). The locations, spacing relative to other ports, and any other configuration of each port of the first set of ports 3620, the second set of ports 3630, the third set of ports 3640, and/or the fourth set of ports 3650 may be similar in many respects to any of the ports described in any of the incorporated by reference applications. Further, any one or more of the ports of the first set of ports 3620, the second set of ports 3630, the third set of ports 3640, and/or the fourth set of ports 3650 may be connected to interior cavity 3610 through which one or more filler materials may be injected into the interior cavity 3610. In the example of FIGS. 35-40, the ports 3621, 3631, and 3651 may be connected to the interior cavity 3610 via openings 3661, 3671, and 3681, respectively. The apparatus, methods, and articles of manufacture described herein are not limited in this regard.

Each port of the first set of ports 3620 may be separated by a distance less than the port diameter of any of the ports of the first set of ports 3620. Each port of the second set of ports 3630 may be separated by a distance less than the port diameter of any of the ports of the second set of ports 3630. Each port of the third set of ports third set of ports 3640 may be separated by a distance less than the port diameter of any of the ports of the third set of ports 3640. Each port of the fourth set of ports 3650 may be separated by a distance less than the port diameter of any of the ports of the third set of ports 3650. In one example, the first set of ports 3620 and the second set of ports 3630 may be spaced apart by a distance greater than the port diameter of any of the ports of the first set of ports 3620 and the second set of ports 3630. In another example, the second set of ports 3630 and the third set of ports 3640 may be spaced apart by a distance greater than the port diameter of any of the ports of the second set of ports 3630 and the third set of ports 3640. In yet another example, the third set of ports 3640 and the fourth set of ports 3645 may be spaced apart by a distance greater than the port diameter of any of the ports of the third set of ports 3640 and the fourth set of ports 3650. The apparatus, methods, and articles of manufacture described herein are not limited in this regard.

Although the figures may depict the ports as separate and individual parts, each set or a combination of adjacent sets of ports of the first, second, third, and fourth sets of ports 3620, 3630, 3640, and 3650, respectively, may be a single port. In one example, all ports of the first set of ports 3620 may be combined into a single port (e.g., a first port). In another example, all ports of the second set of ports 3630 may be combined into a single port (e.g., a second port). In another example, all ports of the third set of ports 3640 may be combined into a single port (e.g., a third port). In yet another example, all ports of the fourth set of ports 3650 may be combined into a single port (e.g., a fourth port). While the figures may depict a particular number of ports, the apparatus, methods, and articles of manufacture described herein may include more or a smaller number of ports.

The body portion 3510 may include one or more mass portions (e.g., weight portion(s)), which may be integral mass portion(s) or separate mass portion(s) that may be coupled to the body portion 3510. In the illustrated example as shown in FIGS. 35-40, the body portion 3510 may include a first set of mass portions 3720 (e.g., shown as mass portions 3721 and 3722), a second set of mass portions 3730 (e.g., shown as mass portions 3731 and 3732), a third set of mass portions 3740 (e.g., shown as mass portions 3741, 3742, and 3743), and a fourth set of mass portions 3750 (e.g., shown as mass portions 3751 and 3752). While the above example may describe a particular number or portions of mass portions, a set of mass portions may include a single mass portion or a plurality of mass portions as described in any of the incorporated by reference applications. For example, any one or a combination of adjacent sets of mass portions of the first set of mass portions 3720 may be a single mass portion, the second set of mass portions 3730 may be a single mass portion, the third set of mass portions 3740 may be a single mass portion, and/or the fourth set of mass portions 3750 may be a single mass portion. Further, the first set of mass portions 3720, the second set of mass portions 3730, the third set of mass portions 3740, and/or the fourth set of mass portions 3750 may be a portion of the physical structure of the body portion 3510. The mass portions of the first set of mass portions 3720, the second set of mass portions 3730, the third set of mass portions 3740, and/or the fourth set of mass portions 3750 may be similar to any of the mass portions described in any of the incorporated by reference applications. The apparatus, methods, and articles of manufacture described herein are not limited in this regard.

The interior cavity 3610 may be partially or entirely filled with one or more filler materials (i.e., a cavity filling material), which may include one or more similar or different types of materials. In one example, as shown in FIGS. 35-40, the interior cavity 3610 may be filled with a first filler material 3812 and a second filler material 3814. The first filler material 3812 and the second filler material 3814 may be similar to the first filler material 412 and the second filler material 414, respectively, or similar to any of the filler materials described herein or described in any of the incorporated by reference applications. The apparatus, methods, and articles of manufacture described herein are not limited in this regard.

The first filler material 3812 may be coupled to all or portions of the inner walls 3612 of the interior cavity 3610. In one example, the first filler material 3812 may have inherent adhesive or bonding properties to attach to all or portions of the inner walls 3612. In another example, the first filler material 3812 may be attached to all or portions of the inner walls 3612 with one or more bonding agents or adhesives that may be mixed with the first filler material 3812. In another example, the first filler material 3812 may be attached to all or portions of the inner walls 3612 with one or more bonding agents or adhesives that may be separate from the first filler material 3812. The apparatus, methods, and articles of manufacture described herein are not limited in this regard.

In one example, as shown in FIGS. 35-40, the first filler material 3812 may be coupled to at least a portion of the inner walls 3612 that may generally correspond to the ball strike region 3568 of the face portion 3562 (i.e., the first filler material 3812 may be generally located behind the ball strike region 3568) or regions proximate to and/or surrounding the ball strike region 3568 of the face portion 3562. In another example, the first filler material 3812 may be coupled to at least 10% of the inner walls 3612. In another example, the first filler material 3812 may be coupled to at least 25% of the inner walls 3612. In yet another example, the first filler material 3812 may be coupled to between 25% and 50% of the inner walls 3612. In another example, the first filler material 3812 may be coupled to between 35% and 75% of the inner walls 3612. In yet another example, the first filler material 3812 may be coupled to between 50% and 90% of the inner walls 3612. In yet another example, the first filler material 3812 may be coupled to more than 75% of the inner walls 3612. In yet another example, the first filler material 3812 may be coupled to all of inner walls 3612. The apparatus, methods, and articles of manufacture described herein are not limited in this regard.

The amount of the first filler material 3812 that may be coupled to the inner walls 3612 may depend on the loft angle of the golf club head, the overall thickness of the face portion 3562, the thickness profile of the face portion 3562, the shape of the interior cavity 3610, the locations and configurations of any ports or mass portions, the material properties of the first filler material 3812, and/or the material properties of the second filler material 3814. In one example, a golf club head with a relatively high loft angle may limit the portions of the inner walls 3612 to which the first filler material 3812 may be coupled. In another example, a golf club head with a relatively small loft angle may allow the first filler material 3812 to be coupled to all or substantial portions of the inner walls 3612. In yet another example, the acoustic properties of a golf club head may be a factor in determining the amount of filler material 3812 that may be coupled to the inner walls 3612 to provide a pleasing sound and feel to an individual. The amount (i.e., volume and/or mass) of the first filler material 3812 coupled to the inner walls 3612 may be determined for each golf club head (i.e., having a certain loft angle) to (i) provide vibration dampening or sound dampening (e.g., consistent and/or pleasing sound and feel when the golf club head 3500 strikes a golf ball as perceived by an individual using the golf club head 3500), (ii) provide structural support for the face portion 3562, and/or (iii) optimize ball travel distance, ball speed, ball launch angle, ball spin rate, ball peak height, ball landing angle and/or ball dispersion. The apparatus, methods, and articles of manufacture described herein are not limited in this regard.

In the example of FIGS. 35-40, a central portion 3611 of the interior cavity 3610, which may be a portion of the interior cavity 3610 that may generally correspond to the ball strike region 3568, may be include the first filler material 3812 and the second filler material 3814. The width 3613 of the interior cavity 3610 at the central portion 3611 of the interior cavity 3610 may be generally greater than the width 3613 of the interior cavity 3610 at other portions of the interior cavity 3610. Accordingly, the region of the interior cavity 3610 behind the ball strike region 3568, i.e., the central portion 3611, may include a relatively large volume of the first filler material 3812 and/or the second filler material 3814. Further, the configuration of the central portion 3611 (i.e., size, shape, contour, volume, etc.) may depend on the loft angle 3845. For example, a golf club head 3500 with a relatively small loft angle 3845 may have a larger central portion 3611 (i.e., larger volume, depth, height, etc.) than a golf club head 3500 with a relatively large loft angle 3845. Accordingly, as described herein, the amount of first filler material 3812 and/or the second filler material 3814 inside the interior cavity 3610, and more specifically, in the central portion 3611 may be determined based on the loft angle 3845 to provide (i) provide vibration dampening or sound dampening (e.g., consistent and/or pleasing sound and feel when the golf club head 3500 strikes a golf ball as perceived by an individual using the golf club head 3500), (ii) provide structural support for the face portion 3562, and/or (iii) optimize ball travel distance, ball speed, ball launch angle, ball spin rate, ball peak height, ball landing angle and/or ball dispersion. The apparatus, methods, and articles of manufacture described herein are not limited in this regard.

The contour of the interior cavity 3610 or the shape of the inner walls 3612 may be defined by a plurality of recessed portions that are recessed relative to the perimeter edge portion 3561. In the example of FIGS. 35-40, the interior cavity 3610 may include a first recessed portion 3614, a second recessed portion 3615 that may have a generally smaller depth (i.e., interior cavity width 3613 as viewed in cross section in FIGS. 38-40) relative to the first recessed portion 3614, a third recessed portion 3616 that may have a generally smaller depth than the second recessed portion 3615, a fourth recessed portion 3617 that may have a generally smaller depth than the third recessed portion 3616, and a fifth recessed portion 3618 that may have a generally smaller depth than the fourth recessed portion 3617. The interior cavity 3610 may have more or less recessed portions. The apparatus, methods, and articles of manufacture described herein are not limited in this regard.

The first recessed portion 3614 may generally include the largest width 3613 of the interior cavity 3610 and may be located at the central portion 3611 and/or may include portions that are adjacent to or surround the central portion 3611. The second recessed portion 3615 may be adjacent to all or portions of the first recessed portion 3614, and may include portions that may be in the central portion 3611. In the example of FIGS. 35-40, the second recessed portion 3615 is located below the first recessed portion 3614. A portion of the structure of the body portion 3510 that includes the third set of ports 3640 may be between the second recessed portion 3615 and the lower back wall portion 3914. Accordingly, the depth of the second recessed portion 3615 may be less than the depth of the first recessed portion 3614 so that the body portion 3510 can accommodate the third set of ports 3640 between the second recessed portion 3615 and the lower back wall portion 3914. The apparatus, methods, and articles of manufacture described herein are not limited in this regard.

The third recessed portion 3616 may be adjacent to and/or surround all or portions of the second recessed portion 3615 and/or the first recessed portion 3614, and may include portions that may be in the central portion 3611. In the example of FIGS. 35-40, the third recessed portion 3616 surrounds the first recessed portion 3614 above the horizontal midplane 3820. The fourth recessed portion 3617 may be at or proximate to the perimeter edge portion 3561, and/or may be adjacent to and/or surround all or portions of the third recessed portion 3616, the second recessed portion 3615, and/or the first recessed portion 3614. In the example of FIGS. 35-40, the fourth recessed portion 3617 is adjacent to portions of the first recessed portion 3614 and the second recessed portion 3615 below the horizontal midplane 3820. A portion of the structure of the body portion 3510 that includes the second set of ports 3630 and the fourth set of ports 3650 may be between the fourth recessed portion 3617 and the lower back wall portion 3914. Accordingly, the depth of the fourth recessed portion 3617 may be less than the depths of the first recessed portion 3614 and the second recessed portion 3615 so that the body portion 3510 can accommodate the second set of ports 3630 and the fourth set of ports 3650 between the fourth recessed portion 3617 and the lower back wall portion 3914. The apparatus, methods, and articles of manufacture described herein are not limited in this regard.

The fifth recessed portion 3618 may be adjacent to the perimeter edge portion 3561. Accordingly, at any location in the interior cavity 3610 that includes the fifth recessed portion 3618, the fifth recessed portion 3618 may be between the perimeter edge portion 3561 and any one or more of the first recessed portion 3614, the second recessed portion 3615, the third recessed portion 3616, and the fourth recessed portion 3617. A portion of the structure of the body portion 3510 that includes the first set of ports 3620 may be between the fifth recessed portion 3618 and the upper back wall portion 3912. Accordingly, the depth of the fifth recessed portion 3618 may be less than the depth of the adjacent portions of the third recessed portion 3616 so that the body portion 3510 can accommodate the first set of ports 3620 between the fifth recessed portion 3618 and the upper back wall portion 3912. The apparatus, methods, and articles of manufacture described herein are not limited in this regard.

The interior cavity 3610 may include one or more internal channels that may extend between the toe portion 3540 and the heel portion 3550. In one example, as shown in FIGS. 35-40, the interior cavity 3610 may include a first internal channel 3625 that may extend from a location at the toe portion 3540 to the central portion 3611, and a second internal channel 3626 that may extend from a location at the heel portion 3550 to the central portion 3611. The first internal channel 3625 and the second internal channel 3626 connect to the first recessed portion 3614 and may have the same depth as the first recessed portion 3614 at or proximate to the central portion 3611. The depths of the first internal channel 3625 and the second internal channel 3626 may diminish from the first recessed portion 3614 toward the toe portion 3540 and heel portion 3550, respectively. As shown in the example of FIGS. 35-40, portions of the first internal channel 3625 and/or the second internal channel 3626 that connect to the first recessed portion 3614 and/or are proximate to the first recessed portion 3614 may maintain a constant depth that may be similar to the depth of the first recessed portion 3614. Accordingly, the first internal channel 3625 and the second internal channel 3626 provide a greater volume of the first filler material 3812 and/or the second filler material 3814 between the central portion 3611 and the toe portion 3540 and the heel portion. Alternatively, all or portions of the first internal channel 3625 and/or the second internal channel 3626 may have diminishing depths in a direction toward the toe portion 3540 and the heel portion 3550, respectively. For off-center hits of a golf ball with the face portion 3562, the increased volume of the first filler material 3812 and/or the second filler material 3814 in the internal channels 3625 and 3626 may (i) provide vibration dampening or sound dampening, (ii) provide structural support for the face portion 3562, and/or (iii) optimize ball travel distance, ball speed, ball launch angle, ball spin rate, ball peak height, ball landing angle and/or ball dispersion. Further, the mass that is removed from the body portion 3510 to provide the internal channels 3625 and 3626 may be shifted to other locations on the body portion 3510 to increase and/or optimize the moment of inertia and the location of the center of gravity of the golf club head 3500. The apparatus, methods, and articles of manufacture described herein are not limited in this regard.

Figure 37:
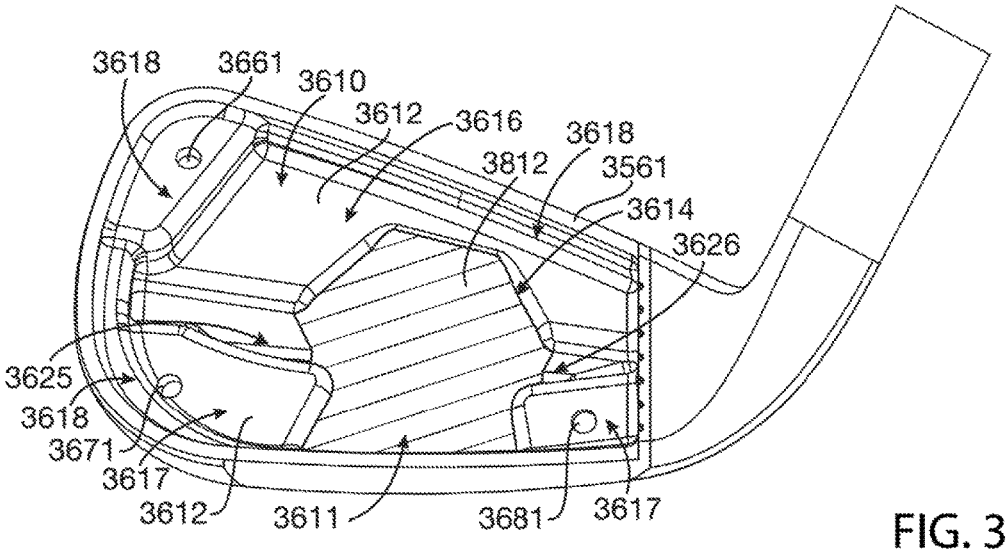
FIG. 37 depicts a front perspective view of the golf club head of FIG. 35 shown without a face portion.
Figure 38:
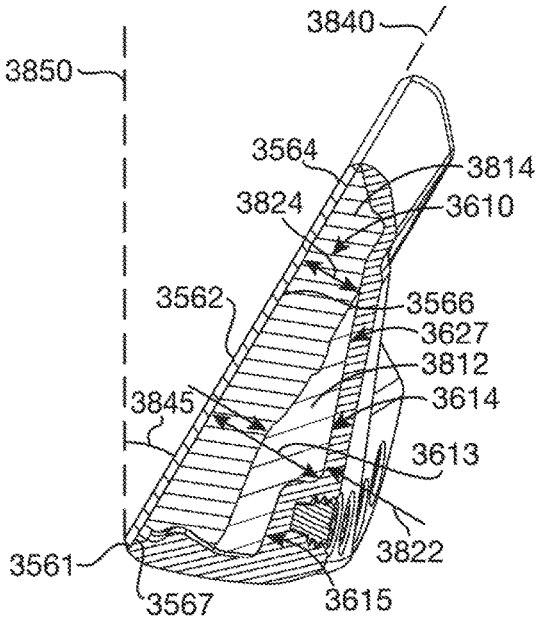
FIG. 38 depicts a perspective cross-sectional view of the golf club head of FIG. 35 taken at line 35-35 of FIG. 36.
Figure 39:
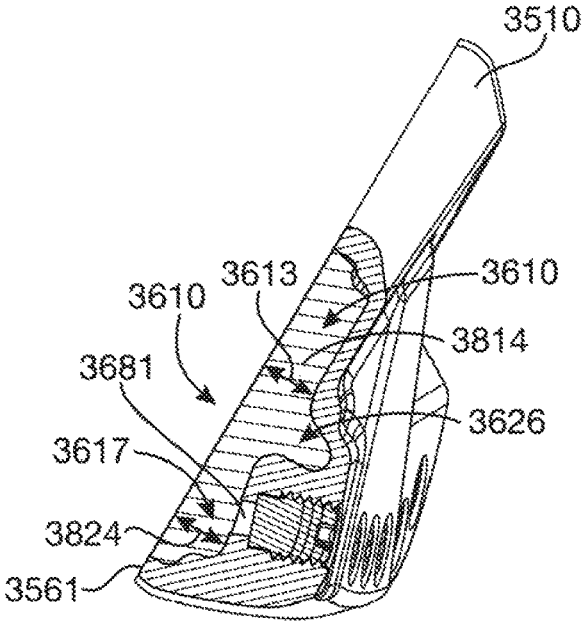
FIG. 39 depicts a perspective cross-sectional view of the golf club head of FIG. 35 taken at line 39-39 of FIG. 36.
Figure 40:
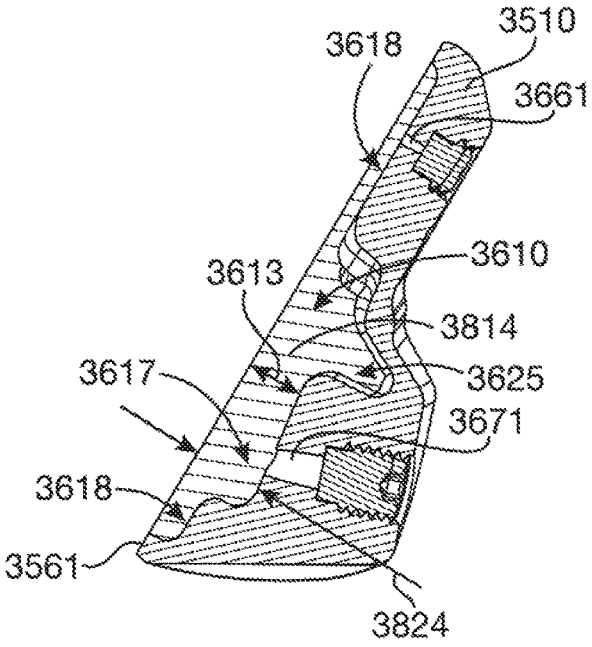
FIG. 40 depicts a perspective cross-sectional view of the golf club head of FIG. 35 taken at line 40-40 of FIG. 36.
Figure 41:
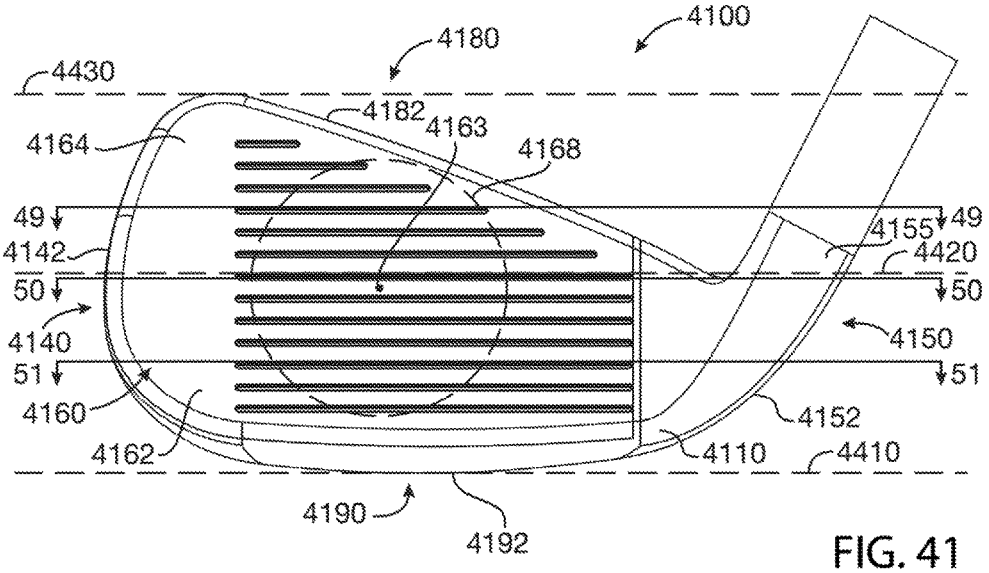
FIG. 41 depicts a perspective front view of a golf club head according to an embodiment of the apparatus, methods, and articles of manufacture described herein.
Figure 42:
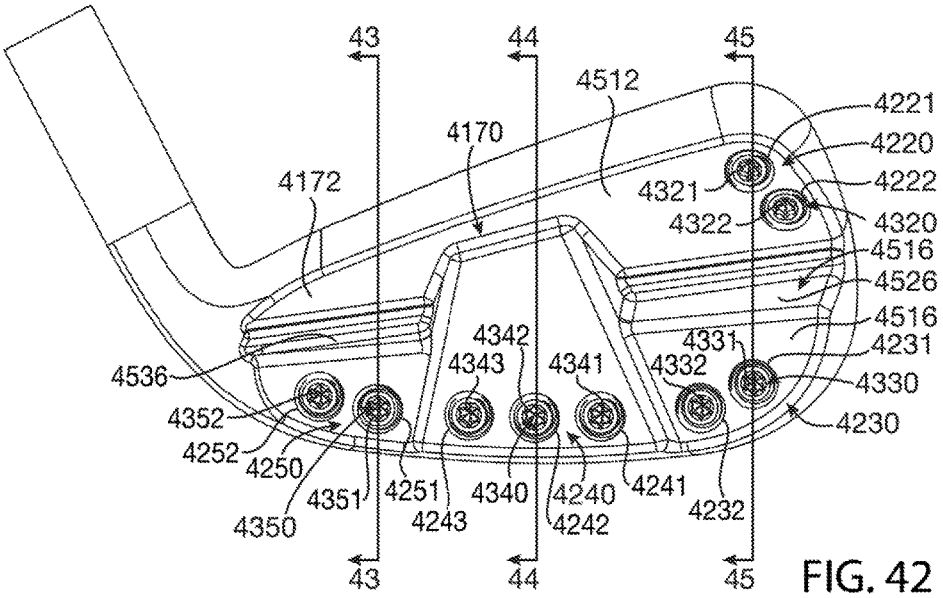
FIG. 42 depicts a perspective back view of the golf club head of FIG. 41.

The interior cavity 3610 may include additional recessed portions that may define transition regions between the first to fifth recessed portions 3614-3618 and the internal channels 3625 and 3626. Each of the recessed portions may be adjacent to and transition into any one or several of the other recessed portions. For example, as shown in FIGS. 37-38, the first recessed portion 3614 may include an inclined surface 3627 that may transition and connect to the third recessed portion 3616 above the first recessed portion 3614. Further, any of the recessed portions may directly transition to the perimeter edge portion 3561. The recessed portions and the transition regions may collectively define the overall shape and/or contour of the interior cavity 3610. The transition regions may include walls that are perpendicular, transverse, or include relative to adjacent recessed portions. Further, the transition regions may include rounded corners when joining an adjacent recessed portion to reduce stress concentrations at the joined corner. The recessed portions may define a contoured, continuous, and/or stepped reduction of the width of the interior cavity 3610 form the central portion 3611 to the perimeter edge portion 3561. The apparatus, methods, and articles of manufacture described herein are not limited in this regard.

The shape, size, width, height, and other characteristics of the recessed portions 3614-3618 and the internal channels 3625 and 3626 may be associated with the loft angle 3845 of the golf club head 3500. In one example, as shown in FIGS. 35-40, the first recessed portion 3614 and the second recessed portion 3615 may be filled with the first filler material 3812. The first filler material 3812 may be injection molded in the first recessed portion 3614 and the second recessed portion 3615. The filler material 3812 may be bonded to the inner walls 3612 of the first recessed portion 3614 and the second recessed portion 3615 by having inherent adhesive or bonding properties, with a bonding agent that is mixed with the first filler material 3812, and/or a separate bonding agent. In another example, the first filler material 3812 may be separately molded in the shape of the first recessed portion 3614 and the second recessed portion 3615 and coupled to the first recessed portion 3614 and the second recessed portion 3615 with a bonding agent. In one example, the remaining portions of the interior cavity 3610, which include the third recessed portion 3616, the fourth recessed portion 3617, and the fifth recessed portion 3618 may be filled with the second filler material 3814. Accordingly, the second filler material 3814 may be coupled to the back surface 3566 of the face portion 3562, coupled to portions of the inner walls 3612 outside the first recessed portion 3614 and the second recessed portion 3615, and/or disposed between the face portion 3562 and the first filler material 3812. The apparatus, methods, and articles of manufacture described herein are not limited in this regard.

A width 3822 ($W_{F1}$) of the first filler material 3812 and the width 3824 ($W_{F2}$) of the second filler material 3814 may vary from the toe portion 3540 to the heel portion 3550 and/or from the top portion 3580 to the sole portion 3590 and/or according to the shapes of the first recessed portion 3614, the second recessed portion 3615, the third recessed portion 3616, the fourth recessed portion 3617, and/or the fifth recessed portion 3618 depending on the location inside the interior cavity 3610. The width 3822 of the first filler material 3812 may vary according to the shapes of the first recessed portion 3614 and the second recessed portion 3615. The width 3822 of the first filler material 3812 and/or the width 3824 of the second filler material 3814 may be constant or substantially constant at one or more locations in the interior cavity 3610 and vary at certain other locations in the interior cavity 3610. In one example, the width 3822 of the first filler material 3812 and/or the width 3824 of the second filler material 3814 may vary at one or more locations in the interior cavity 3610 similar or substantially similar to the contour of all or portions of the inner walls 3612 of the interior cavity 3610 (i.e., the contours of the recessed portions) and/or the contours of the boundaries between the first filler material 3812 and the second filler material 3814. In one example, the second filler material 3814 may (i) provide vibration dampening or sound dampening (e.g., consistent and/or pleasing sound and feel when the golf club head 3500 strikes a golf ball as perceived by an individual using the golf club head 3500), (ii) provide structural support for the face portion 3562, and/or (iii) optimize ball travel distance, ball speed, ball launch angle, ball spin rate, ball peak height, ball landing angle and/or ball dispersion. The width 3822 of the first filler material 3812 and width 3824 of the second filler material 3814 may be determined at the ball strike region 3568 and/or other regions of the interior cavity 3610 so that a relatively high or optimum coefficient of restitution (COR) is provided for the golf club head 3500. The apparatus, methods, and articles of manufacture described herein are not limited in this regard.

The first filler material 3812 may include a polymer material having a relatively high coefficient of restitution (COR). The COR of the first filler material 3812 may be determined by shooting a golf ball sized sample of the first filler material 3812 from an air cannon toward a steel plate. Two light screens at known positions between the cannon and the plate may be used to measure the approach velocity and rebound velocities of the sample. The COR of the sample may then be calculated as the rebound velocity divided by the approach velocity. In one example, the first filler material 3812 may have a COR of greater than or equal to 0.7 at an approach velocity of 125 ft/s (38.1 m/s). In another example, the first filler material 3812 may have a COR of greater than or equal to 0.75 at an approach velocity of 125 ft/s (38.1 m/s). In yet another example, the first filler material 3812 may have a COR of greater than or equal to 0.7 and less than or equal to 0.9 at an approach velocity of 125 ft/s (38.1 m/s). The apparatus, methods, and articles of manufacture described herein are not limited in this regard.

The compression of the golf ball sized sample may be related to the COR of the golf ball sized sample. Compression is a measurement of how much the golf ball sized sample deforms (compresses) under load. A relatively lower compression rating indicates a softer filler material, whereas a relatively higher compression rating indicates a firmer filler material. Compression may be measured by using an ATTI compression gauge, manufactured by ATTI Engineering, Union City, N.J. In one example, the COR of the first filler material 3812 may be greater than or equal to 0.75 at a compression of greater than or equal to 22. In another example, the COR of the first filler material 3812 may be greater than or equal to 0.78 at a compression of greater than or equal to 2 and less than or equal to 0.8 at a compression of less than or equal to 80. In yet another example, the COR of the first filler material 3812 may be greater than or equal to 0.78 at a compression of greater than or equal to 32 and less than or equal to 0.9 at a compression of less than or equal to 90. The apparatus, methods, and articles of manufacture described herein are not limited in this regard.

In one example, the first filler material 3812 may be a polymer material having a density of greater than or equal to 1.1 g/cm$^3$ and less than or equal to 1.3 g/cm$^3$. In another example, the first filler material 3812 may be a polymer material having a density of greater than or equal to 1.15 g/cm$^3$ and less than or equal to 1.25 g/cm$^3$. In yet another example, the first filler material 3812 may be a polymer material having a density of greater than or equal to 1.1 g/cm$^3$ and less than or equal to 1.2 g/cm$^3$. The apparatus, methods, and articles of manufacture described herein are not limited in this regard.

In one example, the first filler material 3812 may be a polymer material including rubber or a rubber compound that may provide the COR and compression ranges described herein. In one example, the first filler material 3812 may include rubber and at least another compound that may provide increased softness or firmness to the first filler material 3812 to maximize the COR of the first filler material 3812 while maintaining compression values within a certain range as described herein. In one example, the first filler material 3812 may include rubber and Zinc Diacrylate (ZDA), which may increase the compression value of the first filler material 3812 and hence the COR of the first filler material 3812. The amount of Zinc Diacrylate (ZDA) in the first filler material 3812 may be varied to achieve certain COR and/or compression values as described herein. The apparatus, methods, and articles of manufacture described herein are not limited in this regard.

The adhesive for bonding the first filler material 3812 to the back surface 3566 of the face portion 3562 may be any type of adhesive that can bond the first filler material 3812 to the material of the face portion 3562. In one example, the first filler material 3812 may be a rubber or a rubber compound and the face portion 3562 may be constructed from a steel-based material such as stainless steel. Accordingly, the adhesive for bonding the first filler material 3812 to the back surface 3566 of the face portion 3562 may be a type of adhesive used to bond steel-based materials to rubber or rubber compounds. In another example, the first filler material 3812 may be a rubber or a rubber compound and the face portion 3562 may be constructed from titanium or a titanium alloy. Accordingly, the adhesive for bonding the first filler material 3812 to the back surface 3566 of the face portion 3562 may be a type of adhesive used to bond titanium-based materials to rubber or rubber compounds. The bonding of the first filler material 3812 to any portion of the body portion 3510, the face portion 3562, and/or the second filler material 3814, and the bonding of the second filler material 3814 to the body portion 3510, the face portion 3562, and/or the first filler material 3812 may be similar to any of the bonding properties and procedures described in any of the incorporated by reference applications. The apparatus, methods, and articles of manufacture described herein are not limited in this regard.

In one example (not shown), the interior cavity 3610 may be entirely filled with the first filler material 3812. In another example, as shown in FIGS. 35-40, the interior cavity 3610 may be partially filled with the first filler material 3812. Accordingly, the remaining portions of the first interior cavity 3610 may be filled with a second filler material 3814. As described herein, the second filler material 3814 may provide or assist (e.g., alone or in conjunction with one or more adhesives) in the coupling of the first filler material 3812 with the face portion 3562. In other words, the second filler material 3814 may assist in maintaining or maintain the first filler material 3812 coupled to the back surface 3566 of the face portion 3562. The apparatus, methods, and articles of manufacture described herein are not limited in this regard.

The second filler material 3814 may have one or more different properties than the first filler material 3812 such as density, compression, hardness (i.e., durometer), tensile strength, shear strength, viscosity, elasticity, etc., to optimize energy transfer from the face portion 3562 to a golf ball. The second filler material may be a polymer material. In one example, the second filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, the second filler material 3814 may be one or more thermoset polymers having bonding properties (e.g., one or more adhesive or epoxy materials). The second filler material 3814 may also absorb shock, isolate vibration, and/or dampen noise when the golf club head 400 strikes a golf ball. Further, the second filler material 3814 may be an epoxy material that may be flexible or slightly flexible when cured. In another example, the second filler material 3814 may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, the filler material may include 3M™ Scotch-Weld™ DP100 Plus Clear adhesive. In another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, the filler material may be LOCTITE® materials manufactured by Henkel Corporation, Rocky Hill, Conn. The apparatus, methods, and articles of manufacture described herein are not limited in this regard.

In the example of FIGS. 41-52, a golf club head 4100 may include a body portion 4110 having a toe portion 4140 with a toe portion edge 4142, a heel portion 4150 with a heel portion edge 4152 that may include a hosel portion 4155 configured to receive a shaft (not shown) with a grip (not shown) on one end and the golf club head 4100 on the opposite end of the shaft to form a golf club, a front portion 4160 with a perimeter edge portion 4161, a back portion 4170 with a back wall portion 4172, a top portion 4180 with a top portion edge 4182, and a sole portion 4190 with a sole portion edge 4192. The toe portion 4140, the heel portion 4150, the front portion 4160, the back portion 4170, the top portion 4180, and/or the sole portion 4190 may partially overlap each other. The toe portion edge 4142, the heel portion edge 4152, the top portion edge 4182, and the sole portion edge 4192 may define a periphery of the body portion 4110. The apparatus, methods, and articles of manufacture described herein are not limited in this regard.

The golf club head 4100 may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees (°), 48°, 52°, 56°, 60°, etc.). Although FIGS. 41-52 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The volume of the golf club head 4100, the materials of construction of the golf club head 4100, and/or any components thereof may be similar to any of the golf club heads described herein and/or described in any of the incorporated by reference applications. The apparatus, methods, and articles of manufacture described herein are not limited in this regard.

The golf club head 4100 may include a face portion 4162 (i.e., the strike face), which may be integrally formed with the body portion 4110 (e.g., a single unitary piece). In one example, as shown in FIGS. 41-52, the face portion 4162 may be a separate piece coupled (e.g., adhesively, mechanically, by welding, and/or by soldering) to the front portion 4160. The face portion 4162 may include a front surface 4164 and a back surface 4166. In one example (not shown), the front portion 4160 may include one or a plurality of recessed shoulders configured to receive the face portion 4162 for attachment of the face portion 4162 to the body portion 4110. In another example, as shown in FIGS. 41-52, the back surface 4166 may include a perimeter portion 4167 that may be attached to a perimeter edge portion 4161 of the body portion 4110. The perimeter portion 4167 of the face portion 4162 may be attached to the perimeter edge portion 4161 of the body portion 4110 by one or more fasteners, one or more adhesive or bonding agents, and/or welding or soldering. In one example, as shown in FIGS. 41-52, the perimeter portion 4167 of the face portion 4162 may be welded to the perimeter edge portion 4161 of the body portion 4110 at one or more locations. Alternatively, the entire perimeter portion 4167 of the face portion 4162 may be welded to the entire perimeter edge portion 4161 of the body portion 4110 (i.e., a continuous weld). The face portion 4162 may include a ball strike region 4168 to strike a golf ball. In one example, the center of the ball strike region 4168 may be a geometric center 4163 of the face portion 4162, which may provide a generally optimum location (i.e., optimum ball distance, ball speed, ball spin characteristics, etc.) on the face portion 4162 for striking a golf ball. In another example, the geometric center 4163 of the face portion 4162 may be offset from a center of the ball strike region 4168. However, a ball may be struck with any portion of the face portion 4162 outside the ball strike region 4168 for any of the golf club heads described herein resulting in certain ball flight characteristics different from an on-center hit. The configuration of the face portion 4162 and the attachment of the face portion 4162 (e.g., welding) to the body portion 4110 may be similar in many respects to any of the golf club heads described herein and/or described in any of the incorporated by reference applications. The apparatus, methods, and articles of manufacture described herein are not limited in this regard.

In one example, the area of the front surface 4164 of the face portion 4162 may be greater than or equal to 200 $mm^2$ and less than or equal to 5000 $mm^2$. In another example, the area of the front surface 4164 of the face portion 4162 may be greater than or equal to 1000 $mm^2$ and less than or equal to 4000 $mm^2$. In yet another example, the area of the front surface 4164 of the face portion 4162 may be greater than or equal to 1500 $mm^2$ and less than or equal to 4100 $mm^2$. While the above examples may describe particular areas, the area of the front surface 4164 may greater than or less than those numbers. The apparatus, methods, and articles of manufacture described herein are not limited in this regard.

The golf club head 4100 may be associated with a ground plane 4410, a horizontal midplane 4420, and a top plane 4430. In particular, the ground plane 4410 may be a plane that is parallel or substantially parallel to the ground and is tangent to the lowest portion of the sole portion edge 4192 when the golf club head 4100 is at an address position (e.g., the golf club head 4100 aligned to strike a golf ball). A top plane 4430 may be a plane that is tangent to the upper most portion of top portion edge 4182 when the golf club head 4100 is at the address position. The ground and top planes 4410 and 4430, respectively, may be parallel or substantially parallel to each other. The horizontal midplane 4420 may be vertically halfway between the ground and top planes 4410 and 4430, respectively. Further, the golf club head 4100 may be associated with a loft plane 4440 defining a loft angle 4445 ($\alpha$) of the golf club head 4100. The loft plane 4440 may be a plane that is tangent to the face portion 4162. The loft angle 4445 may be defined by an angle between the loft plane 4440 and a vertical plane 4450 normal to the ground plane 4410.

The body portion 4110 may be a hollow body including an interior cavity 4210 having inner walls 4212. The interior cavity 4210 may extend between the front portion 4160, the back portion 4170, the top portion 4180, and the sole portion 4190. In the example of FIGS. 41-52, the interior cavity 4210 of the body portion 4110 may be enclosed with and partially defined with the face portion 4162. The configuration of the interior cavity 4210 (e.g., height, width, volume, shape, etc.), the configuration of the interior cavity 4210 relative to the body portion 4110 (e.g., volume of the interior cavity 4210 relative to the volume of body portion 4110), the width and height variation of the interior cavity 4210, and access to the interior cavity 4210 from one or more ports on the body portion 4110 may be similar to any of the golf club heads described herein and/or described in any of the incorporated by reference applications. The apparatus, methods, and articles of manufacture described herein are not limited in this regard.

The back wall portion 4172 of the back portion 4170 may include an upper back wall portion 4512 and a lower back wall portion 4514. The back wall portion 4172 may include a ledge portion 4516 that may extend between the toe portion edge 4142 and the heel portion edge 4152 in a continuous or discontinuous manner. The lower back wall portion 4514 may be located farther back on the body portion 4110 than the upper back wall portion 4512, with the ledge portion 4516 defining a transition portion between the upper back wall portion 4512 and the lower back wall portion 4514. Accordingly, the ledge portion 4516 may extend transverse to the upper back wall portion 4512 and the lower back wall portion 4514. In one example, as shown in FIG. 41-52, the ledge portion 4516 may include a first ledge portion 4526 and a second ledge portion 4536. The first ledge portion 4526 may extend on the back wall portion from the toe portion edge 4142 to a back wall center portion 4540 of the back wall portion 4172. The second ledge portion 4536 may extend from the center portion 4540 of the back wall portion 4172 to the heel portion edge 4152. As shown in FIGS. 41-52, the ledge portion 4516 may provide for a relatively greater mass of the body portion 4110 below the horizontal midplane 4420, and the mass of the body portion 4110 below the horizontal midplane 4420 to be moved farther back on the body portion 4110. The width of the ledge portion 4516 may be greater than, equal to, or less than the width of the interior cavity at certain locations of the body portion 4110. The configuration of the ledge portion 4516 (e.g., width, segments, tapering, shape, etc.) and the properties of the ledge portion 4516 relative to the width of the interior cavity may be similar to any ledge portion or similar structure of any of the golf club heads described herein and/or described in any of the incorporated by reference applications. The apparatus, methods, and articles of manufacture described herein are not limited in this regard.

The body portion 4110 may include one or more ports, which may be exterior ports and/or interior ports (e.g., located inside the body portion 4110). The inner walls 4212 of the interior cavity 4210 may include one or more ports (not shown). In one example, as shown in FIGS. 41-52, the back portion 4170 may include one or more ports along or proximate to the periphery of the body portion 4110. For example, the body portion 4110 may include a first set of ports 4220 (e.g., shown as ports 4221 and 4222), a second set of ports 4230 (e.g., shown as ports 4231 and 4232), a third set of ports 4240 (e.g., shown as ports 4241, 4242, and 4243), and a fourth set of ports 4250 (e.g., shown as ports 4251 and 4252). The locations, spacing relative to other ports, and any other configuration of each port of the first set of ports 4220, the second set of ports 4230, the third set of ports 4240, and/or the fourth set of ports 4250 may be similar in many respects to any of the ports described in any of the incorporated by reference applications. Further, any one or more of the ports of the first set of ports 4220, the second set of ports 4230, the third set of ports 4240, and/or the fourth set of ports 4250 may be connected to interior cavity 4210 through which one or more filler materials may be injected into the interior cavity 4210. In the example of FIGS. 41-52, the ports 4221, 4231, and 4251 may be connected to the interior cavity 4210 via openings 4261, 4271, and 4281, respectively. The apparatus, methods, and articles of manufacture described herein are not limited in this regard.

Each port of the first set of ports 4220 may be separated by a distance less than the port diameter of any of the ports of the first set of ports 4220. Each port of the second set of ports 4230 may be separated by a distance less than the port diameter of any of the ports of the second set of ports 4230. Each port of the third set of ports third set of ports 4240 may be separated by a distance less than the port diameter of any of the ports of the third set of ports 4240. Each port of the fourth set of ports 4250 may be separated by a distance less than the port diameter of any of the ports of the third set of ports 4250. In one example, the first set of ports 4220 and the second set of ports 4230 may be spaced apart by a distance greater than the port diameter of any of the ports of the first set of ports 4220 and the second set of ports 4230. In another example, the second set of ports 4230 and the third set of ports 4240 may be spaced apart by a distance greater than the port diameter of any of the ports of the second set of ports 4230 and the third set of ports 4240. In yet another example, the third set of ports 4240 and the fourth set of ports 4245 may be spaced apart by a distance greater than the port diameter of any of the ports of the third set of ports 4240 and the fourth set of ports 4250. The apparatus, methods, and articles of manufacture described herein are not limited in this regard.

Although the figures may depict the ports as separate and individual parts, each set or a combination of adjacent sets of ports of the first, second, third, and fourth sets of ports 4220, 4230, 4240, and 4250, respectively, may be a single port. In one example, all ports of the first set of ports 4220 may be combined into a single port (e.g., a first port). In another example, all ports of the second set of ports 4230 may be combined into a single port (e.g., a second port). In another example, all ports of the third set of ports 4240 may be combined into a single port (e.g., a third port). In yet another example, all ports of the fourth set of ports 4250 may be combined into a single port (e.g., a fourth port). While the figures may depict a particular number of ports, the apparatus, methods, and articles of manufacture described herein may include more or a smaller number of ports.

The body portion 4110 may include one or more mass portions (e.g., weight portion(s)), which may be integral mass portion(s) or separate mass portion(s) that may be coupled to the body portion 4110. In the illustrated example as shown in FIGS. 41-52, the body portion 4110 may include a first set of mass portions 4320 (e.g., shown as mass portions 4321 and 4322), a second set of mass portions 4330 (e.g., shown as mass portions 4331 and 4332), a third set of mass portions 4340 (e.g., shown as mass portions 4341, 4342, and 4343), and a fourth set of mass portions 4350 (e.g., shown as mass portions 4351 and 4352). While the above example may describe a particular number or portions of mass portions, a set of mass portions may include a single mass portion or a plurality of mass portions as described in any of the incorporated by reference applications. For example, any one or a combination of adjacent sets of mass portions of the first set of mass portions 4320 may be a single mass portion, the second set of mass portions 4330 may be a single mass portion, the third set of mass portions 4340 may be a single mass portion, and/or the fourth set of mass portions 4350 may be a single mass portion. Further, the first set of mass portions 4320, the second set of mass portions 4330, the third set of mass portions 4340, and/or the fourth set of mass portions 4350 may be a portion of the physical structure of the body portion 4110. The mass portions of the first set of mass portions 4320, the second set of mass portions 4330, the third set of mass portions 4340, and/or the fourth set of mass portions 4350 may be similar to any of the mass portions described in any of the incorporated by reference applications. The apparatus, methods, and articles of manufacture described herein are not limited in this regard.

The interior cavity 4210 may be partially or entirely filled with one or more filler materials (i.e., a cavity filling material), which may include one or more similar or different types of materials. In one example, as shown in FIGS. 41-52, the interior cavity 4210 may be filled with a first filler material 4412 and a second filler material 4414. The first filler material 4412 and the second filler material 4414 may be similar to the first filler material 412 and the second filler material 414, respectively, or similar to any of the filler materials described herein or described in any of the incorporated by reference applications. The apparatus, methods, and articles of manufacture described herein are not limited in this regard.

The first filler material 4412 may be coupled to all or portions of the inner walls 4212 of the interior cavity 4210. In one example, the first filler material 4412 may have inherent adhesive or bonding properties to attach to all or portions of the inner walls 4212. In another example, the first filler material 4412 may be attached to all or portions of the inner walls 4212 with one or more bonding agents or adhesives that may be mixed with the first filler material 4412. In another example, the first filler material 4412 may be attached to all or portions of the inner walls 4212 with one or more bonding agents or adhesives that may be separate from the first filler material 4412. The apparatus, methods, and articles of manufacture described herein are not limited in this regard.

Figure 43:
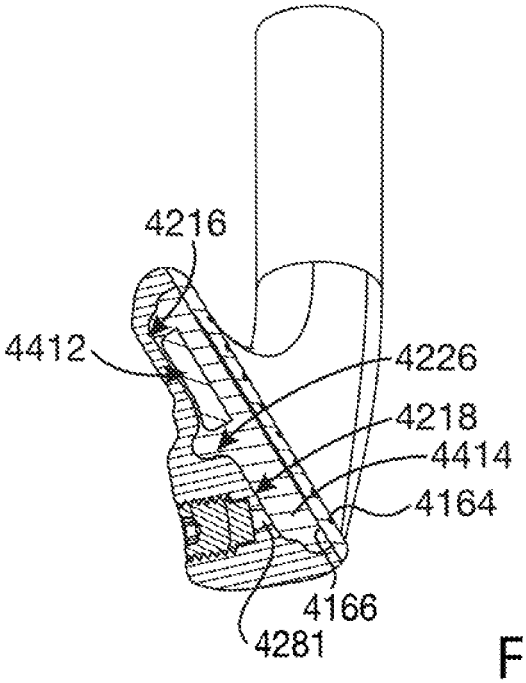
FIG. 43 depicts a perspective cross-sectional view of the golf club head of FIG. 41 taken at line 43-43 of FIG. 42.
Figure 44:
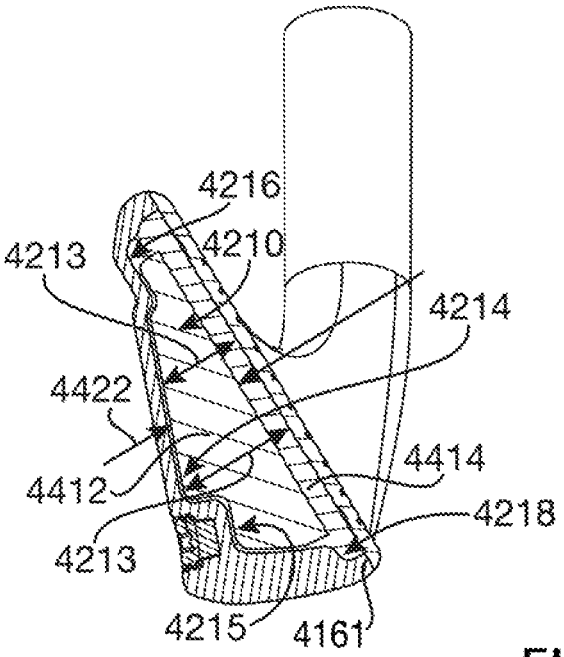
FIG. 44 depicts a perspective cross-sectional view of the golf club head of FIG. 41 taken at line 44-44 of FIG. 42.

In one example, as shown in FIGS. 43 and 44, the first filler material 4412 may be coupled to at least a portion of the inner walls 4212 that may generally correspond to the ball strike region 4168 of the face portion 4162 (i.e., the first filler material 4412 may be generally located behind the ball strike region 4168) or regions proximate to and/or surrounding the ball strike region 4168 of the face portion 4162. In another example, the first filler material 4412 may be coupled to at least 10% of the inner walls 4212. In another example, the first filler material 4412 may be coupled to at least 25% of the inner walls 4212. In yet another example, the first filler material 4412 may be coupled to between 25% and 50% of the inner walls 4212. In another example, the first filler material 4412 may be coupled to between 41% and 75% of the inner walls 4212. In yet another example, the first filler material 4412 may be coupled to between 50% and 90% of the inner walls 4212. In yet another example, the first filler material 4412 may be coupled to more than 75% of the inner walls 4212. In yet another example, the first filler material 4412 may be coupled to all of inner walls 4212. The apparatus, methods, and articles of manufacture described herein are not limited in this regard.

The amount of the first filler material 4412 that may be coupled to the inner walls 4212 may depend on the loft angle of the golf club head, the overall thickness of the face portion 4162, the thickness profile of the face portion 4162, the shape of the interior cavity 4210, the locations and configurations of any ports or mass portions, the material properties of the first filler material 4412, and/or the material properties of the second filler material 4414. In one example, a golf club head with a relatively high loft angle may limit the portions of the inner walls 4212 to which the first filler material 4412 may be coupled. In another example, a golf club head with a relatively small loft angle may allow the first filler material 4412 to be coupled to all or substantial portions of the inner walls 4212. In yet another example, the acoustic properties of a golf club head may be a factor in determining the amount of filler material 4412 that may be coupled to the inner walls 4212 to provide a pleasing sound and feel to an individual. The amount (i.e., volume and/or mass) of the first filler material 4412 coupled to the inner walls 4212 may be determined for each golf club head (i.e., having a certain loft angle) to (i) provide vibration dampening or sound dampening (e.g., consistent and/or pleasing sound and feel when the golf club head 4100 strikes a golf ball as perceived by an individual using the golf club head 4100), (ii) provide structural support for the face portion 4162, and/or (iii) optimize ball travel distance, ball speed, ball launch angle, ball spin rate, ball peak height, ball landing angle and/or ball dispersion. The apparatus, methods, and articles of manufacture described herein are not limited in this regard.

In the example of FIGS. 41-52, a portion of the interior cavity 4210 including a central portion 4211 of the interior cavity 4210, which may be a portion of the interior cavity 4210 that may generally correspond to the ball strike region 4168, may be include the first filler material 4412 and the second filler material 4414. The width 4213 of the interior cavity 4210 at the central portion 4211 of the interior cavity 4210 may be generally greater than the width 4213 of the interior cavity 4210 at other portions of the interior cavity 4210. Accordingly, the region of the interior cavity 4210 behind the ball strike region 4168, i.e., the central portion 4211, may include a relatively large volume of the first filler material 4412 and/or the second filler material 4414. Further, the configuration of the central portion 4211 (i.e., size, shape, contour, volume, etc.) may depend on the loft angle 4445. For example, a golf club head 4100 with a relatively small loft angle 4445 may have a larger central portion 4211 (i.e., larger volume, depth, height, etc.) than a golf club head 4100 with a relatively large loft angle 4445. Accordingly, as described herein, the amount of first filler material 4412 and/or the second filler material 4414 inside the interior cavity 4210, and more specifically, in the central portion 4211 may be determined based on the loft angle 4445 to provide (i) provide vibration dampening or sound dampening (e.g., consistent and/or pleasing sound and feel when the golf club head 4100 strikes a golf ball as perceived by an individual using the golf club head 4100), (ii) provide structural support for the face portion 4162, and/or (iii) optimize ball travel distance, ball speed, ball launch angle, ball spin rate, ball peak height, ball landing angle and/or ball dispersion. The apparatus, methods, and articles of manufacture described herein are not limited in this regard.

The contour of the interior cavity 4210 or the shape of the inner walls 4212 may be defined by a plurality of recessed portions that are recessed relative to the perimeter edge portion 4161. In the example of FIGS. 41-52, the interior cavity 4210 may include a first recessed portion 4214, a second recessed portion 4215 that may have a generally smaller depth (i.e., interior cavity width 4213 as viewed in cross section in FIGS. 44-40) relative to the first recessed portion 4214, a third recessed portion 4216 that may have a generally smaller depth than the second recessed portion 4215, a fourth recessed portion 4217 that may have a generally smaller depth than the third recessed portion 4216, and a fifth recessed portion 4218 that may have a generally smaller depth than the fourth recessed portion 4217. The interior cavity 4210 may have more or less recessed portions. The apparatus, methods, and articles of manufacture described herein are not limited in this regard.

The first recessed portion 4214 may generally include a largest width 4213 of the interior cavity 4210 and may be located at the central portion 4211 and/or may include portions that are adjacent to and/or surround the central portion 4211. The second recessed portion 4215 may be adjacent to and/or surround all or portions of the first recessed portion 4214, and may include portions that may be in the central portion 4211. In the example of FIGS. 41-52, the second recessed portion 4215 is located below the first recessed portion 4214. A portion of the structure of the body portion 4110 that includes the third set of ports 4240 may be between the second recessed portion 4215 and the lower back wall portion 4514. Accordingly, the depth of the second recessed portion 4215 may be less than the depth of the first recessed portion 4214 so that the body portion 4110 can accommodate the third set of ports 4240 between the second recessed portion 4215 and the lower back wall portion 4514. The apparatus, methods, and articles of manufacture described herein are not limited in this regard.

The third recessed portion 4216 may be adjacent to and/or surround all or portions of the second recessed portion 4215 and/or the first recessed portion 4214, and may include portions that may be in the central portion 4211. In the example of FIGS. 41-52, the third recessed portion 4216 surrounds the first recessed portion 4214 above the horizontal midplane 4420. The fourth recessed portion 4217 may be at or proximate to the perimeter edge portion 4161, and/or may be adjacent to and/or surround all or portions of the third recessed portion 4216, the second recessed portion 4215, and/or the first recessed portion 4214. In the example of FIGS. 41-52, the fourth recessed portion 4217 is adjacent to portions of the first recessed portion 4214 and the second recessed portion 4215 below the horizontal midplane 4420. A portion of the structure of the body portion 4110 that includes the second set of ports 4230 and the fourth set of ports 4250 may be between the fourth recessed portion 4217 and the lower back wall portion 4514. Accordingly, the depth of the fourth recessed portion 4217 may be less than the depths of the first recessed portion 4214 and the second recessed portion 4215 so that the body portion 4110 can accommodate the second set of ports 4230 and the fourth set of ports 4250 between the fourth recessed portion 4217 and the lower back wall portion 4514. The apparatus, methods, and articles of manufacture described herein are not limited in this regard.

The fifth recessed portion 4218 may be adjacent to the perimeter edge portion 4161. Accordingly, at any location in the interior cavity 4210 that includes the fifth recessed portion 4218, the fifth recessed portion 4218 may be between the perimeter edge portion 4161 and any one or more of the first recessed portion 4214, the second recessed portion 4215, the third recessed portion 4216, and the fourth recessed portion 4217. A portion of the structure of the body portion 4110 that includes the first set of ports 4220 may be between the fifth recessed portion 4218 and the upper back wall portion 4512. Accordingly, the depth of the fifth recessed portion 4218 may be less than the depth of the adjacent portions of the third recessed portion 4216 so that the body portion 4110 can accommodate the first set of ports 4220 between the fifth recessed portion 4218 and the upper back wall portion 4512. The apparatus, methods, and articles of manufacture described herein are not limited in this regard.

The interior cavity 4210 may include one or more internal channels that may extend between the toe portion 4140 and the heel portion 4150. In one example, as shown in FIGS. 41-52, the interior cavity 4210 may include a first internal channel 4225 that may extend from a location at the toe portion 4140 to the central portion 4211, and a second internal channel 4226 that may extend from a location at the heel portion 4150 to the central portion 4211. The first internal channel 4225 and the second internal channel 4226 connect to the first recessed portion 4214 and may have the same depth as the first recessed portion 4214 at or proximate to the central portion 4211. The depths of the first internal channel 4225 and the second internal channel 4226 may diminish from the first recessed portion 4214 toward the toe portion 4140 and heel portion 4150, respectively. As shown in the example of FIGS. 41-52, portions of the first internal channel 4225 and/or the second internal channel 4226 that connect to the first recessed portion 4214 and/or are proximate to the first recessed portion 4214 may maintain a constant depth that may be similar to the depth of the first recessed portion 4214. Alternatively, all or portions of the first internal channel 4225 and/or the second internal channel 4226 may have diminishing depths in a direction toward the toe portion 4140 and the heel portion 4150, respectively. In one example, as shown in FIGS. 41-52, the height of first internal channel 4225 increases in a direction from the toe portion 4140 to the central portion 4211 to include a relatively large and expanding triangular first channel portion 4235. Similarly, the height of the second internal channel 4226 increases in a direction from the heel portion 4150 to the central portion 4211 to include a relatively large and expanding triangular second channel portion 4236. The first channel portion 4235 and the second channel portion 4236 may effectively expand the central portion 4211 further toward the toe portion 4140 and the heel portion 4150, respectively. Accordingly, the first internal channel 4225 and the second internal channel 4226 may provide a greater volume of the first filler material 4412 and/or the second filler material 4414 between the central portion 4211 and the toe portion 4140 and the heel portion. For off-center hits of a golf ball with the face portion 4162, the increased volume of the first filler material 4412 and/or the second filler material 4414 in the internal channels 4225 and 4226 may (i) provide vibration dampening or sound dampening, (ii) provide structural support for the face portion 4162, and/or (iii) optimize ball travel distance, ball speed, ball launch angle, ball spin rate, ball peak height, ball landing angle and/or ball dispersion. Further, the mass that is removed from the body portion 4110 to provide the internal channels 4225 and 4226, and more specifically, the first channel portion 4235 and the second channel portion 4236, may be shifted to other locations on the body portion 4110 to increase and/or optimize the moment of inertia and the location of the center of gravity of the golf club head 4100. The apparatus, methods, and articles of manufacture described herein are not limited in this regard.

Figure 45:
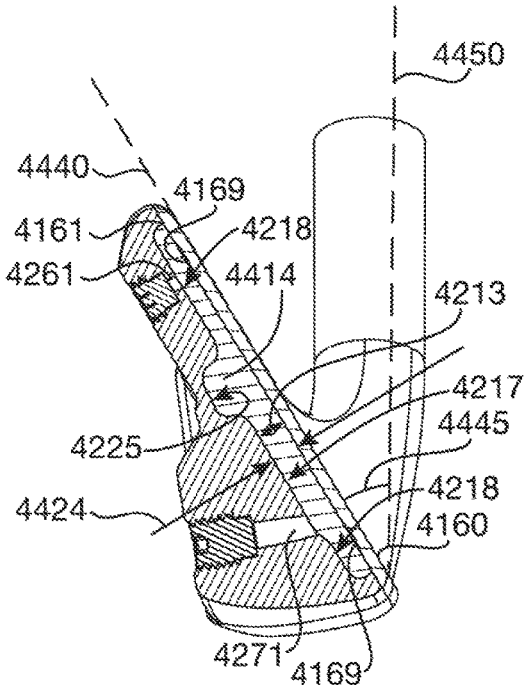
FIG. 45 depicts a perspective cross-sectional view of the golf club head of FIG. 41 taken at line 45-45 of FIG. 42.
Figure 46:
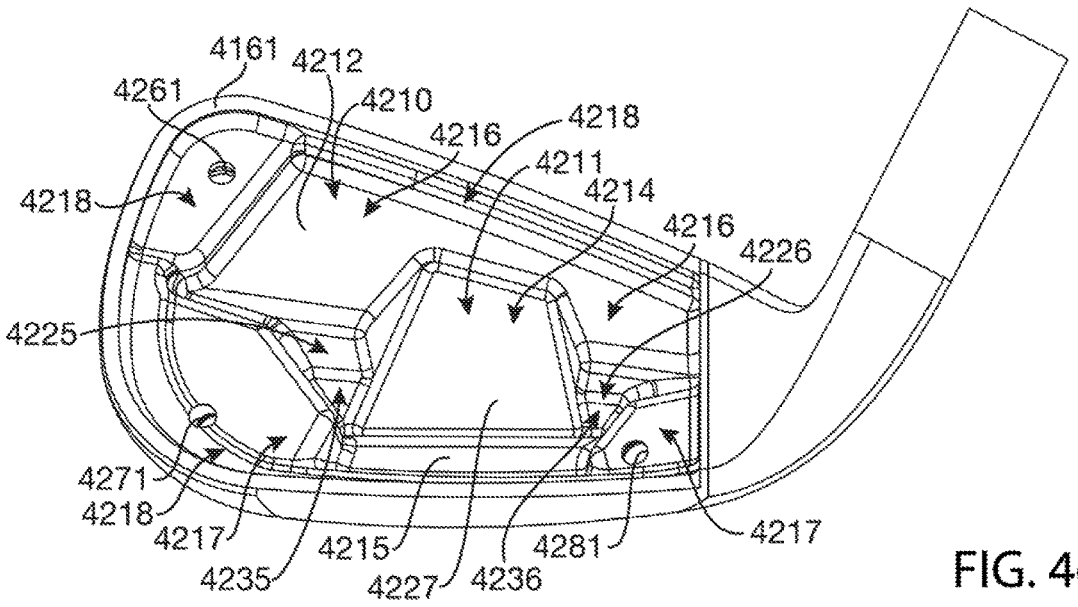
FIGS. 46-48 depict front perspective views of the golf club head of FIG. 41 shown without a face portion.
Figure 47:
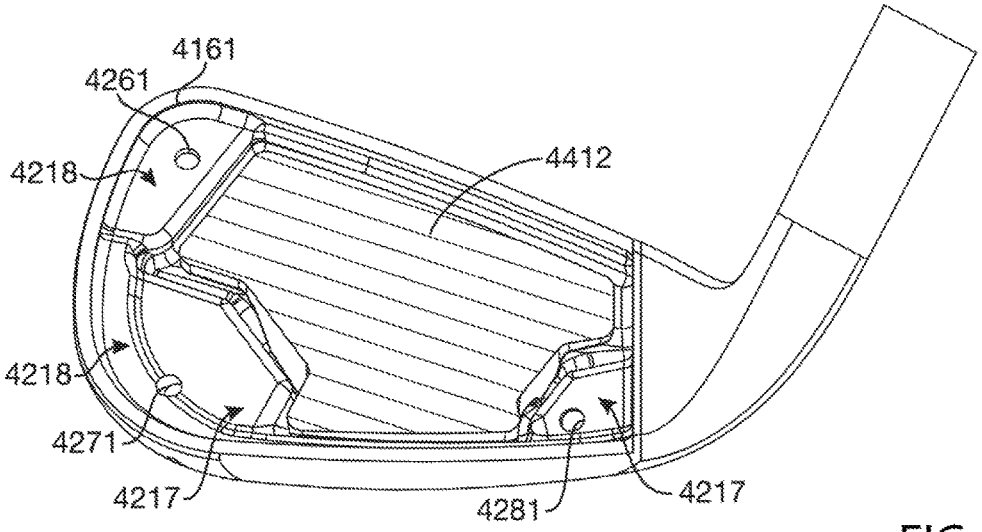
Figure 48:
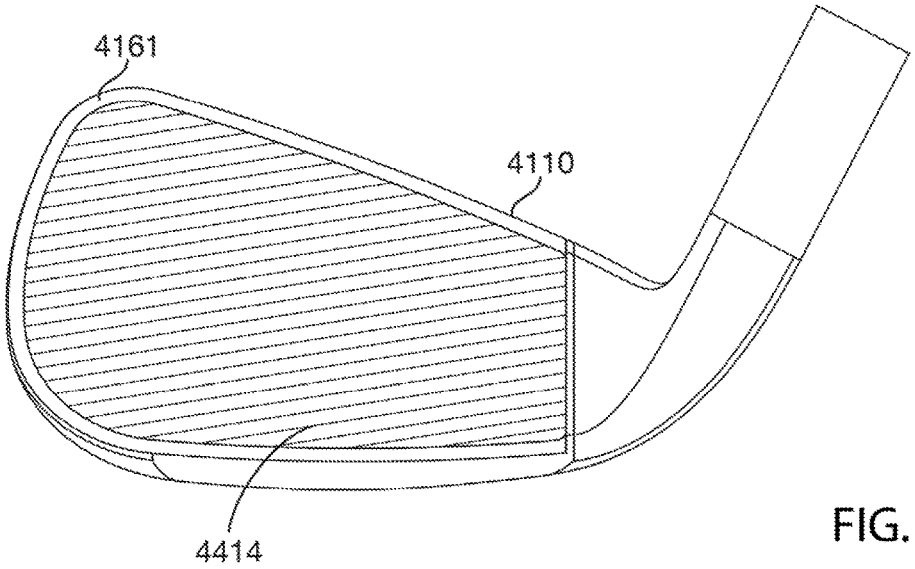
Figure 49:
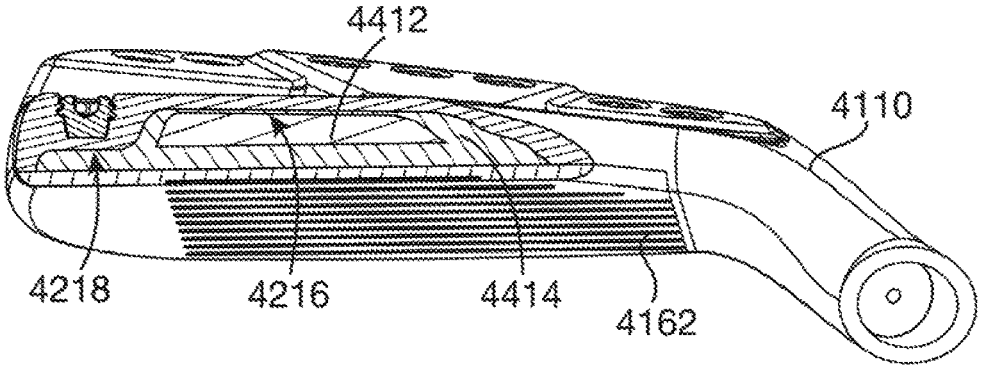
FIG. 49 depicts a top cross-sectional view of the golf club head of FIG. 41 taken at line 49-49 of FIG. 41.
Figure 50:
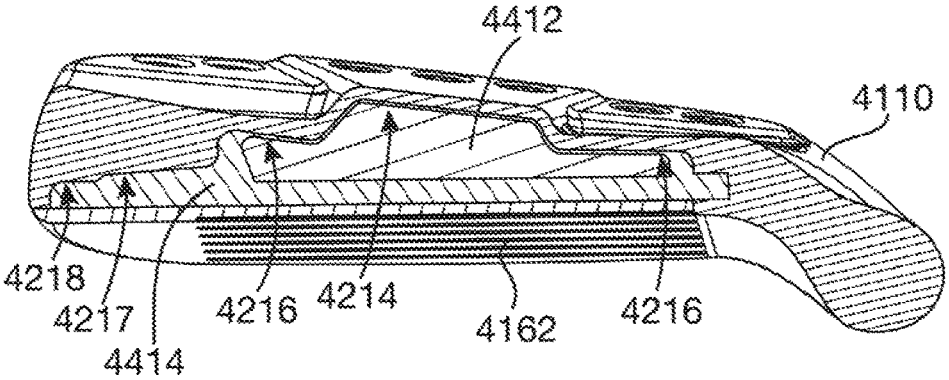
FIG. 50 depicts a top cross-sectional view of the golf club head of FIG. 41 taken at line 50-50 of FIG. 41.
Figure 51:
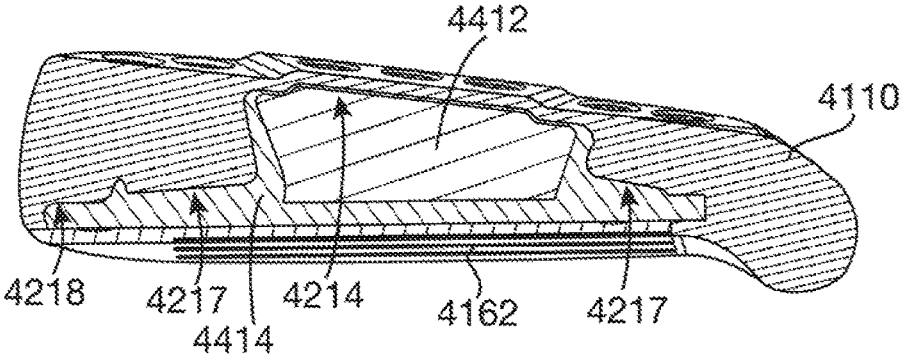
FIG. 51 depicts a top cross-sectional view of the golf club head of FIG. 41 taken at line 51-51 of FIG. 41.

The interior cavity 4210 may include additional recessed portions that may define transition regions between the first to fifth recessed portions 4214-4218 and the internal channels 4225 and 4226. Each of the recessed portions may be adjacent to and transition into any one or several of the other recessed portions. For example, as shown in FIGS. 44-46, the first recessed portion 4214 may include an inclined surface 4227 that may transition and connect to the third recessed portion 4216 above the first recessed portion 4214. Further, any of the recessed portions may directly transition to the perimeter edge portion 4161. The recessed portions and the transition regions may collectively define the overall shape and/or contour of the interior cavity 4210. The transition regions may include walls that are perpendicular, transverse, or include relative to adjacent recessed portions. Further, the transition regions may include rounded corners when joining an adjacent recessed portion to reduce stress concentrations at the joined corner. The recessed portions may define a contoured, continuous, and/or stepped reduction of the width of the interior cavity 4210 form the central portion 4211 to the perimeter edge portion 4161. The apparatus, methods, and articles of manufacture described herein are not limited in this regard.

The shape, size, width, height, and other characteristics of the recessed portions 4214-4218 and the internal channels 4225 and 4226 may be associated with the loft angle 4445 of the golf club head 4100. In one example, as shown in FIGS. 41-52, the first recessed portion 4214, the second recessed portion 4215, and the third recessed portion 4216 may be filled with the first filler material 4412. The first filler material 4412 may be injection molded in the first recessed portion 4214, the second recessed portion 4215, and the third recessed portion 4216. The filler material 4412 may be bonded to the inner walls 4212 of the first recessed portion 4214, the second recessed portion 4215, and the third recessed portion 4216 by having inherent adhesive or bonding properties, with a bonding agent that is mixed with the first filler material 4412, and/or a separate bonding agent. In another example, the first filler material 4412 may be separately molded in the shape of the first recessed portion 4214, the second recessed portion 4215, and the third recessed portion 4216, and coupled to the first recessed portion 4214, the second recessed portion 4215, and the third recessed portion 4216 with a bonding agent. In one example, the remaining portions of the interior cavity 4210, which include the fourth recessed portion 4217 and the fifth recessed portion 4218 may be filled with the second filler material 4414. Accordingly, the second filler material 4414 may be coupled to the back surface 4166 of the face portion 4162, coupled to portions of the inner walls 4212 outside the first recessed portion 4214, the second recessed portion 4215, and the third recessed portion 4216, and/or disposed between the face portion 4162 and the first filler material 4412. The apparatus, methods, and articles of manufacture described herein are not limited in this regard.

A width 4422 ($W_{F1}$) of the first filler material 4412 and the width 4424 ($W_{F2}$) of the second filler material 4414 may vary from the toe portion 4140 to the heel portion 4150 and/or from the top portion 4180 to the sole portion 4190 and/or according to the shapes of the first recessed portion 4214, the second recessed portion 4215, the third recessed portion 4216, the fourth recessed portion 4217, and/or the fifth recessed portion 4218 depending on the location inside the interior cavity 4210. The width 4422 of the first filler material 4412 may vary according to the shapes of the first recessed portion 4214, the second recessed portion 4215, and the third recessed portion 4216. The width 4422 of the first filler material 4412 and/or the width 4424 of the second filler material 4414 may be constant or substantially constant at one or more locations in the interior cavity 4210 and vary at certain other locations in the interior cavity 4210. In one example, the width 4422 of the first filler material 4412 and/or the width 4424 of the second filler material 4414 may vary at one or more locations in the interior cavity 4210 similar or substantially similar to the contour of all or portions of the inner walls 4212 of the interior cavity 4210 (i.e., the contours of the recessed portions) and/or the contours of the boundaries between the first filler material 4412 and the second filler material 4414. In one example, the second filler material 4414 may (i) provide vibration dampening or sound dampening (e.g., consistent and/or pleasing sound and feel when the golf club head 4100 strikes a golf ball as perceived by an individual using the golf club head 4100), (ii) provide structural support for the face portion 4162, and/or (iii) optimize ball travel distance, ball speed, ball launch angle, ball spin rate, ball peak height, ball landing angle and/or ball dispersion. The width 4422 of the first filler material 4412 and width 4424 of the second filler material 4414 may be determined at the ball strike region 4168 and/or other regions of the interior cavity 4210 so that a relatively high or optimum coefficient of restitution (COR) is provided for the golf club head 4100. The apparatus, methods, and articles of manufacture described herein are not limited in this regard.

The first filler material 4412 may include a polymer material having a relatively high coefficient of restitution (COR). The COR of the first filler material 4412 may be determined by shooting a golf ball sized sample of the first filler material 4412 from an air cannon toward a steel plate. Two light screens at known positions between the cannon and the plate may be used to measure the approach velocity and rebound velocities of the sample. The COR of the sample may then be calculated as the rebound velocity divided by the approach velocity. In one example, he first filler material 4412 may have a COR of greater than or equal to 0.7 at an approach velocity of 125 ft/s (44.1 m/s). In another example, the first filler material 4412 may have a COR of greater than or equal to 0.75 at an approach velocity of 125 ft/s (44.1 m/s). In yet another example, the first filler material 4412 may have a COR of greater than or equal to 0.7 and less than or equal to 0.9 at an approach velocity of 125 ft/s (44.1 m/s). The apparatus, methods, and articles of manufacture described herein are not limited in this regard.

The compression of the golf ball sized sample may be related to the COR of the golf ball sized sample. Compression is a measurement of how much the golf ball sized sample deforms (compresses) under load. A relatively lower compression rating indicates a softer filler material, whereas a relatively higher compression rating indicates a firmer filler material. Compression may be measured by using an ATTI compression gauge, manufactured by ATTI Engineering, Union City, N.J. In one example, the COR of the first filler material 4412 may be greater than or equal to 0.75 at a compression of greater than or equal to 22. In another example, the COR of the first filler material 4412 may be greater than or equal to 0.78 at a compression of greater than or equal to 2 and less than or equal to 0.8 at a compression of less than or equal to 80. In yet another example, the COR of the first filler material 4412 may be greater than or equal to 0.78 at a compression of greater than or equal to 32 and less than or equal to 0.9 at a compression of less than or equal to 90. The apparatus, methods, and articles of manufacture described herein are not limited in this regard.

In one example, the first filler material 4412 may be a polymer material having a density of greater than or equal to 1.1 g/cm$^3$ and less than or equal to 1.3 g/cm$^3$. In another example, the first filler material 4412 may be a polymer material having a density of greater than or equal to 1.15 g/cm$^3$ and less than or equal to 1.25 g/cm$^3$. In yet another example, the first filler material 4412 may be a polymer material having a density of greater than or equal to 1.1 g/cm$^3$ and less than or equal to 1.2 g/cm$^3$. The apparatus, methods, and articles of manufacture described herein are not limited in this regard.

In one example, the first filler material 4412 may be a polymer material including rubber or a rubber compound that may provide the COR and compression ranges described herein. In one example, the first filler material 4412 may include rubber and at least another compound that may provide increased softness or firmness to the first filler material 4412 to maximize the COR of the first filler material 4412 while maintaining compression values within a certain range as described herein. In one example, the first filler material 4412 may include rubber and Zinc Diacrylate (ZDA), which may increase the compression value of the first filler material 4412 and hence the COR of the first filler material 4412. The amount of Zinc Diacrylate (ZDA) in the first filler material 4412 may be varied to achieve certain COR and/or compression values as described herein. The apparatus, methods, and articles of manufacture described herein are not limited in this regard.

The adhesive for bonding the first filler material 4412 to the back wall portion 4172 may be any type of adhesive that can bond the first filler material 4412 to the material of the back wall portion 4172. In one example, the first filler material 4412 may be a rubber or a rubber compound and the back wall portion 4172 may be constructed from a steel-based material such as stainless steel. Accordingly, the adhesive for bonding the first filler material 4412 to the back wall portion 4172 may be a type of adhesive used to bond steel-based materials to rubber or rubber compounds. In another example, the first filler material 4412 may be a rubber or a rubber compound and the back wall portion 4172 may be constructed from titanium or a titanium alloy. Accordingly, the adhesive for bonding the first filler material 4412 to the back wall portion 4172 may be a type of adhesive used to bond titanium-based materials to rubber or rubber compounds. The bonding of the first filler material 4412 to any portion of the body portion 4110, the face portion 4162, and/or the second filler material 4414, and the bonding of the second filler material 4414 to the body portion 4110, the face portion 4162, and/or the first filler material 4412 may be similar to any of the bonding properties and procedures described in any of the incorporated by reference applications. The apparatus, methods, and articles of manufacture described herein are not limited in this regard.

In one example (not shown), the interior cavity 4210 may be entirely filled with the first filler material 4412. In another example, as shown in FIGS. 41-52, the interior cavity 4210 may be partially filled with the first filler material 4412. Accordingly, the remaining portions of the first interior cavity 4210 may be filled with a second filler material 4414. As described herein, the second filler material 4414 may provide or assist (e.g., alone or in conjunction with one or more adhesives) in the coupling of the first filler material 4412 with the back wall portion 4172. In other words, the second filler material 4414 may assist in maintaining or maintain the first filler material 4412 coupled to the back wall portion 4172. The apparatus, methods, and articles of manufacture described herein are not limited in this regard.

The second filler material 4414 may have one or more different properties than the first filler material 4412 such as density, compression, hardness (i.e., durometer), tensile strength, shear strength, viscosity, elasticity, etc., to optimize energy transfer from the face portion 4162 to a golf ball. The second filler material may be a polymer material. In one example, the second filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, the second filler material 4414 may be one or more thermoset polymers having bonding properties (e.g., one or more adhesive or epoxy materials). The second filler material 4414 may also absorb shock, isolate vibration, and/or dampen noise when the golf club head 400 strikes a golf ball. Further, the second filler material 4414 may be an epoxy material that may be flexible or slightly flexible when cured. In another example, the second filler material 4414 may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, the filler material may include 3M™ Scotch-Weld™ DP100 Plus Clear adhesive. In another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, the filler material may be LOCTITE® materials manufactured by Henkel Corporation, Rocky Hill, Conn. The apparatus, methods, and articles of manufacture described herein are not limited in this regard.

Figure 52:
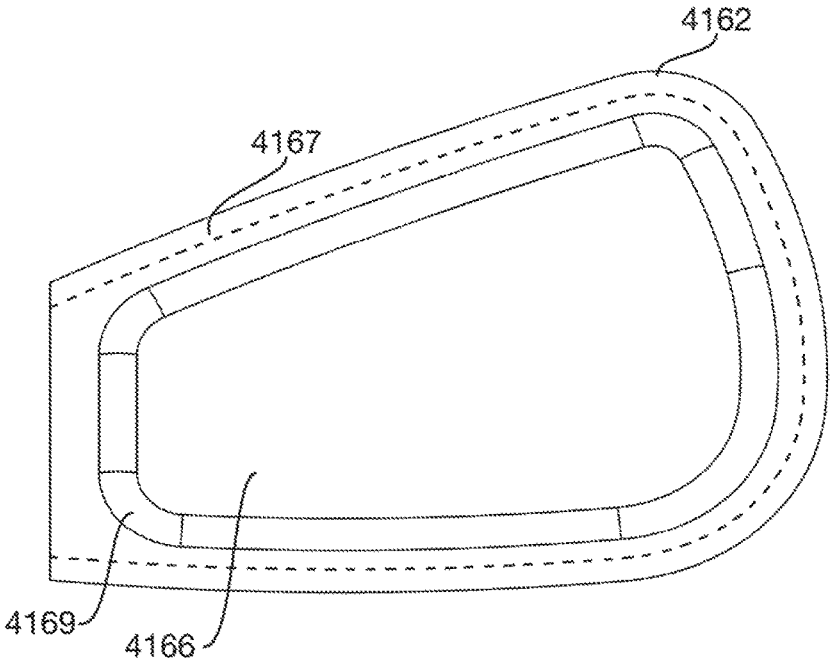
FIG. 52 depicts a back view of a face portion of a golf club head according to any embodiment of the apparatus, methods, and articles of manufacture described herein.

In one example, as shown in FIG. 52, the back surface 4166 of the face portion 4162 may include one or more grooves proximate to the perimeter portion 4167 of the face portion 4162. In one example, as shown in FIG. 52, a groove 4169 may be a continuous groove (i.e., defining a loop) extending in a path similar to the path of the perimeter portion 4167 proximate to the perimeter portion 4167. The groove 4169 includes a relatively thinner portion of the face portion 4162. Accordingly, the groove 4169 may increase the flexibility of the face portion 4162 so that when a golf ball strikes the face portion 4162, the face portion 4162 provides a greater rebound (i.e., a greater trampoline effect), and hence may provide a greater velocity for the golf ball. All or portions of the groove 4169 may be filled with the first filler material 4412 and/or second filler material 4414. In the example of the golf club head 4100, all of the groove 4169 may be filled with the second filler material 4414. Accordingly, the second filler material 4414 may structurally support the relatively thinner portions of the face portion 4162 defined by the groove 4169. The face portion of any of the golf club heads described herein may include the groove 4169. For example, the face portion 3562 of the golf club head 3500 of FIG. 35 may include a similar groove that may be filled with the second filler material 3814 and/or the first filler material 3812. The apparatus, methods, and articles of manufacture described herein are not limited in this regard.

Figure 53:
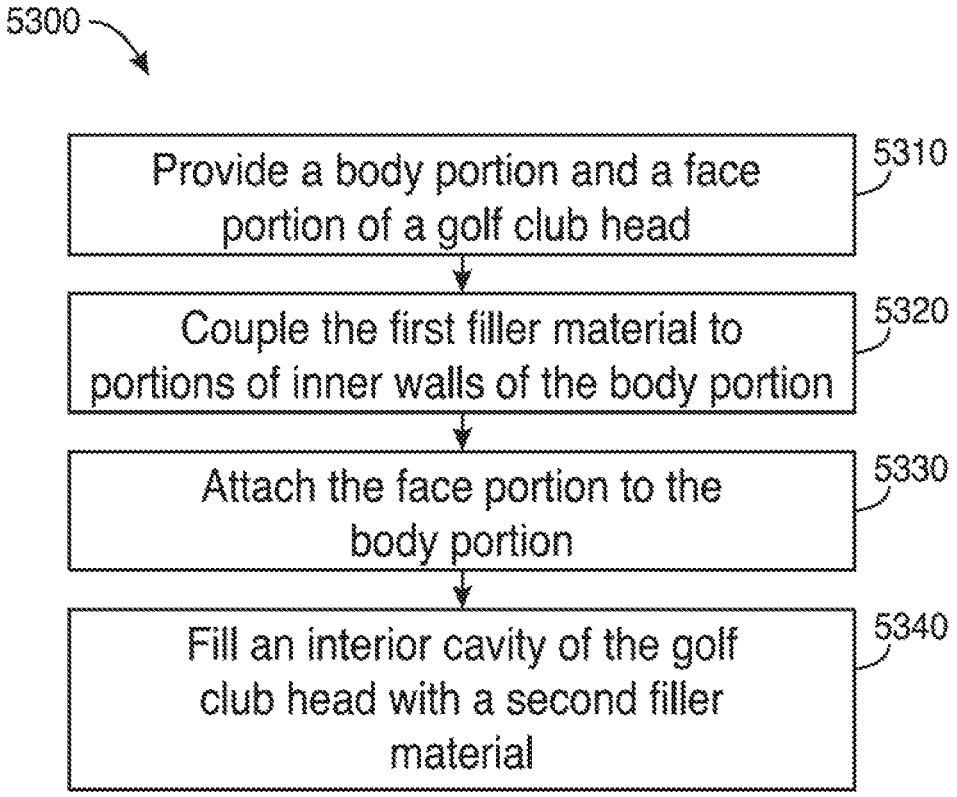
FIG. 53 depicts a manner in which an example golf club head described herein may be manufactured.

FIG. 53 depicts one manner by which the golf club head 4100 or any of the golf club heads described herein may be manufactured. In the example of FIG. 53, the process 5300 may begin with providing a body portion 4110 and a face portion 4162 of a golf club head 4100 (block 5310). The first filler material 4412 may be coupled to the interior cavity 4210 (block 5320). In one example, the first filler material 4412 may be formed in one or more recessed portions as described herein (i.e., any of the recessed portions described herein) of the interior cavity 4210 by injection molding. The first filler material 4412 may then cure at ambient temperature or by one or more heating/cooling cycles depending on the material used for the first filler material 4412. In another example, the first filler material 4412 may be molded into the shape of one or more recessed portions as described herein and then coupled to the one or more recessed portions with a bonding agent as described herein. The face portion 4162 may then be attached to the body portion 4110 as described herein to enclose the interior cavity 4210 (block 5330). The second filler material 4414 may then be injected into the interior cavity 4210 through one or more of the ports of the first set of ports 4220, the second set of ports 4230, the third set of ports 4240, and/or the fourth set of ports 4250 that may be connected to the interior cavity 4210 as described herein (block 5340). The second filler material 4414 may then cure at ambient temperature or by one or more heating/cooling cycles depending on the material used for the second filler material 4414. The apparatus, methods, and articles of manufacture described herein are not limited in this regard.

Figure 54:
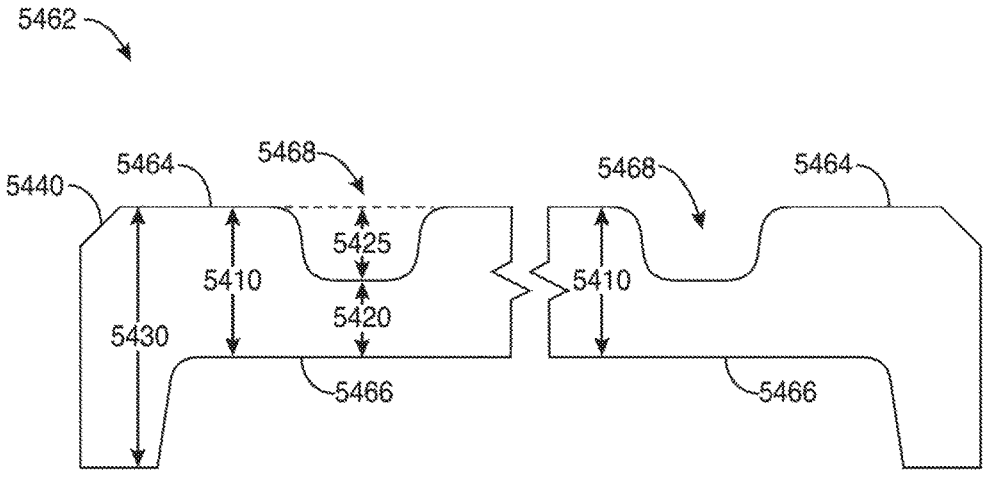
FIG. 54 depicts a cross-sectional view of a face portion according to any embodiment of the apparatus, methods, and articles of manufacture described herein.

In one example, as shown in FIG. 54, a face portion 5462 may have a first thickness 5410 (T1) or a second thickness 5420 (T2). The first thickness 5410 may be a thickness of a section of the face portion 5462 adjacent to a groove 5468 whereas the second thickness 5420 may be a thickness of a section of the face portion 5462 below the groove 5468. For example, the first thickness 5410 may be a maximum distance between the front surface 5464 and the back surface 5466. The second thickness 5420 may be based on the groove 5468. In particular, the groove 5468 may have a groove depth 5425 (Dgroove). The second thickness 5420 may be a maximum distance between the bottom of the groove 5468 and the back surface 5466. The sum of the second thickness 5420 and the groove depth 5425 may be substantially equal to the first thickness 5410 (e.g., T2+Dgroove=T1). Accordingly, the second thickness 5420 may be less than the first thickness 5410 (e.g., T2<T1).

To lower and/or move the CG of a golf club head further back, such as the CG of any of the golf club heads described herein, mass from the front portion of a golf club head may be removed by using a relatively thinner face portion 5462. For example, the first thickness 5410 or the second thickness 5420 may be less than or equal to 0.1 inch (2.54 millimeters). In another example, the first thickness 5410 or the second thickness 5420 may be about 0.075 inch (1.905 millimeters) (e.g., T1=0.075 inch). With the support of the back wall portion of a golf club head to form an interior cavity and filling at least a portion of the interior cavity with one or more filler materials as described herein, the face portion 5462 may be relatively thinner (e.g., T1<0.075 inch) without degrading the structural integrity, sound, and/or feel of a golf club head. In one example, the first thickness 5410 may be less than or equal to 0.060 inch (1.524 millimeters) (e.g., T1≤0.060 inch). In another example, the first thickness 5410 may be less than or equal to 0.040 inch (1.016 millimeters) (e.g., T1≤0.040 inch). Based on the type of material(s) used to form the face portion 5462 and/or the body portion 110, the face portion 5462 may be even thinner with the first thickness 5410 being less than or equal to 0.030 inch (0.762 millimeters) (e.g., T1≤0.030 inch). The groove depth 5425 may be greater than or equal to the second thickness 5420 (e.g., Dgroove≥T2). In one example, the groove depth 5425 may be about 0.020 inch (0.508 millimeters) (e.g., Dgroove=0.020 inch). Accordingly, the second thickness 5420 may be about 0.010 inch (0.254 millimeters) (e.g., T2=0.010 inch). In another example, the groove depth 5425 may be about 0.015 inch (0.381 millimeters), and the second thickness 5420 may be about 0.015 inch (e.g., Dgroove=T2=0.015 inch). Alternatively, the groove depth 5425 may be less than the second thickness 5420 (e.g., Dgroove<T2). Without the support of the back wall portion of a golf club head and one or more filler materials used to fill in the interior cavity, the golf club head may not be able to withstand multiple impacts by a golf ball on a face portion. In contrast, a golf club head with a relatively thin face portion but without the support of the back wall portion and the one or more filler materials as described herein (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form a golf club head such as any of the golf club heads described herein, the face portion 5462 may include additional material at or proximate to a periphery of the face portion 5462. Accordingly, the face portion 5462 may also include a third thickness 5430, and a chamfer portion 5440. The third thickness 5430 may be greater than either the first thickness 5410 or the second thickness 5420 (e.g., T3>T1>T2). In particular, the face portion 5462 may be coupled to the body portion of a golf club head by a welding process. For example, the first thickness 5410 may be about 0.030 inch (0.762 millimeters), the second thickness 5420 may be about 0.015 inch (0.381 millimeters), and the third thickness 5430 may be about 0.050 inch (1.27 millimeters). Accordingly, the chamfer portion 5440 may accommodate some of the additional material when the face portion 5462 is welded to the body portion of the golf club head.

Figure 55:
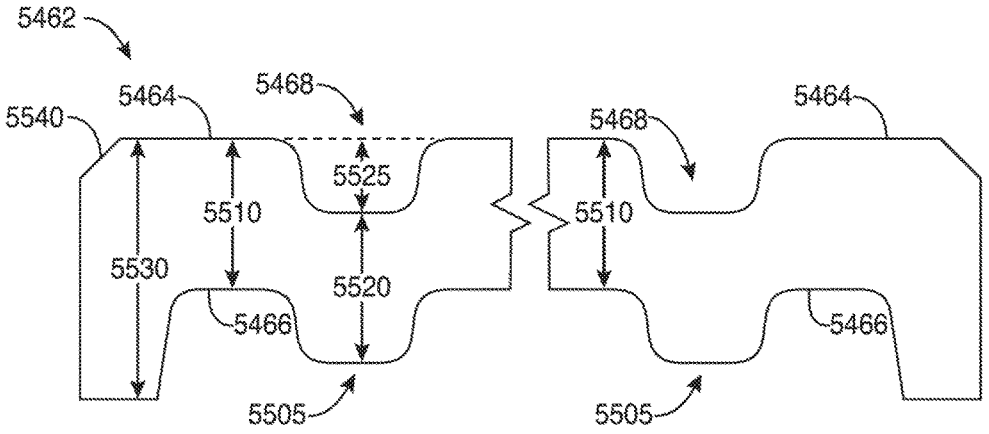
FIG. 55 depicts a cross-sectional view of another face portion according to any embodiment of the apparatus, methods, and articles of manufacture described herein.

As illustrated in FIG. 55, for example, the face portion 5462 may include a reinforcement section, generally shown as 5505, below one or more grooves 5468. In one example, the face portion 5462 may include a reinforcement section 5505 below each groove. Alternatively, face portion 5462 may include the reinforcement section 5505 below some grooves (e.g., every other groove) or below only one groove. The face portion 5462 may include a first thickness 5510, a second thickness 5520, a third thickness 5530, and a chamfer portion 5540. The groove 5468 may have a groove depth 5525. The reinforcement section 5505 may define the second thickness 5520. The first and second thicknesses 5510 and 5520, respectively, may be substantially equal to each other (e.g., T1=T2). In one example, the first and second thicknesses 5510 and 5520, respectively, may be about 0.030 inch (0.762 millimeters) (e.g., T1=T2=0.030 inch). The groove depth 5525 may be about 0.015 inch (0.381 millimeters), and the third thickness 5530 may be about 0.050 inch (1.27 millimeters). The groove 5468 may also have a groove width. The width of the reinforcement section 5505 may be greater than or equal to the groove width. The apparatus, methods, and articles of manufacture described herein are not limited in this regard.

Alternatively, the face portion 5462 may vary in thickness at and/or between the top portion and the sole portion of a golf club head. In one example, the face portion 5462 may be relatively thicker at or proximate to the top portion than at or proximate to the sole portion (e.g., thickness of the face portion 5462 may taper from the top portion towards the sole portion). In another example, the face portion 5462 may be relatively thicker at or proximate to the sole portion than at or proximate to the top portion (e.g., thickness of the face portion 5462 may taper from the sole portion towards the top portion). In yet another example, the face portion 5462 may be relatively thicker between the top portion and the sole portion than at or proximate to the top portion and the sole portion (e.g., thickness of the face portion 5462 may have a bell-shaped contour). The face portion 5462 may be similar to any of the face portions described in any of the incorporated by reference applications. The apparatus, methods, and articles of manufacture described herein are not limited in this regard.

Figure 56:
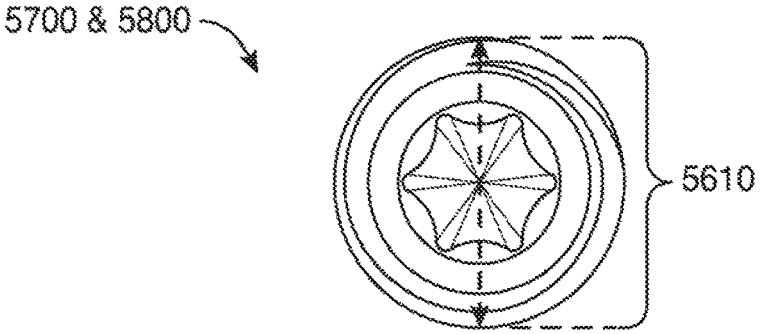
FIG. 56 depicts a top view of a mass portion according to any embodiment of the apparatus, methods, and articles of manufacture described herein.

One or more mass portions of any of the sets of mass portions described herein may have similar or different physical properties (e.g., color, marking, shape, size, density, mass, volume, external surface texture, materials of construction, etc.). Accordingly, any of the sets of mass portions described herein may contribute to the ornamental design of a golf club head. In the illustrated example as shown in FIG. 56, one or more mass portions of any of the sets of mass portions described herein may have a cylindrical shape (e.g., a circular cross section). Alternatively, one or more mass portions of any of the sets of mass portions described herein may have a first shape (e.g., a cylindrical shape) whereas one or more mass portions of another one of the sets of mass portions as described herein may have a second shape (e.g., a cubical shape). In another example, one or more mass portions of any of the sets of mass portions described herein may include two or more mass portions with different shapes. In another example, one or more mass portions of any of the sets of mass portions described herein may have a different color(s), marking(s), shape(s), density or densities, mass(es), volume(s), material(s) of construction, external surface texture(s), and/or any other physical property as compared to one or more mass portions of another one of the sets of mass portions as described herein. The properties of any of the mass portions and sets of mass portions described herein may be similar to any of the mass portions and sets of mass portions described in any of the incorporated by reference applications. The apparatus, methods, and articles of manufacture described herein are not limited in this regard.

Figure 57:
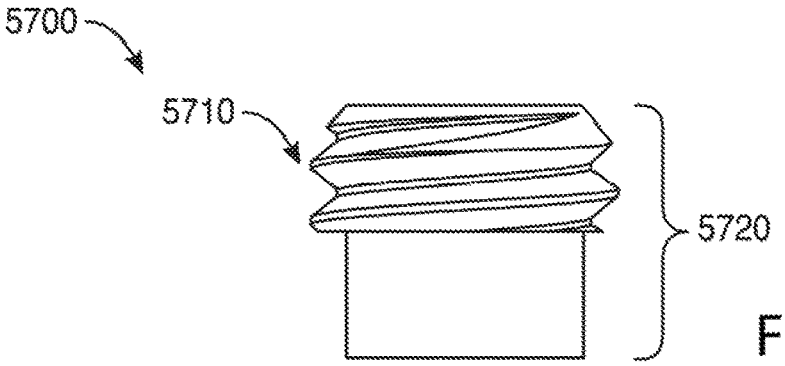
FIG. 57 depicts a side view of a mass portion according to any embodiment of the apparatus, methods, and articles of manufacture described herein.
Figure 58:
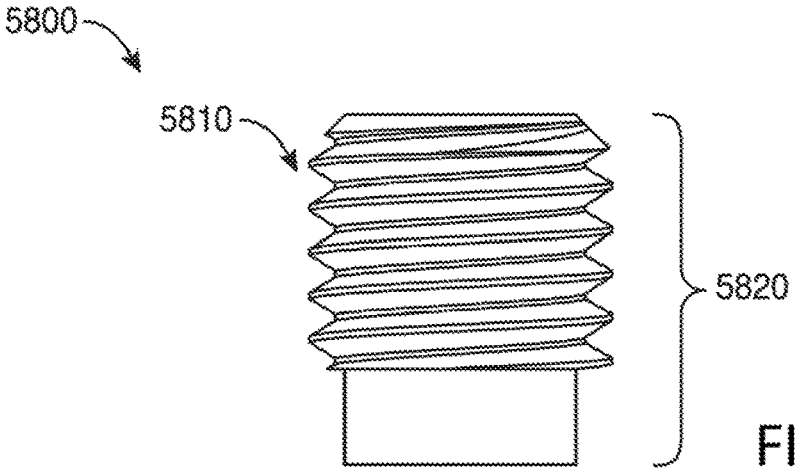
FIG. 58 depicts a side view of another mass portion according to any embodiment of the apparatus, methods, and articles of manufacture described herein.

Referring to FIGS. 57 and 58, for example, a first mass portion 5700 and a second mass portion 5800 may include threads, generally shown as 5710 and 5810, respectively, to engage with correspondingly configured threads in ports on the to secure in the ports as described herein. Accordingly, one or more mass portions as described herein may be shaped similar to and function as a screw or threaded fastener for engaging threads in a port. For example, one or more mass portions of any of the sets of mass portions described herein may be a screw. One or more mass portions of any of the mass portions described herein may not be readily removable from the body portion of a golf club head with or without a tool. Alternatively, one or more mass portions of any of the sets of mass portions described herein may be readily removable (e.g., with a tool) so that a relatively heavier or lighter mass portion may replace one or more mass portions of any of the sets of mass portions described herein. In another example, one or more mass portions of any of the sets of mass portions described herein may be secured in the ports with epoxy or adhesive so that the mass portions may not be readily removable. In yet another example, one or more mass portions of any of the sets of mass portions described herein may be secured in the ports with both threads and thread sealant (e.g. acrylic adhesive, cyanoacrylate adhesive, epoxy, thermoplastic adhesive, silicone sealant, or urethane adhesive) so that the mass portions may not be readily removable. In yet another example, one or more mass portions of any of the sets of mass portions described herein may be press fit in a port. In yet another example, one or more mass portions of any of the sets of mass portions described herein may be formed inside a port by injection molding. For example, a liquid metallic material (i.e., molten metal) or a plastic material (e.g. rubber, foam, or any polymer material) may be injected or otherwise introduced into a port. After the liquid material is cooled and/or cured inside the port, the resulting solid material (e.g., a metal material, a plastic material, or a combination thereof) may form a mass portion. The apparatus, methods, and articles of manufacture described herein are not limited in this regard.

As mentioned above, one or more mass portions of any of the sets of mass portions described herein may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. In yet another example, as illustrated in FIGS. 56-58, one or more mass portions of any of the sets of mass portions described herein may have a diameter 5610 of about 0.25 inch (6.35 millimeters) but one or more mass portions of another one or more sets of mass portions described herein may be different in height. In particular, one or more mass portions of any of the sets of mass portions described herein may be associated with a first height 5720, and one or more mass portions of another one or more sets of mass portions described herein may be associated with a second height 5820. The first height 5720 may be relatively shorter than the second height 5820. In one example, the first height 5720 may be about 0.125 inch (3.175 millimeters) whereas the second height 5820 may be about 0.3 inch (7.62 millimeters). In another example, the first height 5720 may be about 0.16 inch (4.064 millimeters) whereas the second height 5820 may be about 0.4 inch (10.16 millimeters). Alternatively, the first height 5720 may be equal to or greater than the second height 5820. Although the above examples may describe particular dimensions, one or more mass portions described herein may have different dimensions. In one example, any of the mass portions described herein may be interchangeably used in any of the ports described herein. Any property of any of the mass portions described herein may be similar to the corresponding property of any of the mass portions described in any of the incorporated by reference applications. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference applications. The apparatus, methods, and articles of manufacture described herein are not limited in this regard.

Any of the golf club heads described herein may be manufactured by casting from metal such as steel. However, other techniques for manufacturing a golf club head as described herein may be used such as 3D printing, or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The apparatus, methods, and articles of manufacture described herein may include one or more club identifiers (e.g., a serial number, a matrix barcode, a trademark, a club number, a loft angle, a character, etc.). For example, any of the golf club heads described herein may include a visual indicator such as a club number to identify the type of golf club. In particular, the club number may correspond to the loft angle of the golf club head (e.g., 3, 4, 5, 6, 7, 8, or 9). In one example, a 7-iron type golf club head may be marked with "7". In another example, a golf club head may be marked with the loft angle. For example, a 54-degree wedge type golf club head may be marked "54". In yet another example, a 10.5-degree driver type golf club head may be marked "10.5." Any marking(s) associated with a club identifier may be visually differentiated (e.g., different color, texture, pattern, etc.) from the rest of a golf club head. To distinguish from other golf club heads, a golf club head as described herein may include a trademark (e.g., a word, a name, a symbol, a design, or any combination thereof) to identify a brand name or a model of the golf club head (e.g., distinguish from other manufacturer or seller). The club identifier may be another type of visual indicator such as a product number or a serial number to identify the golf club head as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various location on the golf club head (e.g., the heel portion, the hosel portion, the face portion, the top portion, the sole portion, etc.) using various methods (e.g., painted, laser etched, stamped, casted, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy). The apparatus, methods, and articles of manufacture described herein are not limited in this regard.

While the above examples may describe an iron-type or a wedge-type golf club head, the apparatus, methods, and articles of manufacture described herein may be applicable to other types of golf club heads. Further, although the above examples may describe steel-based material, the apparatus, methods, and articles of manufacture described herein may be applicable to other types of metal materials, non-metal materials, or both.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "a," "an," and/or "the" used in the context of describing various embodiments the present disclosure are to be construed to cover both the singular and the plural, unless otherwise indicated herein or clearly contradicted by context. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein. The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto.

On the contrary, this disclosure covers all apparatus, methods, and articles of articles of manufacture fairly falling within the scope of the appended claims either literally or under the doctrine of equivalents.

What is claimed is:

1. A golf club head comprising:

a face portion having a front surface and a back surface opposite of the front surface, the back surface having a perimeter portion;

a body portion having an interior cavity, the body portion having a front portion with a perimeter edge portion defining an outermost surface of the front portion, the perimeter edge portion of the body portion attached to the perimeter portion of the face portion;

a first filler material coupled to a portion of an inner wall of the body portion, the first filler material including a rubber material and having a first density; and a second filler material injection molded into the interior cavity between the first filler material and the face portion, the second filler material including a thermoset material and having a second density different from the first density, wherein a maximum width of the first filler material is aligned with a central portion of the face portion, and wherein the back surface of the face portion includes a continuous groove extending along and proximate to a perimeter of the face portion, and wherein the groove is filled with the second filler material.

2. A golf club head as defined in claim 1, wherein the first filler material comprises a material bonded to the portion of the inner wall with a bonding agent.

3. A golf club head as defined in claim 1, wherein a coefficient of restitution of the first filler material is greater than a coefficient of restitution of the second filler material.

4. A golf club head as defined in claim 1, wherein the face portion is attached to the body portion after the first filler material is coupled to a portion of an inner wall of the body portion.

5. A golf club head as defined in claim 1, wherein the body portion includes a plurality of recessed portions defining the interior cavity, wherein a central recessed portion of the plurality of recessed portions includes the maximum width of the interior cavity, and wherein the central recessed portion is filled with the first filler material.

6. A golf club head as defined in claim 1, wherein the body portion includes a plurality of recessed portions defining the interior cavity, wherein a width of the interior cavity decreases from a central recessed portion of the plurality of recessed portions to one or more recessed portions of the plurality of recessed portions adjacent the perimeter edge portion of the body portion.

7. A golf club head as defined in claim 1, wherein the body portion includes a club identifier associated with the golf club head.

8. A golf club head comprising:

a face portion having a front surface and a back surface opposite of the front surface, the face portion defining a loft angle, the face portion including a groove on the back surface extending proximate to a periphery of the face portion;

a body portion coupled to the face portion, the body portion having an interior cavity including a central recessed portion aligned with a central portion of the face portion, the central recessed portion having a shape associated with the loft angle, the central recessed portion including a maximum width of the interior cavity;

a first filler material coupled to the body portion in at least the central recessed portion and filling the central recessed portion; and a second filler material injection molded into the interior cavity, at least a portion of the second filler material coupled to the back surface of the face portion and located between the first filler material in the central recessed portion and the face portion, the second filler material having at least one different material property than the first filler material, wherein the groove is at least partially filled with the second filler material.

9. A golf club head as defined in claim 8, wherein the face portion is welded to the body portion after the first filler material is coupled to the body portion.

10. A golf club head as defined in claim 8, wherein the interior cavity includes a plurality of recessed portions adjacent to the central recessed portion, and wherein the second filler material at least partially fills the plurality of recessed portions.

11. A golf club head as defined in claim 8, wherein the maximum width of the interior cavity is proximate to geometric center of the face portion.

12. A golf club head as defined in claim 8, wherein a coefficient of restitution of the first filler material is greater than a coefficient of restitution of the second filler material.

13. A golf club head as defined in claim 8, wherein the first filler material comprises a rubber material, and wherein the second filler material comprises a thermoset material.

14. A golf club head comprising:

a face portion having a front surface and a back surface opposite of the front surface;

a body portion coupled to the face portion, the body portion having an interior cavity and one or more inner walls;

a first filler material coupled to the body portion, the first filler material covering at least 25% of the one or more inner walls; and a second filler material injection molded into the interior cavity, wherein a coefficient of restitution (COR) of the first filler material is greater than the COR of the second filler material, wherein a greatest width of the first filler material is at or proximate to a central portion of the face portion, and wherein the back surface of the face portion includes a continuous groove extending along and proximate to a perimeter of the face portion, and wherein the groove is filled with the second filler material.

15. A golf club head as defined in claim 14, wherein the first filler material is injection molded in the interior cavity before the face portion is attached to the body portion.

16. A golf club head as defined in claim 14, wherein the first filler material is preformed and attached to the body portion.

17. A golf club head as defined in claim 14, wherein first filler material comprises a rubber material.

18. A golf club head as defined in claim 14, wherein the second filler material comprises a thermoset material.

19. A golf club head as defined in claim 14, wherein an area of the front surface of the face portion is greater than or equal to 200 $mm^2$ and less than or equal to 5000 $mm^2$.

* * * * *